US007647708B2

(12) United States Patent
Christoffersen

(10) Patent No.: US 7,647,708 B2
(45) Date of Patent: Jan. 19, 2010

(54) MANUFACTURING METHODS FOR PRODUCING PARTICLEBOARD, OSB, MDF AND SIMILAR BOARD PRODUCTS

(76) Inventor: William Christoffersen, 2016 NE. Bluebird Ct., Bend, OR (US) 97701

( * ) Notice: Subject to any disclaimer, the term of this patent is extended or adjusted under 35 U.S.C. 154(b) by 722 days.

(21) Appl. No.: 11/096,211

(22) Filed: Mar. 30, 2005

(65) Prior Publication Data

US 2006/0049537 A1 Mar. 9, 2006

Related U.S. Application Data

(62) Division of application No. 10/406,826, filed on Apr. 4, 2003, now abandoned.

(60) Provisional application No. 60/378,763, filed on May 7, 2002, provisional application No. 60/370,186, filed on Apr. 4, 2002, provisional application No. 60/370,187, filed on Apr. 4, 2002.

(51) Int. Cl.
*F26B 17/08* (2006.01)

(52) U.S. Cl. ..... 34/589; 34/611; 34/640

(58) Field of Classification Search ..... None
See application file for complete search history.

(56) References Cited

U.S. PATENT DOCUMENTS

| | | | | | |
|---|---|---|---|---|---|
| 4,472,887 | A * | 9/1984 | Avedian et al. | ..... | 34/496 |
| 4,704,805 | A * | 11/1987 | Kaya et al. | ..... | 34/483 |
| 4,785,551 | A * | 11/1988 | Meyer | ..... | 34/368 |
| 5,473,825 | A * | 12/1995 | Conselvan et al. | ..... | 34/389 |
| 5,635,123 | A * | 6/1997 | Riebel et al. | ..... | 264/125 |
| 5,755,238 | A * | 5/1998 | Soots et al. | ..... | 131/302 |
| 2001/0015020 | A1 * | 8/2001 | Uehara | ..... | 34/446 |

* cited by examiner

*Primary Examiner*—Mary Lynn F Theisen
(74) *Attorney, Agent, or Firm*—patenttm.us

(57) ABSTRACT

Methods and apparatus for manufacturing particleboard (PB), medium density fiberboard (MDF), oriented strand board (OSB) and board products and the like employ density control for producing a board product having a desired configuration.

4 Claims, 70 Drawing Sheets

Stacking Arrangement

Vacuum Plate

Placement of Lifters and Vacuum Plate

Ski Type Compression Fingers
(To Be Placed Over the Mat or Material)

Wheel Type Compression Units
(To Be Placed Over the Mat or Material)

CNC Scalping Device Components

CNC Scalper Assembly End View

CNC Scalper Assembly Partial Plan View
Long Rake Configuration

CNC Scalper Assembly Partial Plan View
Short Rake Configuration

CNC Narrow-Width Scalper Assembly Partial Plan View

CNC Ultra-Narrow-Width Scalper Assembly
Partial Plan View

CNC Ultra-Narrow-Width Scalper Device Components

CNC Scalper Location

Vibrating Forming Head or Conveyor

Fluidizing Tines Arrangement & Placement
(Viewed From Outfeed End of Forming Head)

Sketch of Truss

Composite Panel Density by Depth

Fines Separation Concept

Particleboard Face Forming Head Design #1

Face Forming Head
Conveyor and Side Wall Configuration

Particleboard Forming Machine Configuration 1

MDF Mat Compressing

Forming Head with Angled Scalper
&
Material Funnel

Longitudinal or Lengthwise Orienting Device

Crosswise Orienting Device

4-Head OSB Forming Machine

Fine Tuning Forming Head (Final Stage)
With Capture Trough

Flap Design

5-Head OSB Forming Machine Configuration

Extruder Forming Head

Fines Only Forming Head

Particleboard Forming Machine Utilizing Extruder Forming Heads
PB Forming Machine Configuration 2

Smaller-Capacity Particleboard Forming Machine Utilizing Extruder & Fines Skimming Concept
PB Forming Machine Configuration 3

MDF Forming Machine Utilizing Extruder Forming Head & Mat Shaver

Pivoting Arm CNC Scalping Device Components

Pivoting Arm Scalping CNC Device
Side View

Pivoting Arm CNC Scalper Multiple Assembly
Side View

Pivoting Arm CNC Scalper Assembly With Large Dust Hood
Overhead View

Pivoting Arm CNC Scalper Chain or Belt Picker Configuration Components

Pivoting Arm CNC Scalper Chain or Belt Picker Configuration

Pivoting Arm CNC Scalper Chain or Belt Picker Configuration
Overhead View of Multiple Assemblies Mounted Onto Main Shaft Pivoting Arm CNC Scalper Chain or Belt Configuration
Side View Illustrating Means of Eliminating Slider Banana Roll or Bow Roll Position Layout Scalping Belt Configuration Longitudinal Scalping Belt Method Particleboard Air Separation Face Forming Head Particleboard Forming Machine With Air Separation
View of Bottom Face and Bottom Core Heads Only Particleboard Face Forming Head
Combines Lifters, Fines Skimming and Air Nozzle Fines Separation Particleboard Forming Machine With Screening
PB Configuration 4

Particleboard Forming Machine With Remote Screening
PB Configuration 5

Particleboard Forming Machine With Fluidizing Tines
PB Configuration 6

Particleboard "Depositing Belt" Forming Head

"Belt Depositing" Bottom Face Forming Head

Particleboard Forming Machine Configuration 7

Multi-Level Depositing Belt
Particleboard Forming Machine Face Head Configuration Chamber General Configuration Channels Conduct Heating Fluid Heating Medium Is Conducted Through Ducting In A Pressurized Plate Stacking Arrangement Stacking Arrangement Mounted Into Two Frames That Are Nested Together Inlet of Christoffersen Continuous Press Multiple Upper Platens Continuous Press with Vibrating Platens Top & Bottom Continuous Press Conveying Forward Pinch Roll Conveying Cam Follower & Slot
Left-To-Right Pathway for Top Platen Framework Example D-drive Linkage Example Phase Positioning of 4 sets of Platens Continuous Press with Example Multiphase Platen Configuration Multiphase Configuration with Upper Tapered Compression Zone

MANUFACTURING METHODS FOR PRODUCING PARTICLEBOARD, OSB, MDF AND SIMILAR BOARD PRODUCTS

BACKGROUND OF THE INVENTION

This invention relates to the production of particleboard, OSB (oriented strand board), MDF (Medium Density Fiberboard) and the like.

SUMMARY OF THE INVENTION

In accordance with the invention, new manufacturing methods for producing particleboard, OSB, MDF and similar board products are shown and described.

It is an object of the present invention to provide an improved method and apparatus for producing particleboard.

It is another object of the present invention to provide an improved method and apparatus for producing OSB.

It is a further object of the present invention to provide an improved method and apparatus for producing MDF.

It is still another object of the present invention to provide an improved method and apparatus for producing board products.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
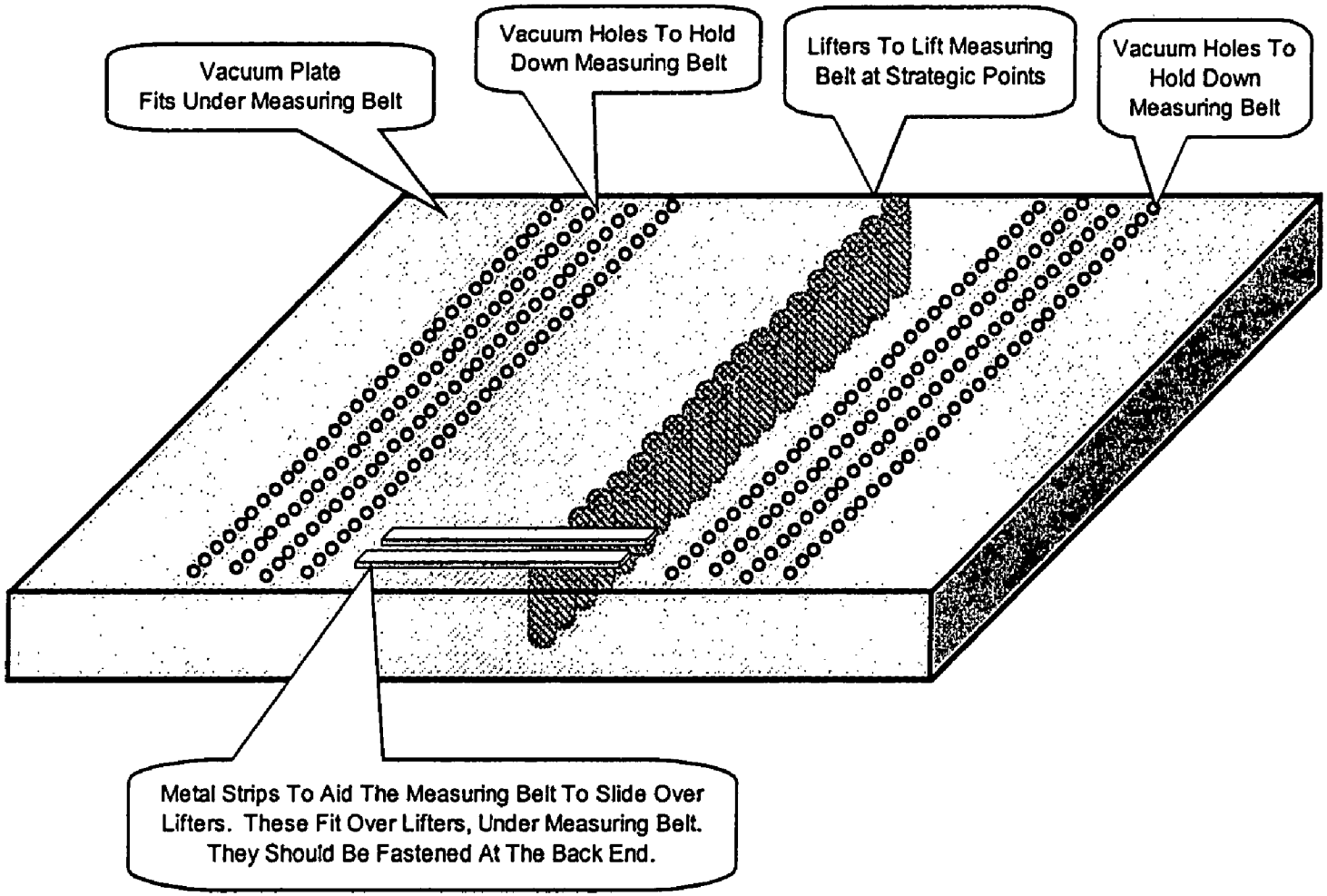
FIGS. 1 & 2 illustrate general arrangements of the lifters and vacuum plate.

The system according to a preferred embodiment of the present invention comprises methods and apparatus for forming board products.

Forming Machine Introduction

This application contains a variety of concept descriptions and illustrations in sufficient detail for the reader to readily understand how the ideas may be combined and implemented in a variety of forming machine designs for particleboard, medium density fiberboard ("MDF"), oriented strand board ("OSB"), and related or similar board products.

It is assumed that not all persons involved in the decision about acquiring this technology are cognizant of the problems inherent in manufacturing these board products. Therefore, the descriptions of problems and other comments will be a review for engineers and sales personnel with relevant experience. On the other hand, it is also assumed that not all of the apparent design combinations need to be spelled out.

Most designs discussed in this presentation are also applicable to other industries where material forming can be enhanced through the control of density or material volume consistency. For example, tobacco being formed for cigarettes can be more precisely layered by utilizing these methods of controlling density and material size separation. Forming felt for the textile industry can also be better controlled with similar applications of these principals. Better control of the density of paper pulp as it is being formed for paper can reduce the cost of manufacturing. Another example is the rubber industry where the control of the application of dry or slurry material in a layer is important.

Section I

General

The following subjects are for general information and apply to the different forming machine types to be addressed for three different types of board products. Rather than review each subject with discussions about forming particleboard, then with MDF, and finally again with OSB, this section will provide general information that is common to each of the forming machine types.

Density Control

A key element in forming machine designs is the ability to form product on the line with a very consistent density. Furthermore, the major goal over the past decades has been to achieve improvements in consistency of cross-panel (transverse) density and longitudinal density consistency from panel to panel as they are produced. Thus, the industry has been seeking tighter manufacturing parameters for density.

The first benefit of tighter parameters is better manufacturing cost due to reduced wood, resin and wax material usage. So, there is a reduction in direct material costs.

The second benefit is faster press cycles for a corresponding reduction in the density of the board product. This results in a reduction in manufacturing cost due to the reduced fixed overhead and labor per square foot as more square feet are produced per hour and per year.

Rather than focusing solely upon devising systems that inherently deposit the material onto the forming belt in a uniform manner, this (the "Christoffersen") design attacks the problem directly by controlling density. Included are devised methods that make it possible to make ongoing density corrections regardless of the condition of the formed mat. This results in the ability to "dial in" a desired density or density profile and the system will seek to create a mat with that density in every square inch of its construction. The degree of accuracy may be customized to suit each individual customer by a corresponding amount of capital investment.

Forming machines currently on the market frequently generate density variations that appear in general patterns for more than several minutes and often for days at a time. There are exceptions that will be addressed later. However, the common problem occurs as high-density streaks and low-density valleys full length of the product as it is being formed.

This presentation addresses several new methods of controlling these critical aspects. Each of these methods begins the process by taking a cross-panel density sampling of the mat currently being formed on the forming belt. This is accomplished by utilizing a nuclear, x-ray or similar density gauge. The result provides the density pattern baseline for correction and control that is instantaneously fed to a Computerized Numerical Control (CNC) system or Programmable Logic Control (PLC) (hereinafter "CNC"). This CNC system performs the control upon mechanical devices to make changes. The mechanical devices (to be described shortly) are then activated in numerical magnitude to make corrections. As these corrections are made, further cross-panel sampling is conducted for evaluation of effectiveness. This method of obtaining the optimum density might be compared to the operation of "cruise control" on an automobile.

The first method and its associated mechanical devices will perform optimally for particleboard and OSB forming machines. In addition to density gauges and a CNC system, the components include jacking devices or lifting fingers ("lifters") that are located under the measuring belts in the forming heads that lift the measuring belt in strategic areas. Controlling these makes it possible to make corrections in the amount of material being formed over the various areas across the panel width. All areas except the lowest-density valley are lifted into the scalping rake. The amount of "lift" for each area corresponds numerically to the area's density correction. Those areas that are highest in density are lifted the highest and so on down to the lowest density area. The CNC system determines and controls the amount of lift required from the previous density sampling. Then as previously described, new data are fed in from the density gauge on the newly formed mat and further corrections are made until optimum cross-panel density is achieved. When the density pattern changes, however slightly, the degree and pattern of correction is changed.

A vacuum plate is also beneficial under the measuring belt to further enhance the control effect of the lifters. Its function is to limit the effect of each lifter upon adjacent areas across the panel width.

For best operation and wear, a thin strip of metal or other material is placed over each lifter. This allows the measuring belt to slide smoothly over the lifters.

Figure 2:
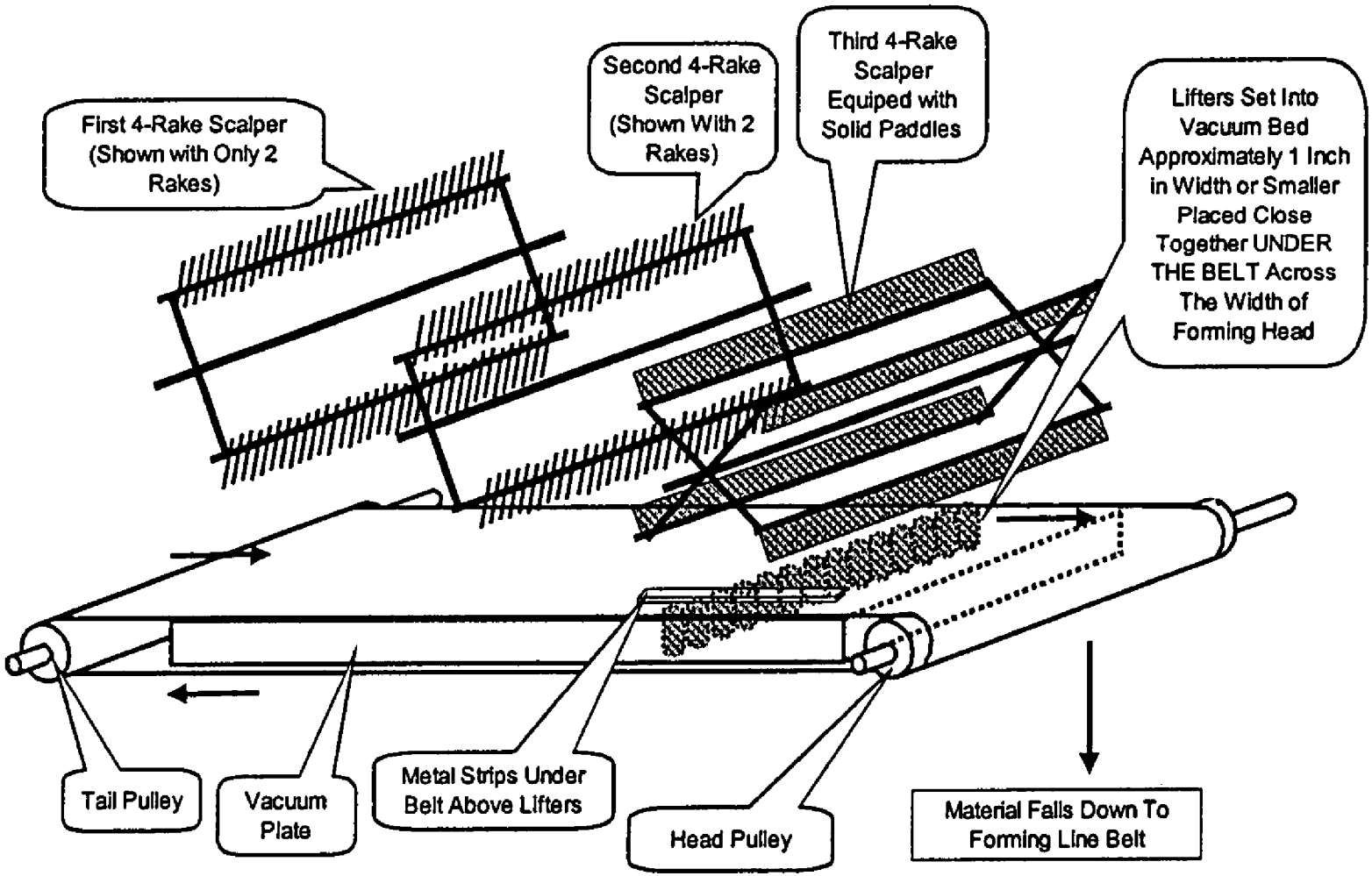

FIGS. 1 & 2 illustrate general arrangements of the lifters and vacuum plate.

An Internet word search for "linear actuators" will lead to a vast variety of types, shapes, sizes, manufacturers and costs of such devices.

Three or more scalpers are utilized rather than only two. The purpose is to dedicate the third rake for a more precise final leveling of the material over the lifters. For particleboard it is possible to utilize solid paddles in place of tines in the third scalper to increase the accuracy of the system.

It should be noted here that the belting material utilized for the measuring belt must be flexible so that the desired effect is created when the lifters are activated. Furthermore, it is possible to create a greater effect with a small amount of lift in the measuring belt by first scalping the material down to a very thin layer, the thinner the layer the more pronounced the effect. Since a given amount of material must be fed per minute from each forming head in order to produce a given number of pounds per hour at the press, the thinness of the layer will automatically be made up by running the measuring belt faster. Therefore, if the measuring belt is raised in a certain area a quarter of an inch (6 mm), the effect from that quarter-inch lift is equal to one-fourth of the material in that strip if the material layer is 1-inch thick (25 mm). Conversely, it is only one-twelfth of the density in that strip on a 3-inch layer.

The method described will work well on particleboard and OSB but not for MDF. For that product, the second method is needed. The mechanical device aspect of controlling density in MDF product is somewhat similar to that previously described. It applies the same principal but rather than lifting the measuring belt in the high-density areas so that they are scalped off, the low-density areas are compressed and the higher density areas are shaved off. The ski-type strips or wheels perform the actual compressing when they are pressed into the material as it travels past. The activating devices ("pushers") are similar to the lifters previously described.

Figure 3:
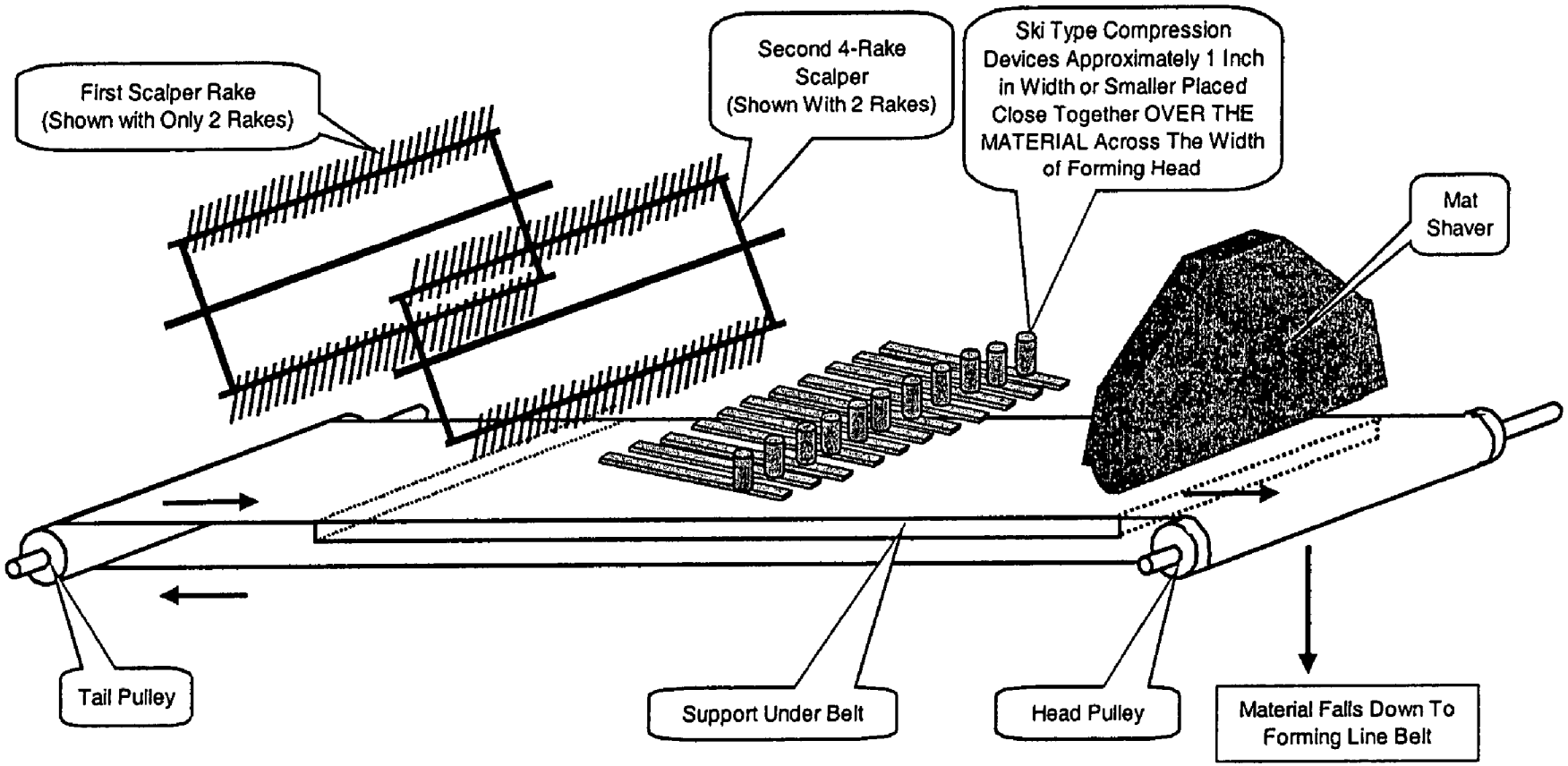
FIG. 3 shows Ski Type Compression Fingers (To Be Placed Over the Mat or Material)
Figure 4:
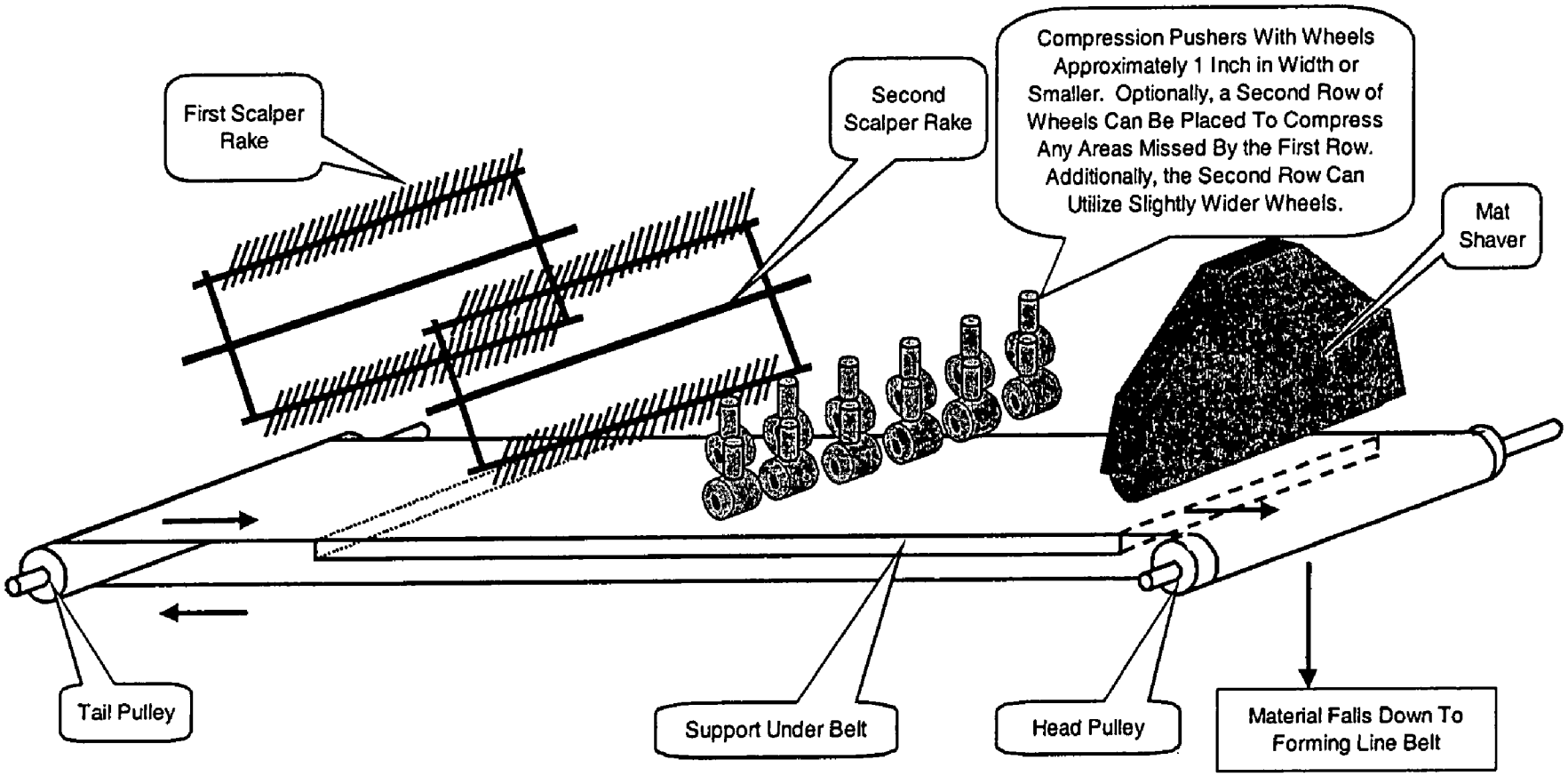
FIG. 4 shows Wheel Type Compression Units (To Be Placed Over the Mat or Material)

As with the lifters, the pushers must also be controlled in both directions. The outcome is CNC controlled in the same manner as the first method. Although the process of adjusting and shaving can be achieved in forming heads as shown in FIGS. 3 and 4 if the forming machine is so arranged, it is more efficient to perform the operation directly on the forming belt. The process may also be done in steps to separate face from core but that is not necessary unless a balance of face/core/face layers is important for some reason. As with "lifters," an Internet word search for "linear actuators" will yield an abundance of types, shapes, sizes and manufacturers of devices that can meet with design criteria for "pushers." FIG. 4 illustrates two rows of wheels rather than only one. The advantage is in compressing the areas that would otherwise be missed by the gap between rollers. The effect of the second row should be placed to overlap the areas compressed by the first row of wheels. (The same principle can be applied to ski-type compressors strips.)

This method is also applicable to vacuum-formed mats as well as mechanically formed mats. As with the lifter method, this second method will not work well for all products. It will not work well for particleboard or OSB in the form described here. Variations that are applicable will be discussed under the headings "Particleboard Forming" and "OSB Forming."

Figure 5:
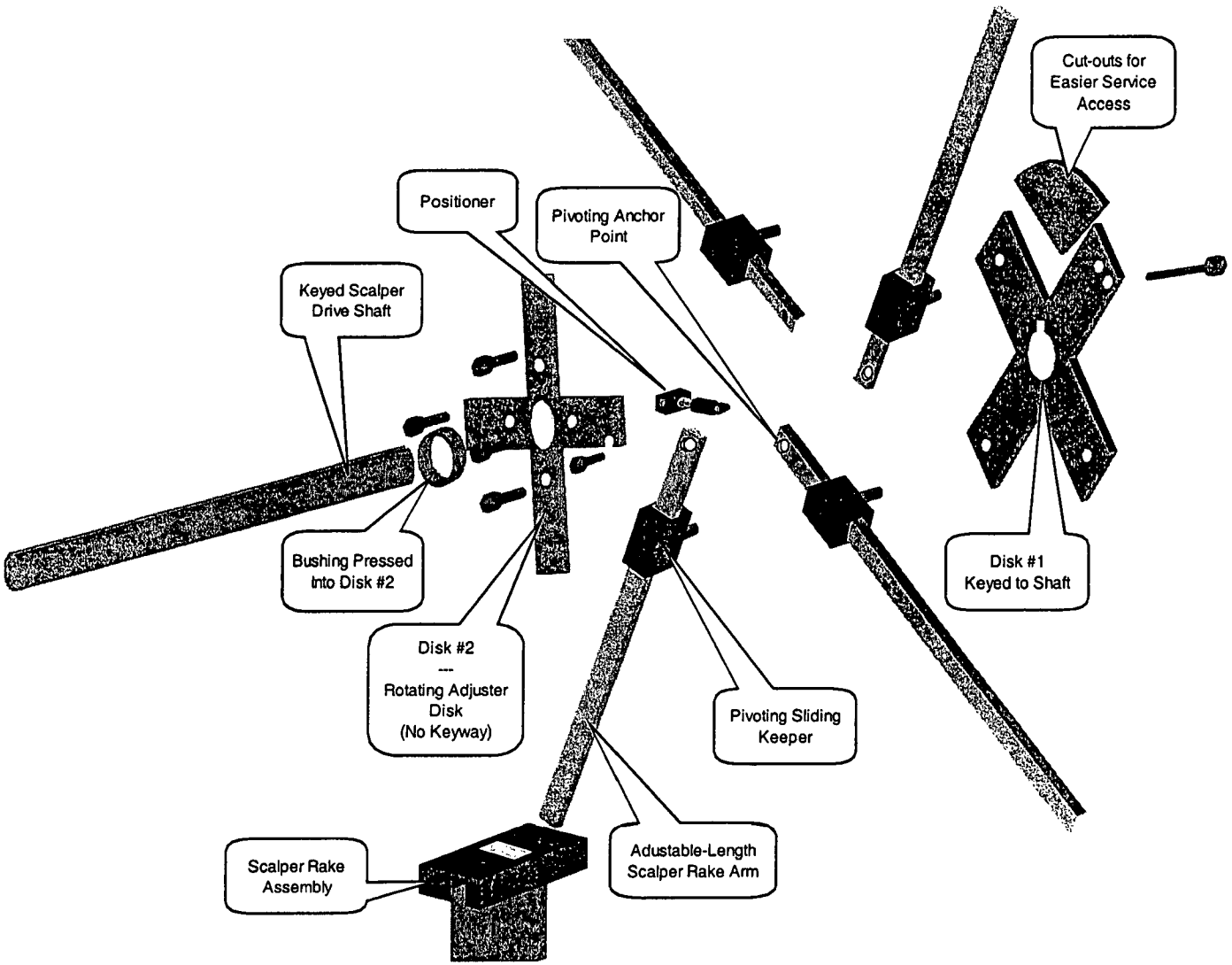
FIG. 5 illustrates CNC Scalping Device Components.

A third method can be utilized that will work well for all three products. Like the previously discussed method, this one works from the top of the material. As before, this device is controlled by CNC activation of a similar push-pull ("positioner") device. Rather than lifting the belt from underneath or pressing down on the mat, the device adjusts the elevation on a scalping-type of device in varying magnitude in various locations across the width of the forming machine. Thus, the heavier density areas are picked or swept off at the surface in strategic points by the scalping device. Similar to previously discussed methods, this is accomplished in forming head although for some products it can be achieved on the forming line. FIG. 5 illustrates the functional concept and assembly configuration of one such scalping device.

Two disks placed onto to the scalper main drive shaft, one fixed and one able to turn a few degrees on the shaft. The two disks are cut out as shown to allow greater access to the components for assembly and repair. Disk #1 is identified as the disk fixed to the shaft, whereas, disk #2 is allowed to slip on the shaft. "Keepers" are attached to disk #1 in a way that allows the keepers to turn on a pivot. The scalper arms fit into the keepers and slide in and out to adjust the scalper diameter when adjustments are required.

Scalper arms are attached to disk #2 by means of pin joints. The arms are allowed to pivot about the pin.

Figure 6:
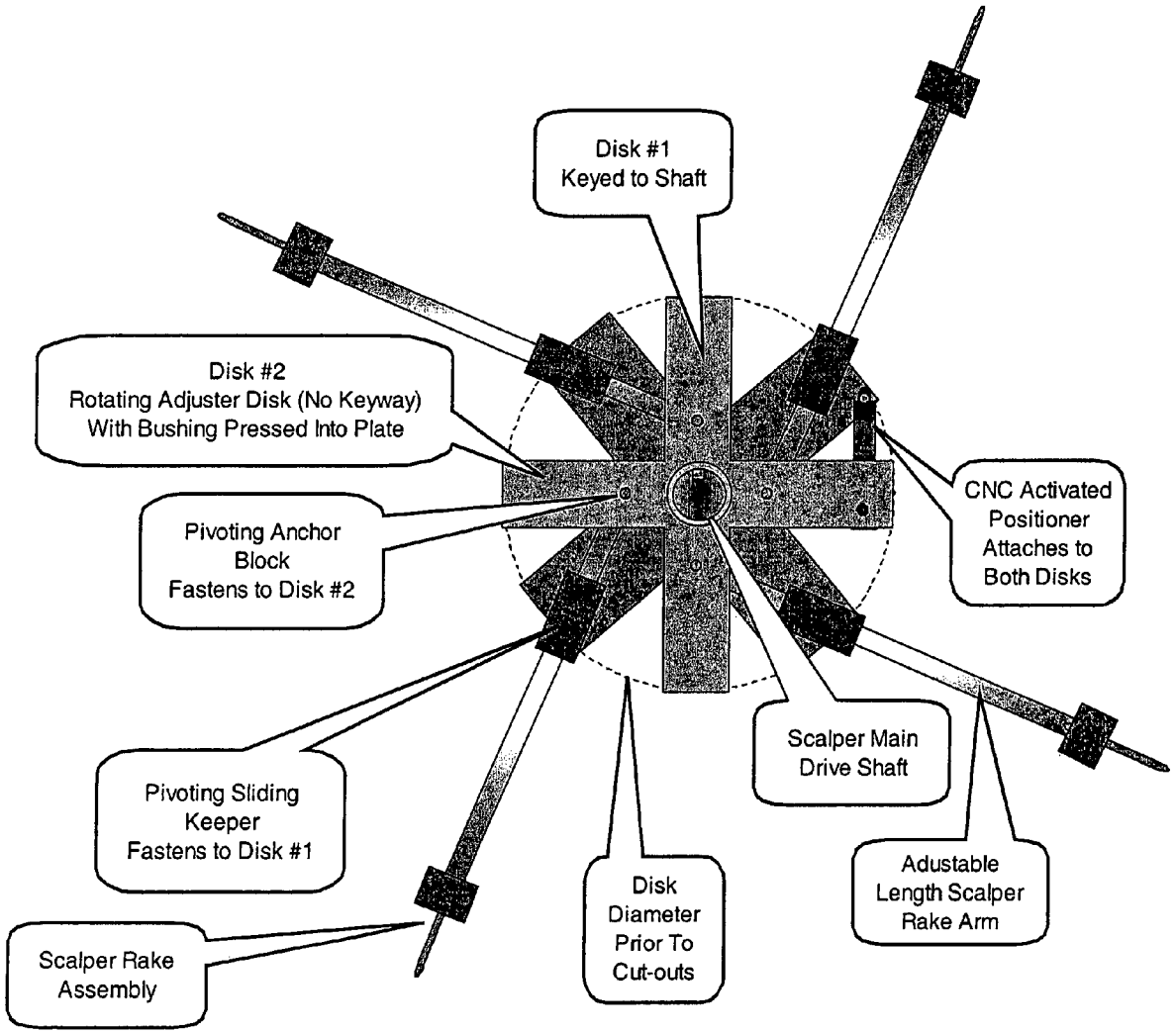
FIG. 6 illustrates CNC Scalper Assembly End View.

The positioner is attached to one disk at one end and to the other disk at the other end. FIG. 6 illustrates the end view of the assembly.

Figure 7:
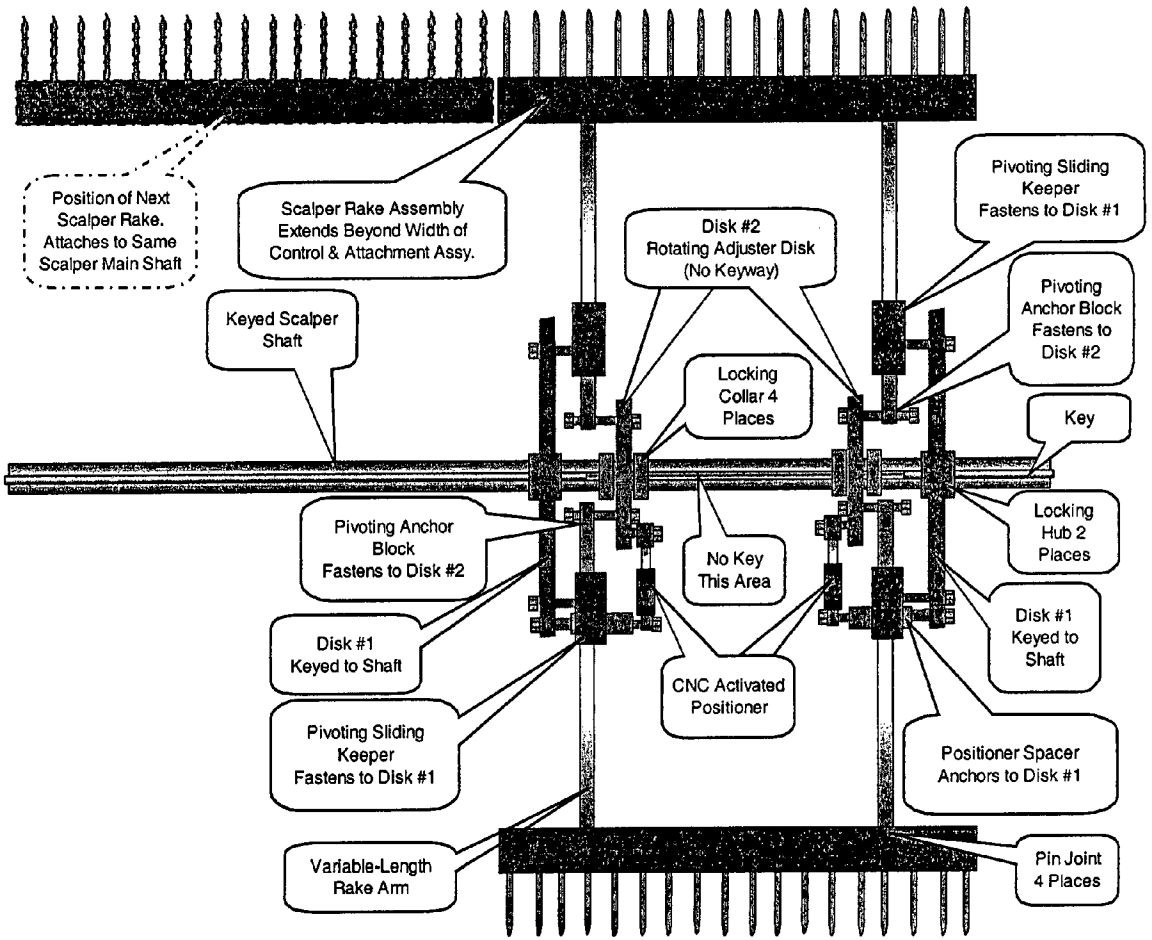
FIG. 7 illustrates a partial plan view and functionally illustrates a scalper assembly.

When the positioner is lengthened or shortened, disk #2 rotates about the main shaft and adjusts the length of the scalper arms. The length of the arms determines the depth of scalping cut placed upon the material. FIG. 7 is a partial plan view and functionally illustrates a scalper assembly utilizing two positioners to adjust the scalper rake depths at each end. Thus, the rake can scalp deeper at one end if required.

Figure 8:
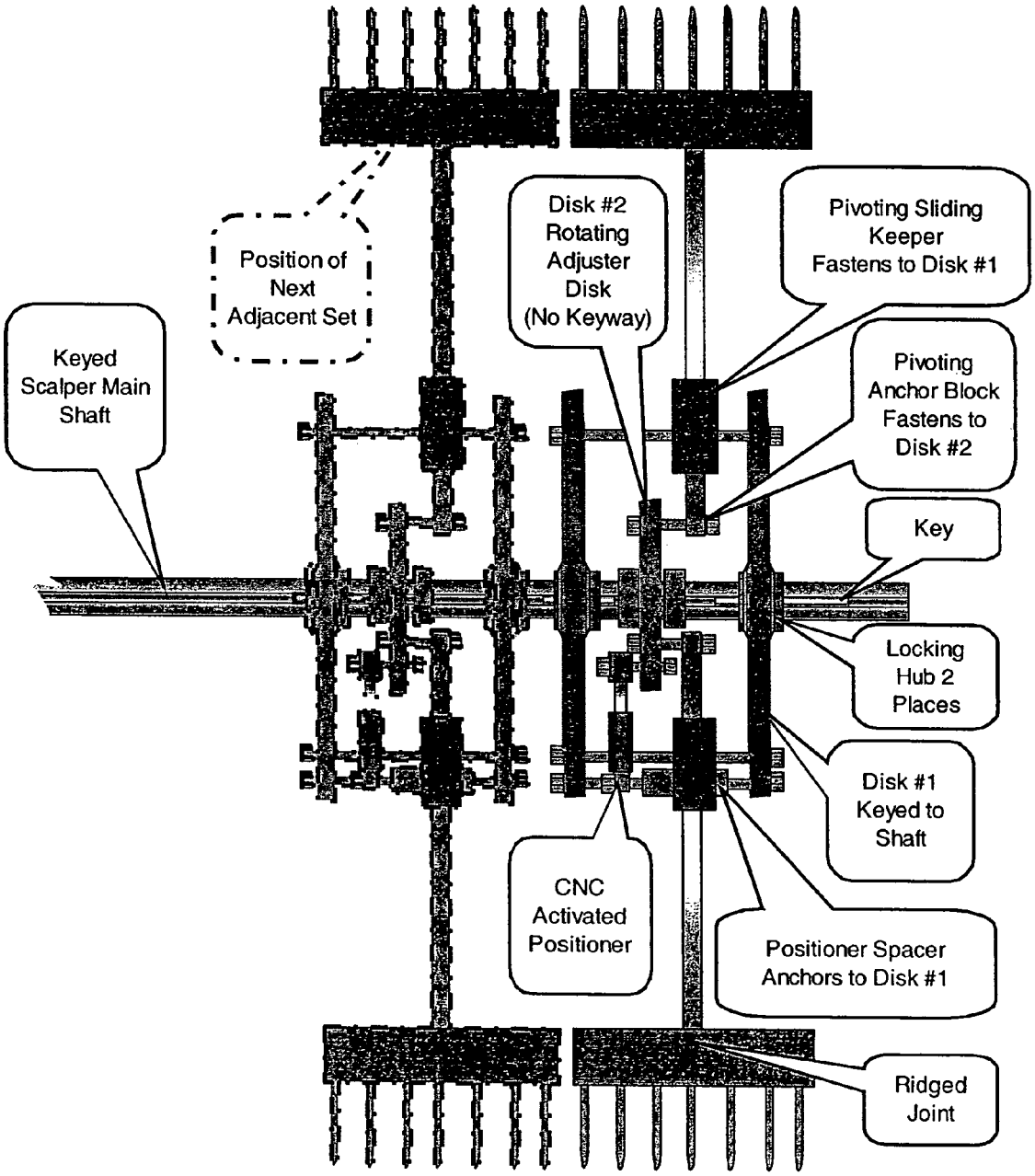
FIG. 8 illustrates CNC Scalper Assembly Partial Plan View Short Rake Configuration.

Essentially, the same result can be achieved by utilizing one positioner on a single-rake assembly as shown in FIG. 8.

Figure 9:
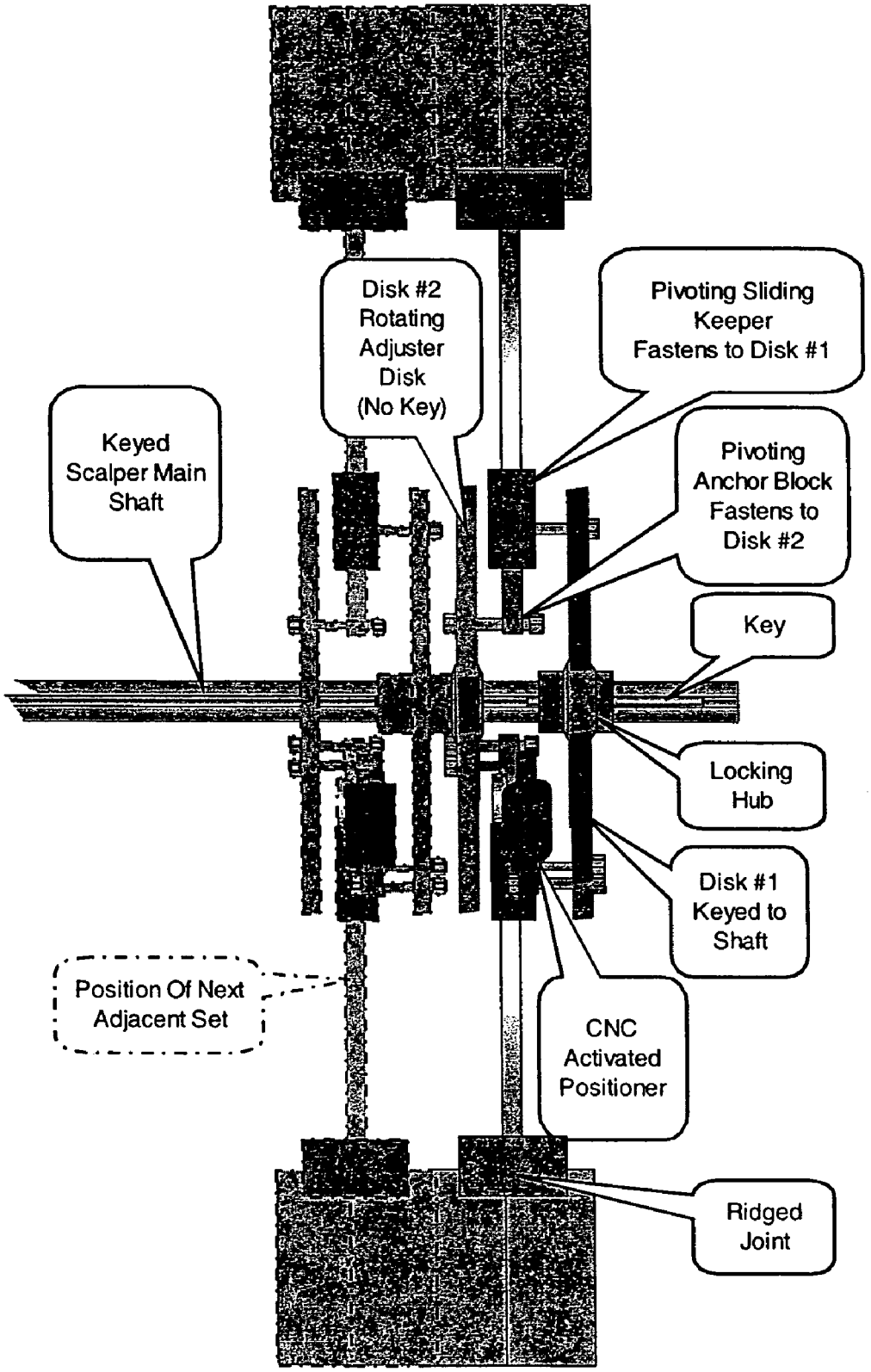
FIG. 9 illustrates CNC Narrow-Width Scalper Assembly Partial Plan View

Even tighter designs are achievable so that narrower widths of scalpers can be assembled. As the width is lessened, the control of density is increased. FIG. 9 illustrates a partial plan view of a narrow-width scalper.

Scalper blades or tabs rather than tines are shown in the FIG. 9 illustration. Tabs will work well for particleboard but not for MDF or OSB unless the speed and other design considerations are changed.

Figure 10:
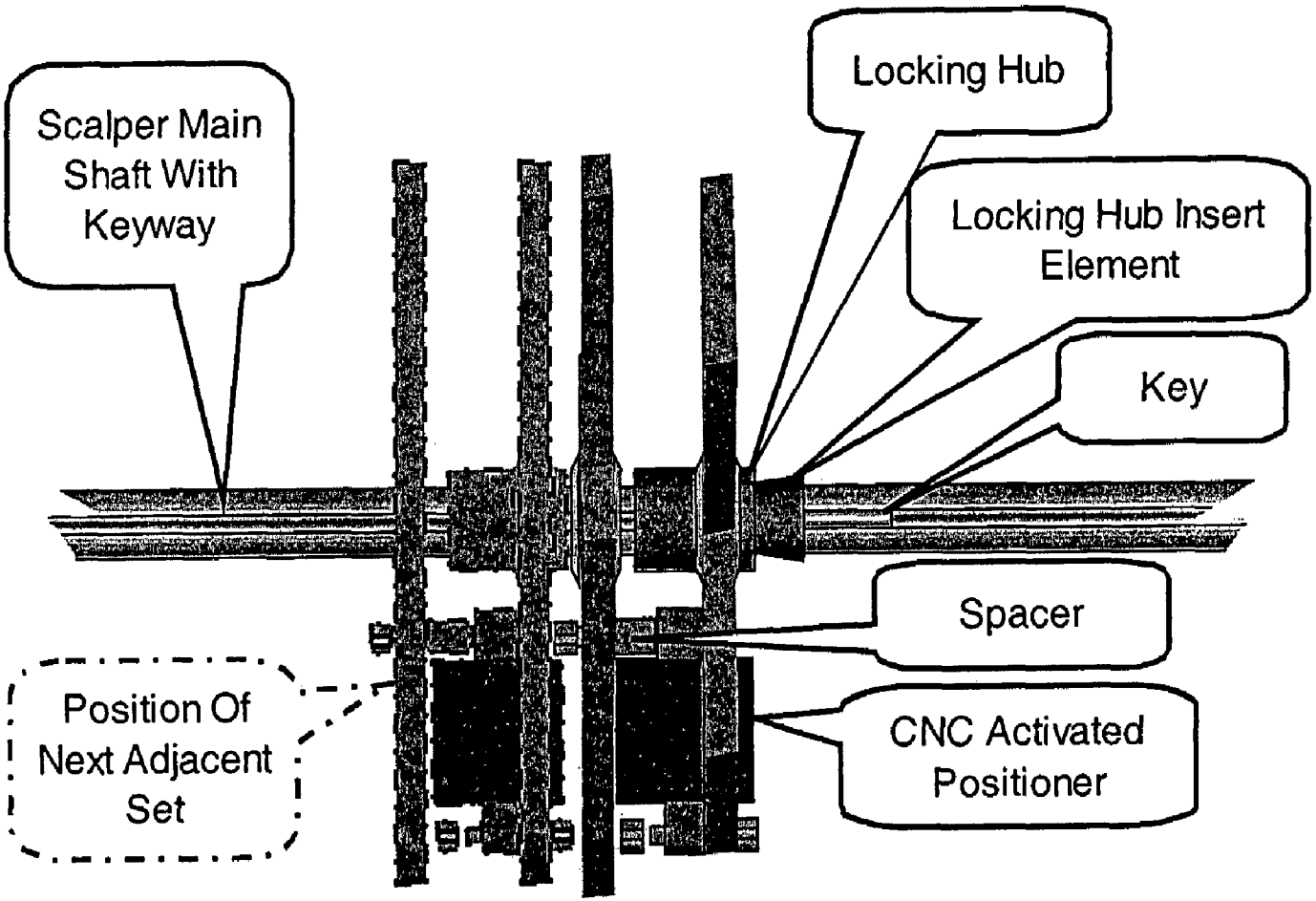
FIG. 10 shows CNC Ultra-Narrow-Width Scalper Assembly Partial Plan View.

If the positioner is attached so that it cannot collide with either disk, the diameter of the positioner barrel will not preclude the disks from being closer together. One way to achieve this objective is to rotate each pair of disks a few degrees beyond that of the previous pair attached to the scalper main shaft. The result is a helical arrangement of scalper blades or tines on the shaft similar to the blades on a reel-type lawnmower. This method has the added benefit of allowing the tabs shown above to work more effectively. Alternatively, the diameter of the disks and scalper arms can be increased to allow more room. Fewer rake heads/arms per assembly (3 rather than 4 as shown) will also allow more room. FIG. 10 illustrates a very narrow width scalper assembly in a partial plan view.

Figure 11:
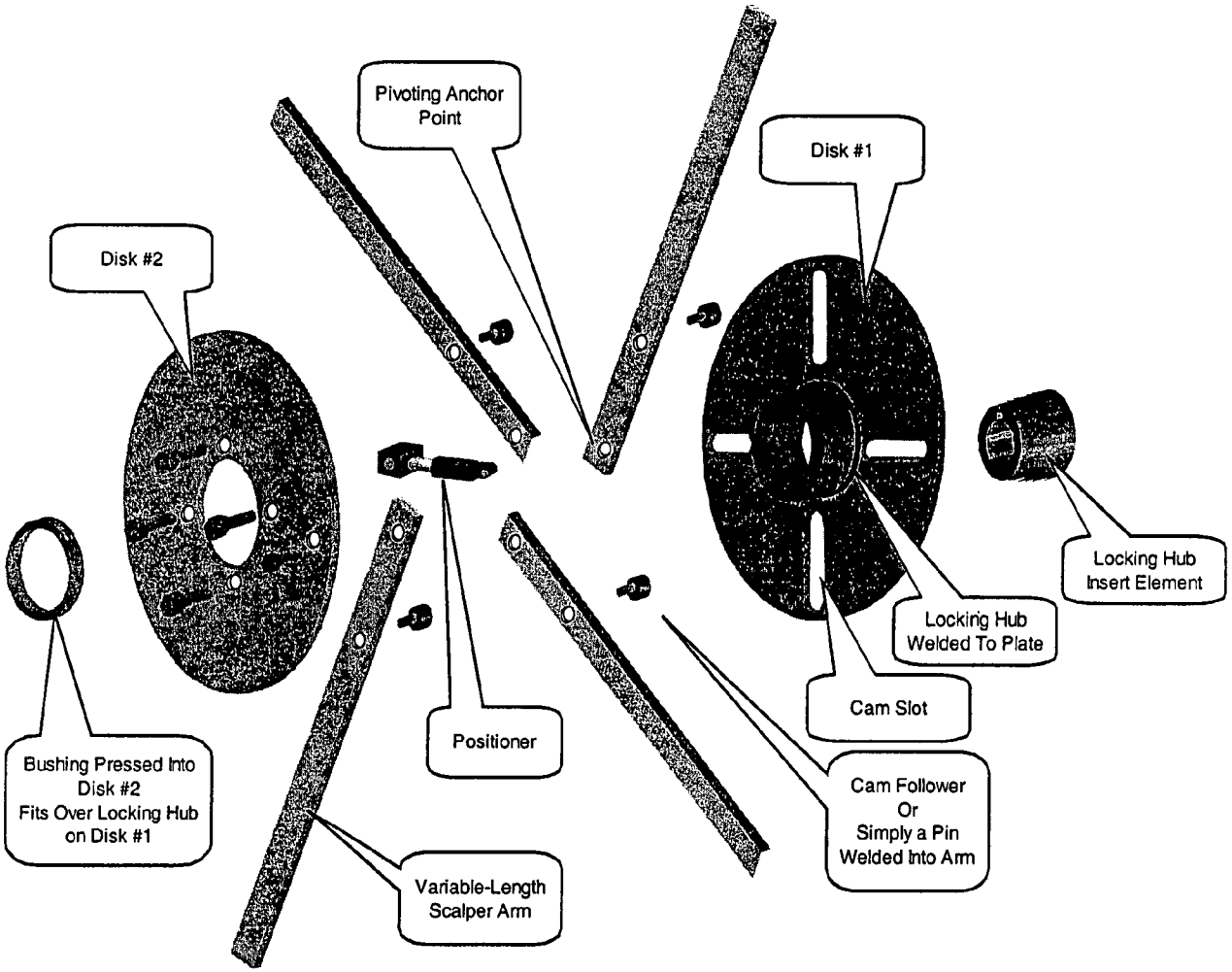
FIG. 11 shows CNC Ultra-Narrow-Width Scalper Device Components.

The locking hub width and the width of the rake arm keepers will limit how many sets of scalper assemblies can be mounted onto the main shaft. There are also many other ways to keep these small. For example, if the rake arms are manufactured from ¼-inch by 2-inch flat bar, the strength will be sufficient and the ¼-inch width will require only a small space on the main shaft. The keeper blocks can be eliminated by the use of a cam follower or pin that follows a slot in disk #1 as shown in FIG. 11.

Disk #2 will be held into place by the subsequent set to be placed onto the shaft. Otherwise, the locking hubs could be machined with a shoulder and threads on the end for a lock nut to hold disk #2 in place. Such assemblies could be discrete units made up to slide onto the main shaft and then locked into place by each locking hub. Therefore, it is possible to supply assemblies having a scalper width of less than 2 inches (50 mm) and taking up an equal amount of space on the main shaft. Hence, for a forming line 8 feet wide, there will be approximately 50 contiguous control points across the width.

Concerning the electrical connection, electrical leads to each positioner can be run from a commutator on the end or ends of the main shaft. Commutator brushes would allow direct connection to the CNC system. Alternatively, power leads from a commutator can be connected to a control circuit board at each positioner. That control board would be activated by radio frequency to increase or decrease the length of the positioner.

Figure 12:
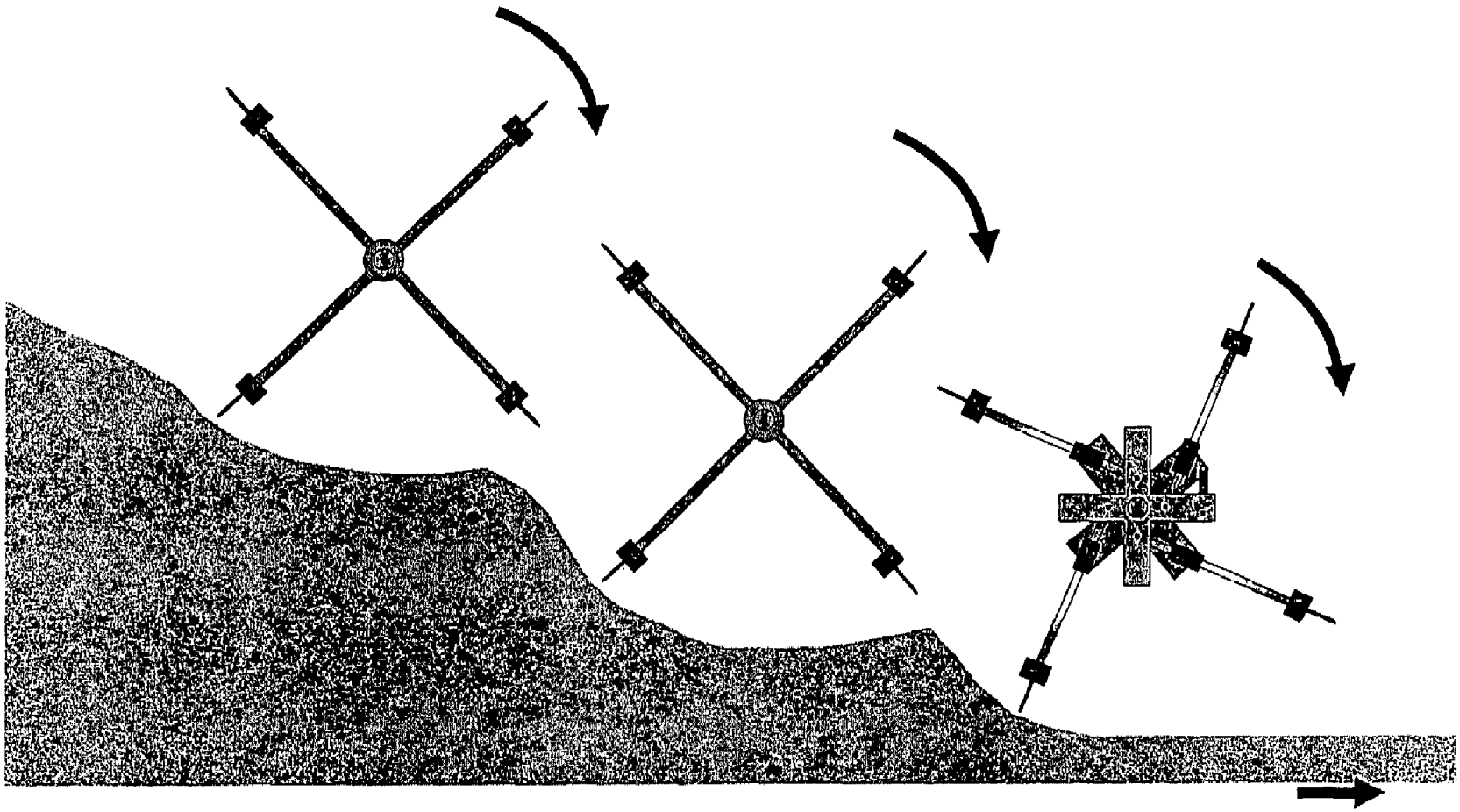
FIG. 12 shows CNC Scalper Location.

The completed shaft assembly described can be considered a shaving device if it is so utilized. However, it seems best to utilize the concept as a scalper for most applications. As a scalper, other scalpers upstream can sweep excess material away to prevent a continuous build-up of unwanted material as shown in FIG. 12. If configured as a shaver, a pneumatic system would best evacuate excess or shaved material.

More specific detail about the mechanics of employing these various types of controls is provided under the headings "Particleboard Forming," "MDF Forming" and "OSB Forming."

For comparison with other industrial methods, the Hessemann brand electronic sander employs controlled pushers.

Fluidized Flow of Material

The concept of "fluidizing" the material is a key element in the forming methods described in this presentation. Others have been creating solutions to the problems inherent in forming various materials. However, the Christoffersen concepts concentrate upon creating fluidization of the wood material mass in order to "flow" the material onto the forming line belt.

Fluidizing of material in the forming machine is not an issue of concern for forming MDF employing mechanical or vacuum methods. However, it is a problem when forming particleboard and OSB. With these products there must be a steady flow of material off the measuring belts at each forming head in order to provide good density control across the panel width. Otherwise, material falls off the measuring belt in "clumps." While it may not be apparent, these clumps create density highs that directly affect the entire pressing cycle to increase overall time requirements. Conversely, following every high-density clump there will be a low-density pocket. These appear as density valleys with reduced strength properties when the cross-panel density is measured.

Some particleboard forming machines have utilized "picker rolls" to sweep the material off the belt as it travels into the brush. However, the major drawback with this method is that the material is "sprayed" over a greater longitudinal area. Although it may seem that the effect on the density control is negligible because the line is running steady, experience has demonstrated otherwise. Granted, such results were considered acceptable twenty years ago, but the industry standard today is more stringent. If the desired design of a forming machine is to utilize picker rolls, a correction to the problem must be found. One way to correct or eliminate the effect is to funnel this material spray down into a single and tight stream. The result would be a delivery of the material onto the forming belt in precise time coordination with the measuring belt.

Some forming machines have utilized a rotating shaft with spikes to fluidize the material. This type is found mostly in forming machines utilizing a very deep dosing bin for the forming head. Multiple shafts in a stair-stepped arrangement provide a steady flow off an entire mass of a deep dosing bin. It is important to assure that the spikes do not fling the material but merely fluidize it. Again, the proposed method suggests that it may be best to funnel the material into a narrow opening if it must be sprayed.

Figure 13:
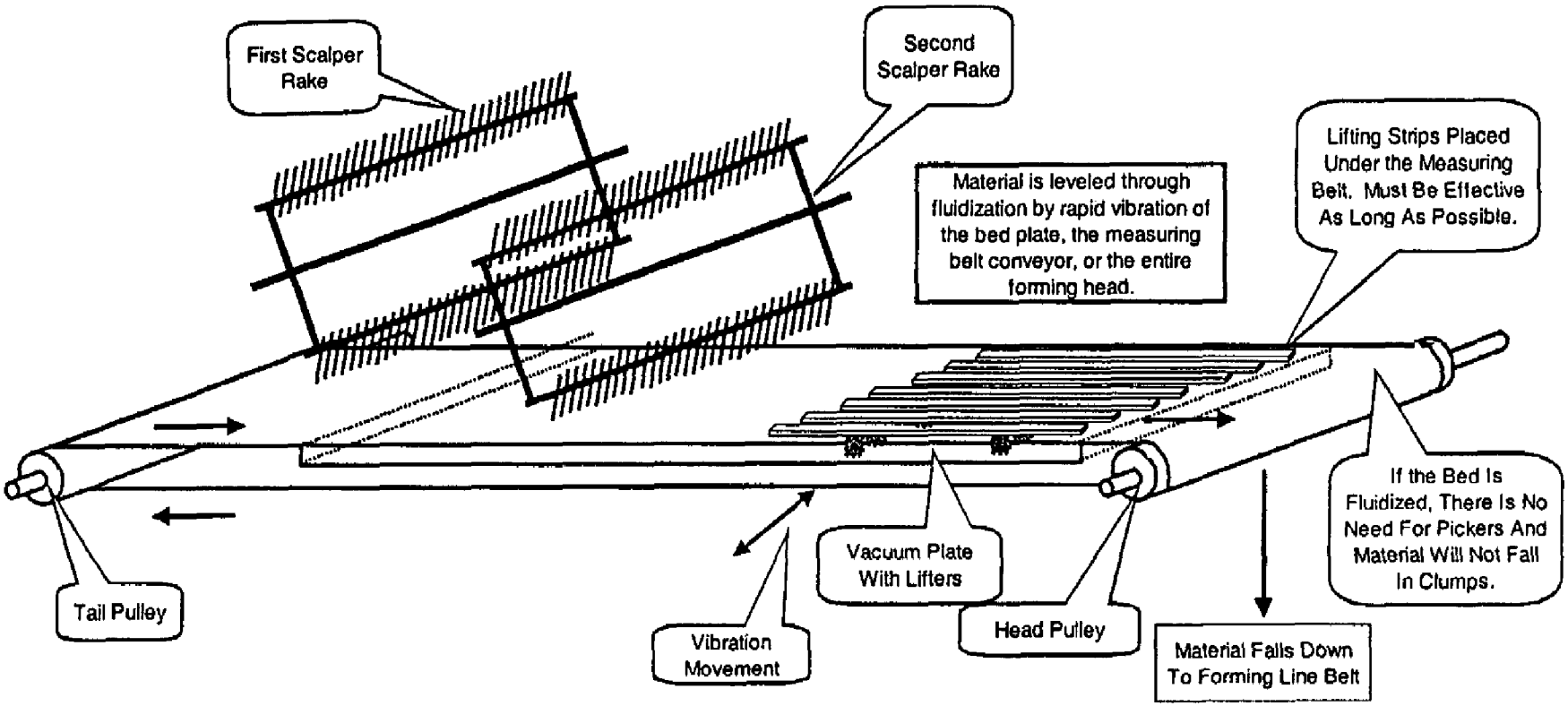
FIG. 13 shows Vibrating Forming Head or Conveyor.

The concept of fluidization and the term "fluidized" have been utilized in this section to prepare the reader for an alternative method. We have now delineated the objective, "to fluidize the material." Therefore, it is easy to now visualize a mechanism that fluidizes the material by vibration. We can do this by vibrating the measuring belt conveyor or the entire forming head. This method has the advantage of accuracy in flowing material evenly. A secondary advantage realized in this method is that material will flow to a level top surface in the forming head over the lifters. The vibration frequency, direction and magnitude all have a great effect upon the resulting accuracy. This method requires the lifters (under the forming head measuring belt) to extend to the head pulley or the effect created by the lift will be partially lost. Several methods of achieving this effect are possible. FIG. 13 illustrates an example configuration of such a forming head.

Figure 14:
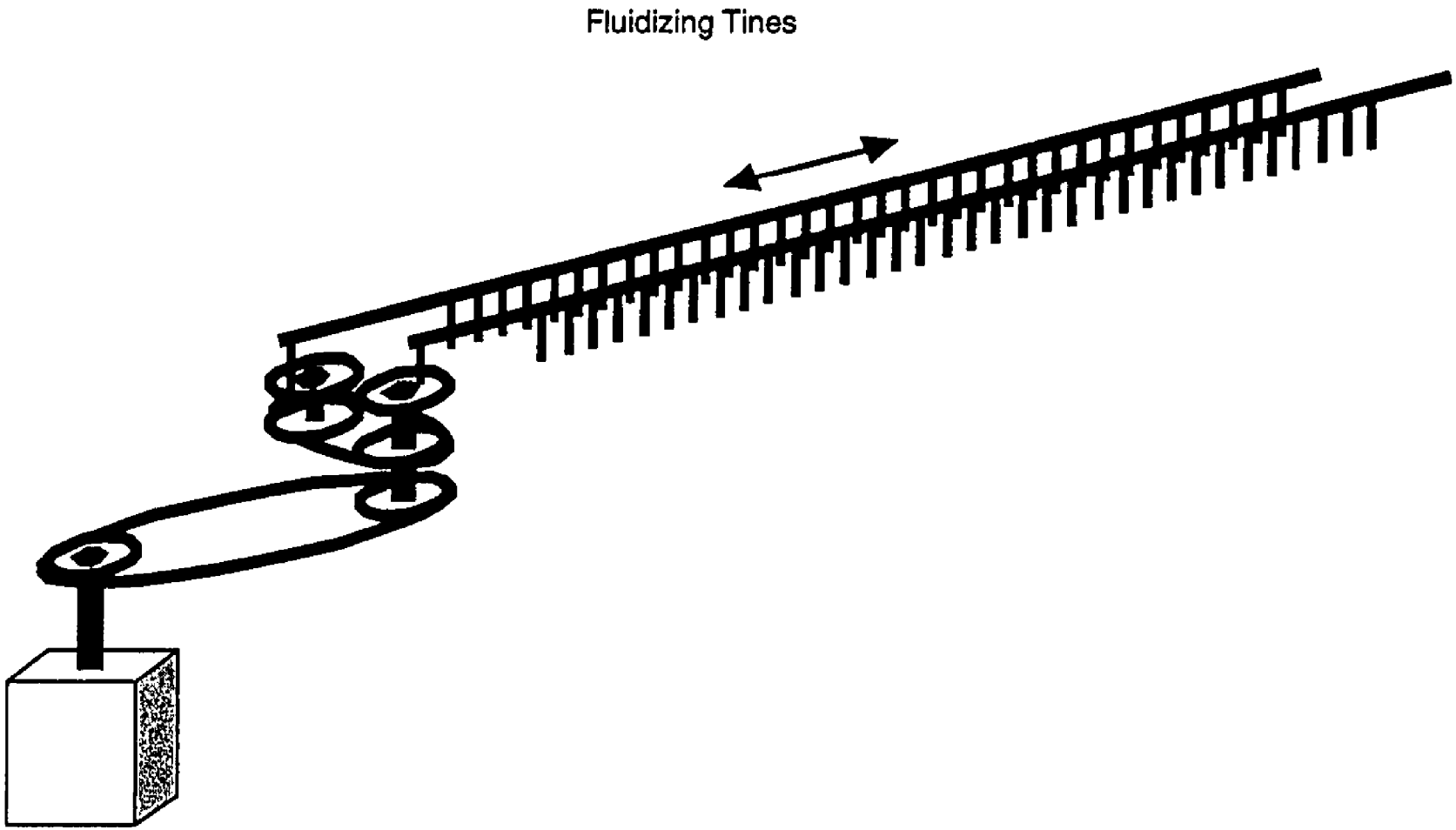
FIG. 14 shows Fluidizing Tines.
Figure 15:
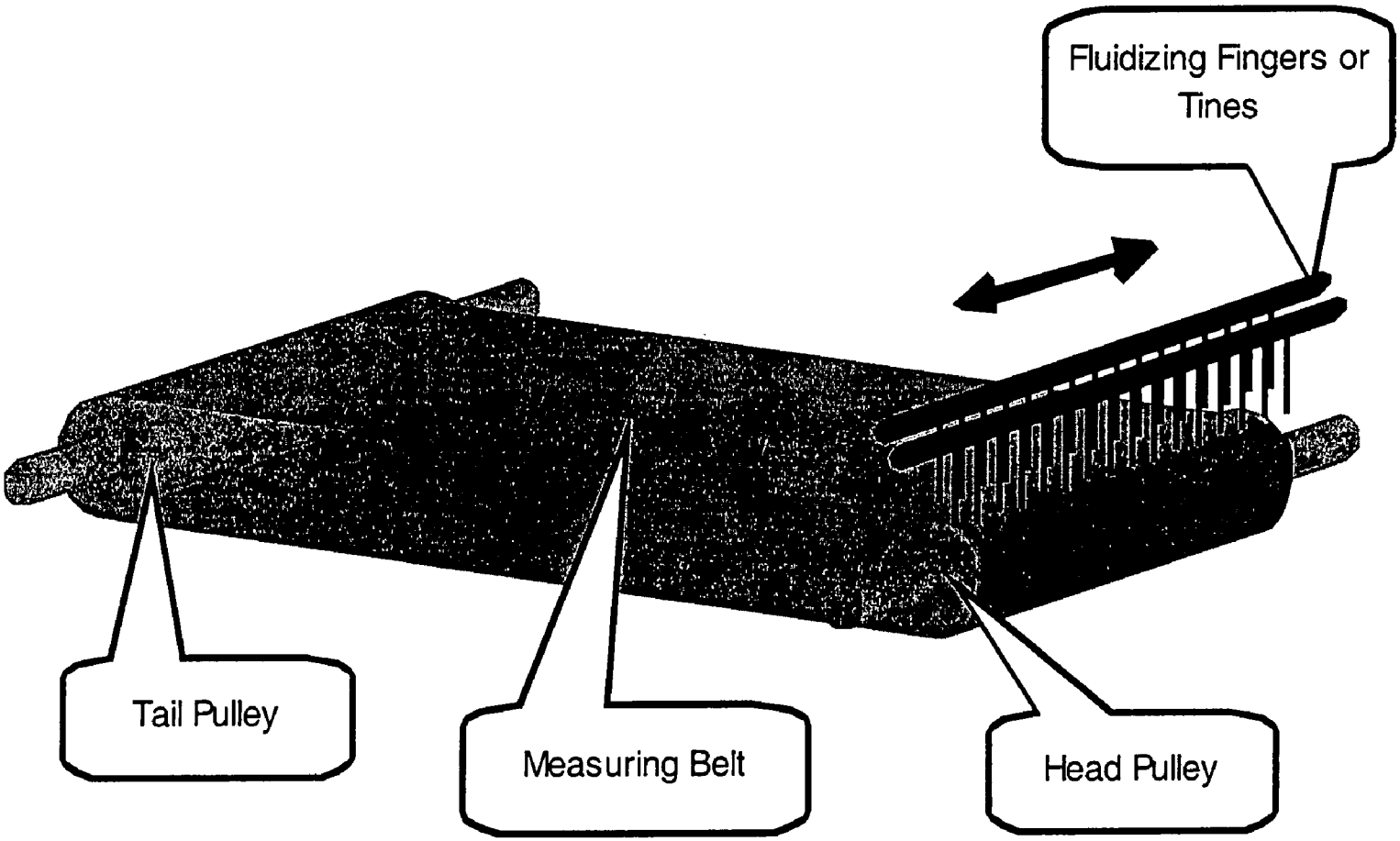
FIG. 15 shows Fluidizing Tines Arrangement & Placement (Viewed From Outfeed End of Forming Head)

Another means of fluidizing the material presented here, especially for particleboard, is to oscillate one or more sets of rake tines or fingers ("tines") near the break-over point at the forming head measuring belt head pulley. FIGS. 14 and 15 illustrate one of several possible configurations.

This method can also work with OSB but the spacing of the tines will be very critical considering the lengths of the strands and the propensity for them to remain interwoven. A rotary shaft with picker tines may work better for that product.

Physical Properties

Meeting physical property requirements must be considered when designing a forming machine. Therefore, some discussion is called for here.

The construction for strength of panel board products addressed herein is analogous to a truss bridge or commercial building truss. The outer surfaces carry the load while the inner cords spread and transfer the load to the surfaces and maintain internal integrity. If the top or bottom cord were to be fractured across the width, the entire truss would likely break. However, if an inner cord were to fracture, the effect on the truss would be negligible to the overall support integrity.

Similarly, the core portion of composite panels is less strong than the panel surfaces and its function is to transfer the load to the faces of the panel to provide bending strength. The physical integrity of the outer surfaces must remain intact in order for the panel to maintain its strength. The FIGS. 16, 17 and 18 illustrate the comparison:

There are three major areas of physical property consideration that apply to the board types addressed by this paper. Namely, they are modulus of rupture (MOR), modulus of elasticity (MOE) and internal bond (IB). Other properties such as screw holding strength are related to these.

Figure 16:
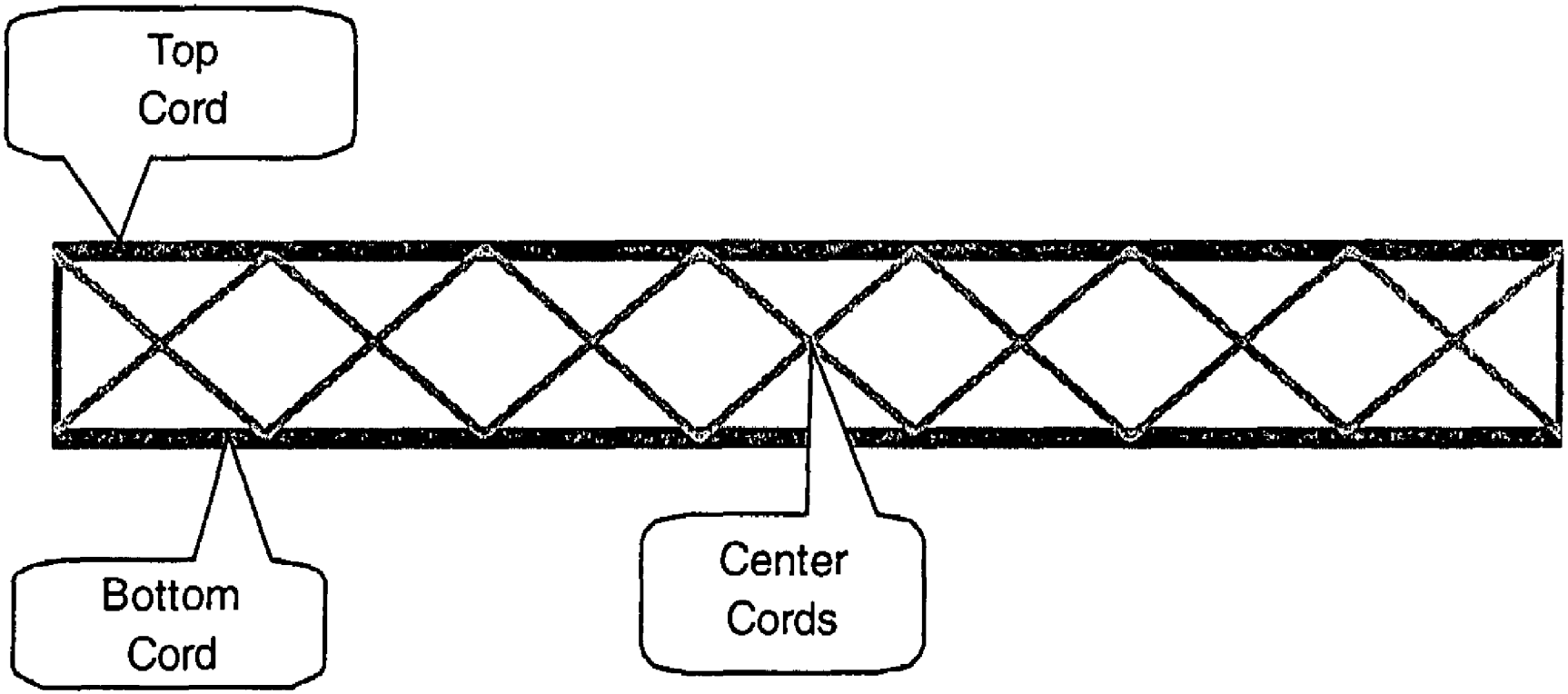
FIG. 16 shows Sketch of Truss.
Figure 17:
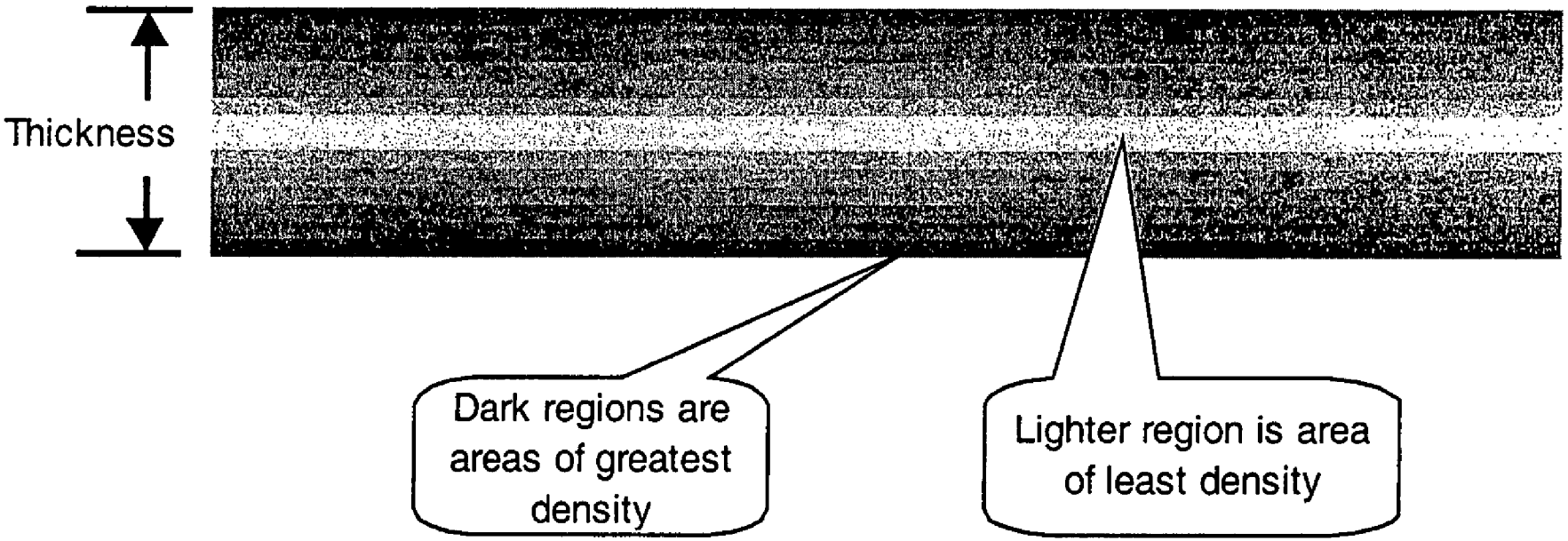
FIG. 17 shows Composite Panel Density by Depth.
Figure 18:
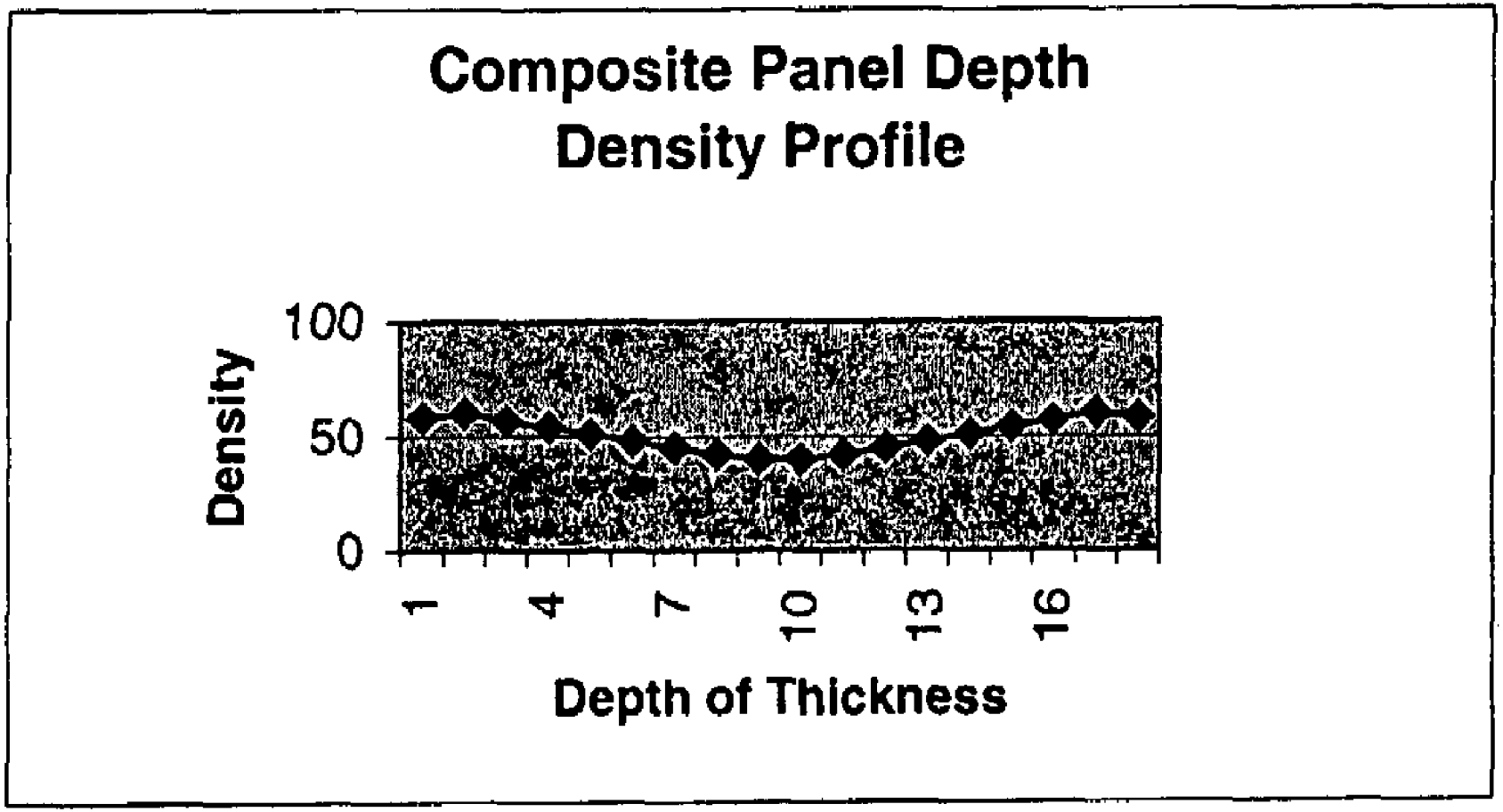
FIG. 18 shows Composite Panel Depth Density Profile.

FIGS. 16, 17 and 18 illustrate how the strengths of the surfaces provide properties to MOR and MOE. Similarly, the IB is related to the degree of weakness found in the core. All other factors being the same, the idea is to obtain a proper balance between core properties and face properties. For example, if we were to increase IB without changing resin content or particle geometry, the MOR and MOE properties would be reduced.

The intent of this application is to discuss unique forming methodologies but some general information should be considered. For example, OSB and MDF do not rely entirely upon the same methods as particleboard for their strength properties. Note that some influence will always remain within the manufacturing process for all board types that are controlled in the pressing operation such as the effects of thermo-plasticity and press closing speed.

Resin Distribution

It is important here to consider an important phenomenon about resin concentration or distribution and its relationship to particle geometry. Because of the relationship between wood particle size and surface area, the smaller the size of the wood piece being coated with resin, the more resin is used. This is true with any type of wood whether it is for particleboard, MDF or OSB. So, within a homogenous group of pieces to be coated with resin in the same process, the smaller-sized pieces will end up with the most resin per pound of wood directly influencing how board strength properties are increased, decreased and distributed.

An example of strength relying upon this phenomenon may be inferred from FIG. 17 for particleboard. Very small particles that are heavily laden with resin are deposited on the surfaces of the board thereby achieving the highest resin concentration, highest density and highest strength.

Deckles

The terms "deckles" and "deckling" are related to devices on the forming belt that allow width adjustment of the mat being formed. Deckles are essentially thin steel movable sidewalls placed vertically above the forming line belt. They normally make contact with, or nearly make contact with, the forming line belt at the deckle bottom edge and run lengthwise nearly full length of the forming machine. As material falls from the forming heads above, some material falls inside the deckles to become board product. Material falling outside the deckles is captured and returned to the forming heads above.

Material is normally captured in phases that maintain a separation between face material and core material. Material outside the deckles is plowed off the forming line belt at three or four strategic points along the forming line. By this method, captured face material is returned to the face forming heads and captured core material is returned to the core forming heads by auger conveyor or other types of conveyors.

The Christoffersen forming machines utilize this important but decades-old technology the same as many manufacturers continue to do.

Section II

Particleboard Forming

General Observations

Particleboard forming has its unique problems compared to forming OSB or MDF. Specifically, it is desirable and actually necessary by today's industry standards to create a very smooth surface composed of very fine wood particles. Generally, particleboard is composed of three or five layers and the core layer is often formed utilizing two forming heads for capacity reasons.

In the case of only three layers, the core is composed of courser material while the face becomes a compromise of "fines" material and regular "face" material, different from what would otherwise be sought as face material. Therefore, if we were to describe the material going from face to face we might have finer, courser, and finer materials.

In the case of a five-layer board, the core is again composed of courser material while the top and bottom face material is separated into two additional layers. This is usually accomplished by separating some fines from the courser face material and placing them onto both outer-most surfaces. Thus, to describe the material types going from face to face we have super fine, semi-fine, course, semi-fine and super fine.

The main reason for this is to provide a surface acceptable for subsequent decoration and without further "fiber pop" problems. However, the process also provides additional MOR and MOE properties due to greater density and more resin at the outer surfaces. While in some manufacturing facilities meeting MOR and MOE specifications is not a problem due to unique material or mechanical conditions, others may look to control these properties by adding resin to the face. Other options such as adding more fines to the surface are available to the production line supervisor but are not generally readily utilized as short-term solutions. During periods of more careful and refined adjustments, surface fines content may be adjusted to optimize the board properties and to provide a thicker fines layer that might not be sanded away.

The Metso Particleboard Forming Machine

There have been many advances over the years in particleboard forming machines. However, one now stands out because it has recently replaced numerous forming machines in operating plants in addition to capturing a significant percentage of new sales. The Metso (formerly Valmet and Sunds Defibrator) forming machine operates utilizing a series of rolls with diamond shaped cells. The rolls are placed in sets with each set having smaller sized cells than the previous set. Material is then conveyed over these closely spaced rolls. Material that is fine enough to be contained within the cells is carried through between the rolls and dropped onto the forming line belt below. The effect is to form a uniform amount of material across the width of the line. Furthermore, the graduated sizes for the sets provide the control for laying down finer material in the faces.

A certain amount of finesse is required in the design in order to obtain the desired particle mix for each layer. That is, some fine material will always fall through with the courser material whereas courser material cannot fall through with the fines. Therefore, the concern is to make sure there is a proper amount of fines mixed in with the course so that an optimum bond may be obtained in every layer without using excess resin. This factor can be a weakness in the system, although it has not created a lack of forming machine sales.

Another weakness in the system is the fact that material that has a higher amount of "tack" tends to clog the cells in the rolls and can cause more downtime for cleaning and restart time. Tack is primarily a function of moisture and resin property and concentration. Normally, a high degree of tack is desired so that the mat does not easily fracture as it travels down the production line and into the press. Resin tack and other physical property factors may be compromised until the material will properly pass through the forming machine. This problem has been a concern especially in early periods after installations and initial startups of the Metso machine.

With all this effort in design to make the material fall where it is supposed to, there is an adjustment capability for the gap between the diamond rolls. Some plant operating managers have opted to have the gap widened in order to accommodate the various problems associated with their particular operations. This seems self-defeating to the concept of delivering material down onto the forming line belt in measured amounts. Nevertheless, sales continue undaunted in spite of this apparent deficiency.

There have been other machines on the market that utilized the same sort of roll arrangement only without the diamond cell feature. An example is the Durand Microfelter that was comprised of multiple rolls with diamond points extending from their surfaces to break up the material that was to pass between the rolls. The rolls were larger in diameter and fixed a little farther apart than with the Metso machine. This design worked fairly well but not with the accuracy that can be expected from the Metso machine.

The Metso machine utilizes a rotating cage to break up the material and prevent it from falling off the measuring belt in chunks. This type of device can have a tendency to spray material longitudinally to some extent depending upon the speed of rotation. However, that effect is not particularly important in the Metso machine because the accuracy of the particleboard cross-panel density of the mat it forms is substantially more dependent upon the diamond roll arrangement.

Despite its apparent weaknesses, the Metso machine seems to have set an industry standard for a particleboard forming machine for the near future. Its value over other manufacturer's machines can be real or merely a perception. Either way, the goal is to design a forming machine that will form product with control of properties significantly better than the control provided by the Metso machine.

The Christoffersen Forming Machine

I have developed three primary ways to accurately lay up the board in five layers. Naturally, this could be abbreviated into only three layers but doing this is apparent after knowing how to build a machine that will produce the five layers. Additionally, extensions to these designs are possible by combining elements. This paper will first show the best arrangement and then proceed to discuss what are probably less desirable alternative arrangements.

Figure 19:
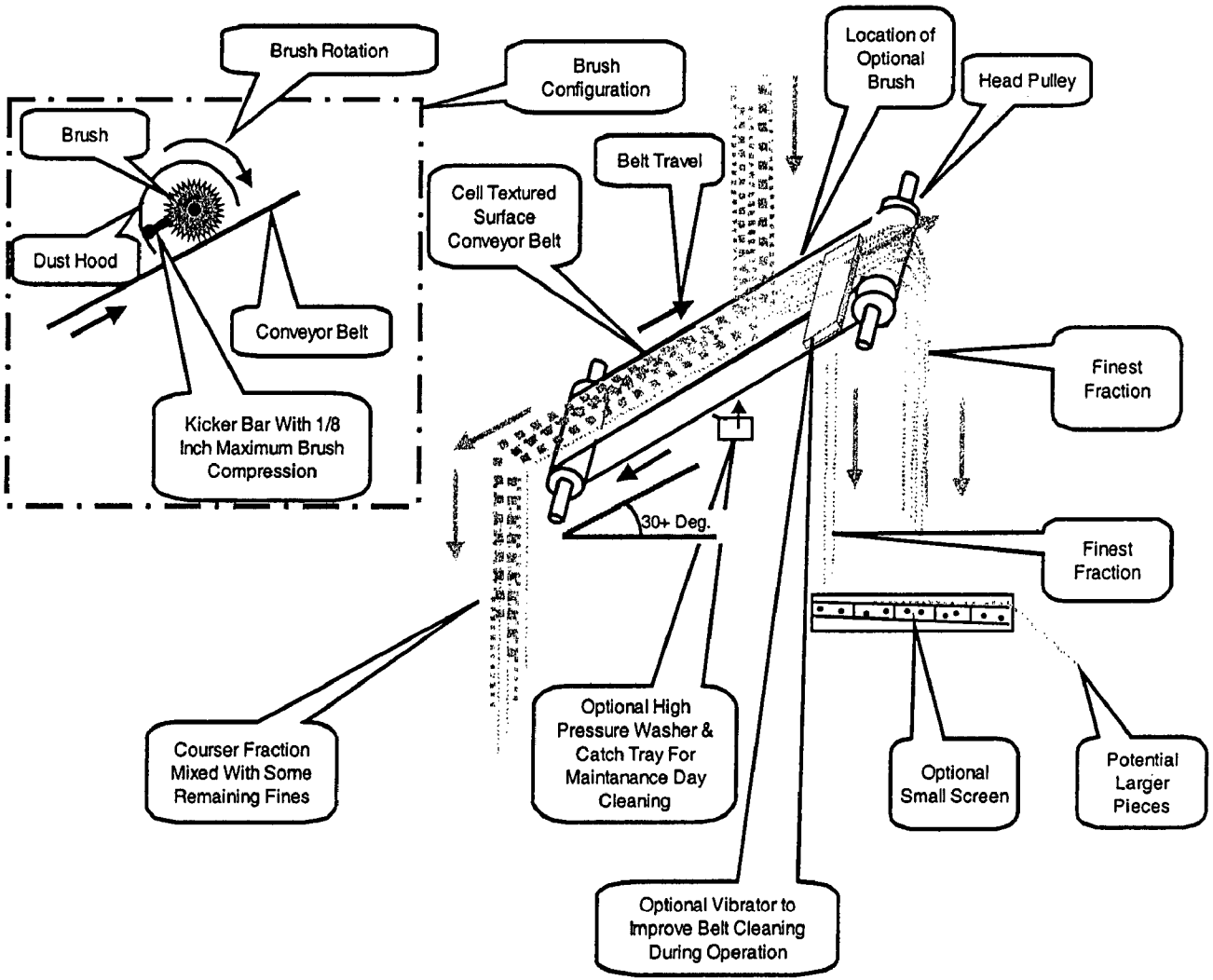
FIG. 19 shows Fines Separation Concept.

After incorporating the methodologies fluidization and true density control of the material as it leaves the measuring belt, consideration must be given to laying down a uniform layer of surface fines in a very controlled manner. Therefore, we must now explore how this might be accomplished. FIG. 19 will illustrate how fines may be "skimmed" or separated from the larger pieces of face material after it comes out of the face material blender.

The concept can be utilized as a useful stand-alone device. Conveyors can also be placed series to obtain a variety of separations with the cell size decreasing with each subsequent separation. A forming machine utilizing this multiple-separations method is described in connection with FIGS. 53 and 54 herein.

This device is comprised of a conveyor situated to convey upward at an angle (of optimally greater than thirty degrees) at a fairly fast rate of speed. At a first approximation, if the combination of conveyor angle and speed is sufficiently radical, material will not convey forward. Therefore, if the conveyor belt is textured with a pattern, only the material that will fit into the cells of the texture will be conveyed. Accordingly, as face material is fed onto the conveyor belt only the finest-sized portion will travel forward. The percentage of fines to be carried forward will be determined by the depth of the cells on the belt and the belt speed.

A mental picture of this device in operation may be constructed by visualizing a wide belt conveyor on a steep angle with a textured surface such as that known as "orange rough top." Only sawdust sized material and finer will fit into the cut out "cells" in this belting material.

Looking at the concept more closely, it is possible to visualize flakes on edge fitting into the cells and thus traveling forward. This paper will offer three solutions in the event this would be the case in some applications. Ordinarily the cells will be symmetrical and consequently would not allow such pieces in any significant quantity to travel forward. Regardless, an optional screen or rotating brush to deal with these few pieces may be added in the places shown in FIG. 19. One or the other will normally suffice.

The brush will sweep away any pieces that will not totally fit into the cells. It should be built to last a long time and be maintenance-free. A regular medium soft brush with only a slight compression is necessary. Some of the fines will also be swept away but uniformly across the width of the belt. The total amount of fine material to be skimmed is controlled by the inclined belt speed. No suction need be provided if there is a "kicker bar" installed to operate against the brush. (This bar should be electrically grounded.) Again, only a maximum of ⅛-inch compression of the brush is warranted.

If this concept is utilized on a forming head as will be discussed in further detail later, the screen should not be a "ball deck" type as shown. This is because the balls themselves will deflect material while it is being passed through the screen. This may not be so noticeable except during the actual measurement of the cross-panel density, but we are striving for ever-better control. On the other hand, material will be deflected if large pieces become lodged into the screen. Furthermore, the direction of the slope of the screen should be in the longitudinal direction in a device that is part of the forming machine. The purpose for this is to remove those larger pieces from the path where the material is falling. Therefore, the screens should be sloped upstream or downstream and rejected oversized material should be captured for return to the forming head via the deckling system.

One significant advantage for utilizing the screens is that the fines may be further skimmed to produce only the finest of powders for surface material. The screens appear in all of the sketches for this reason.

Figure 20:
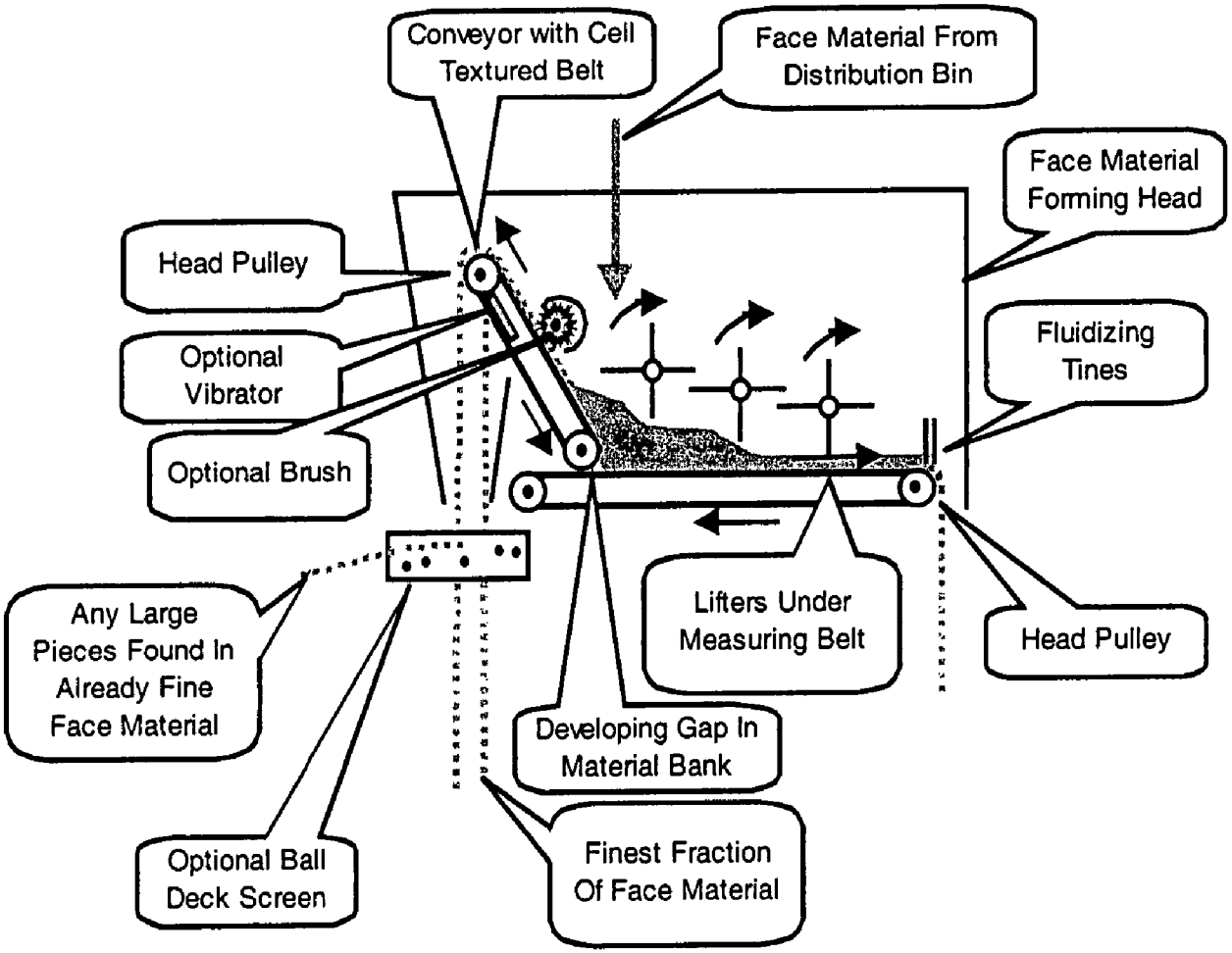
FIG. 20 shows Particleboard Face Forming Head Design #1.

The third way to deal with any large unwanted pieces is not shown in FIGS. 19 or 20. The process is to vibrate the conveyor belt or the entire conveyor to the degree that larger pieces are dislodged and fall down the slope. This is the preferred embodiment of those offered herein.

Another problem that could appear in the course of operation concerns the possibility of the cells having a tendency to clog over time. This does not seem likely since the problem is overcome regularly in the Metso machine on their diamond rolls. Nevertheless, two solutions are offered here to demonstrate the fact this is not a significant problem and to provide confidence in the design. A vibrator may be added as shown in FIG. 19 and FIG. 20 to assure the belt is emptied on the return side. This provides an ongoing cleaning methodology superior to any solution now available on the Metso machine. To provide further comfort in the design, a reciprocating pressure washer that may also be added for maintenance day cleaning is shown. Such a washer would travel across the width of the belt and the wastewater is captured and carried away by a trough below. Splash wipers may be raised up against the belt on the upstream and downstream sides to reduce over-spray.

The concepts of cross panel density control and fines separation may be combined into a face-layer forming head for the Christoffersen particleboard forming machine. The forming head is arranged so that the fines separating belt becomes the back end wall of the bin itself for the material to bank against.

The measuring belt is fixed a few inches below the fine material separation belt. Lifters and a suction plate are placed under the measuring belt. Although the brush and ball deck screen are shown in FIG. 20, I am confident that vibrating the entire fines conveyor will be better. Fluidizing tines are utilized over the head pulley but vibrating the measuring belt conveyor will eliminate these. Suspending the entire forming head from above or below and vibrating it will eliminate the need for the tines and for vibrating the fines separation conveyor alone.

In operation, there will be a small material gap located at the intersection of the fines conveyor and the measuring belt. Material cannot leak past the gap due to the forward motion of the measuring belt and material will not flow back if the forming head is stopped.

Figure 21:
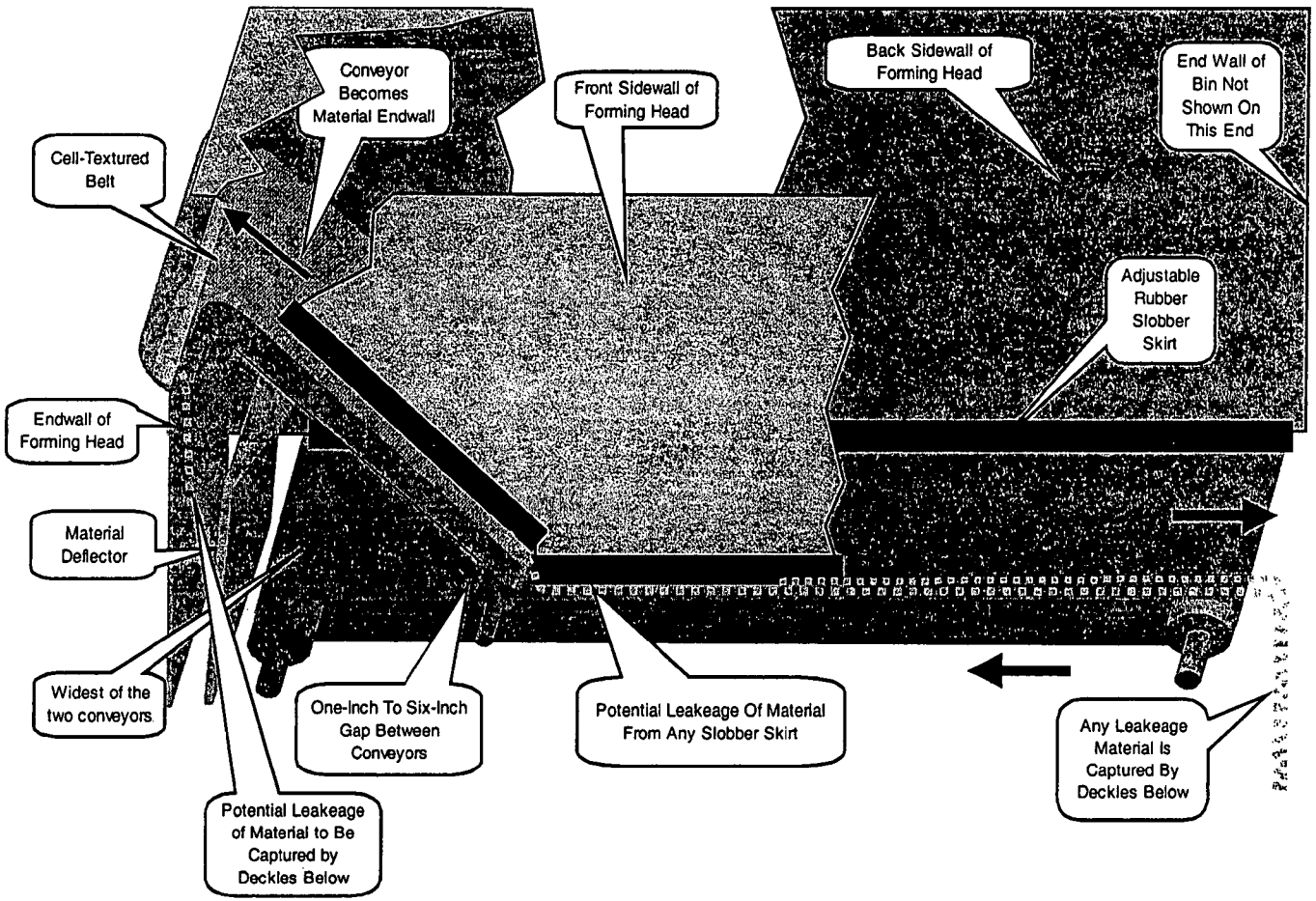
FIG. 21 shows Face Forming Head Conveyor and Side Wall Configuration.
Figure 22:
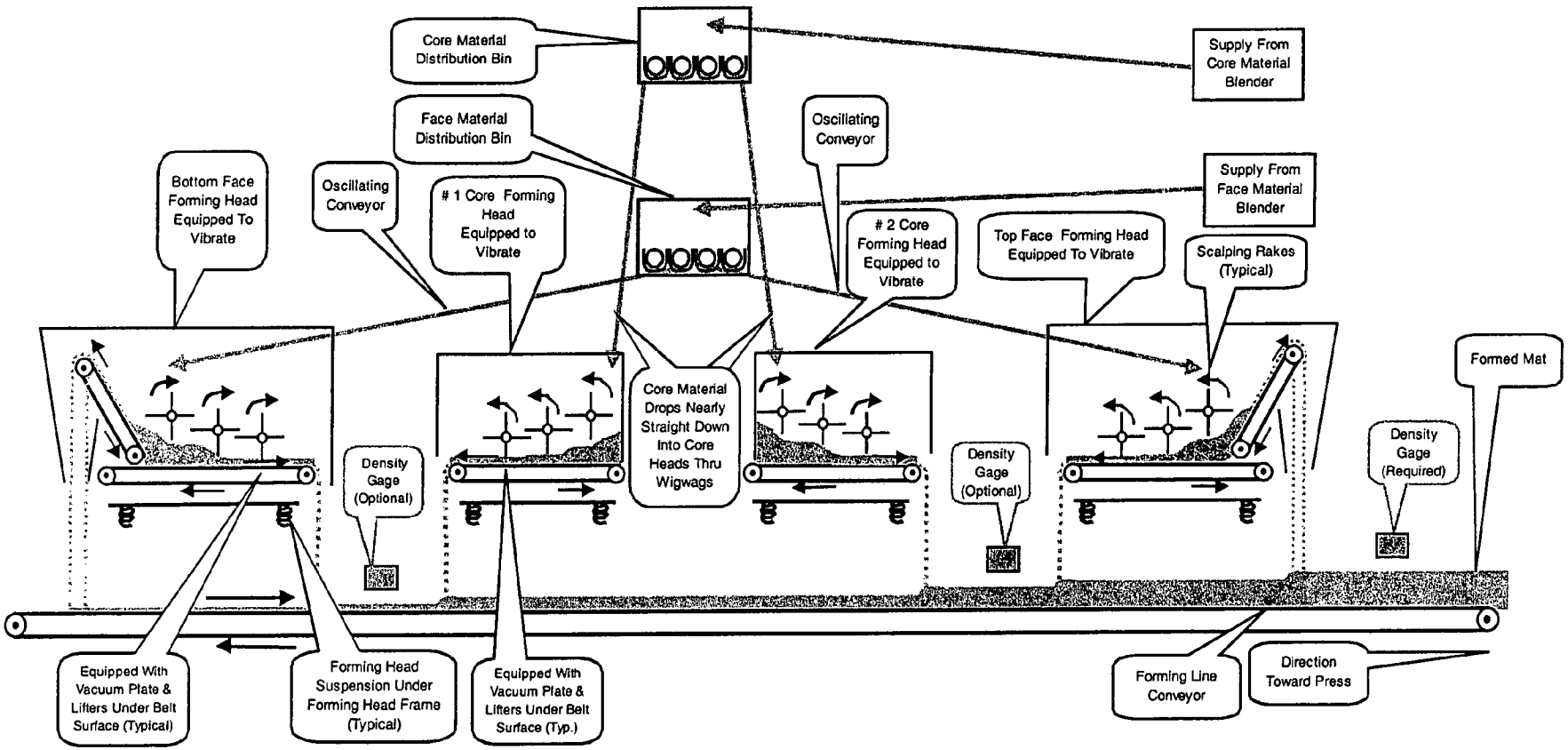
FIG. 22 shows Particleboard Forming Machine Configuration 1.

FIG. 21 illustrates the configuration of the forming head sidewalls and conveyors:

The illustration of FIG. 22 represents the best arrangement for forming particleboard utilizing these ideas.

There are three density gauges shown in illustrations in FIG. 22. Only the final gauge is mandatory. The others can be installed to further refine the control of the density profile by face, core, and face material.

Oscillating conveyors feed the two end forming heads while the two center bins are fed from the core distribution bin by dropping material directly down into the forming heads. These are facing the directions shown so that the slope of the chutes is nearly straight. One or both bins may be operated during production.

Figure 52:
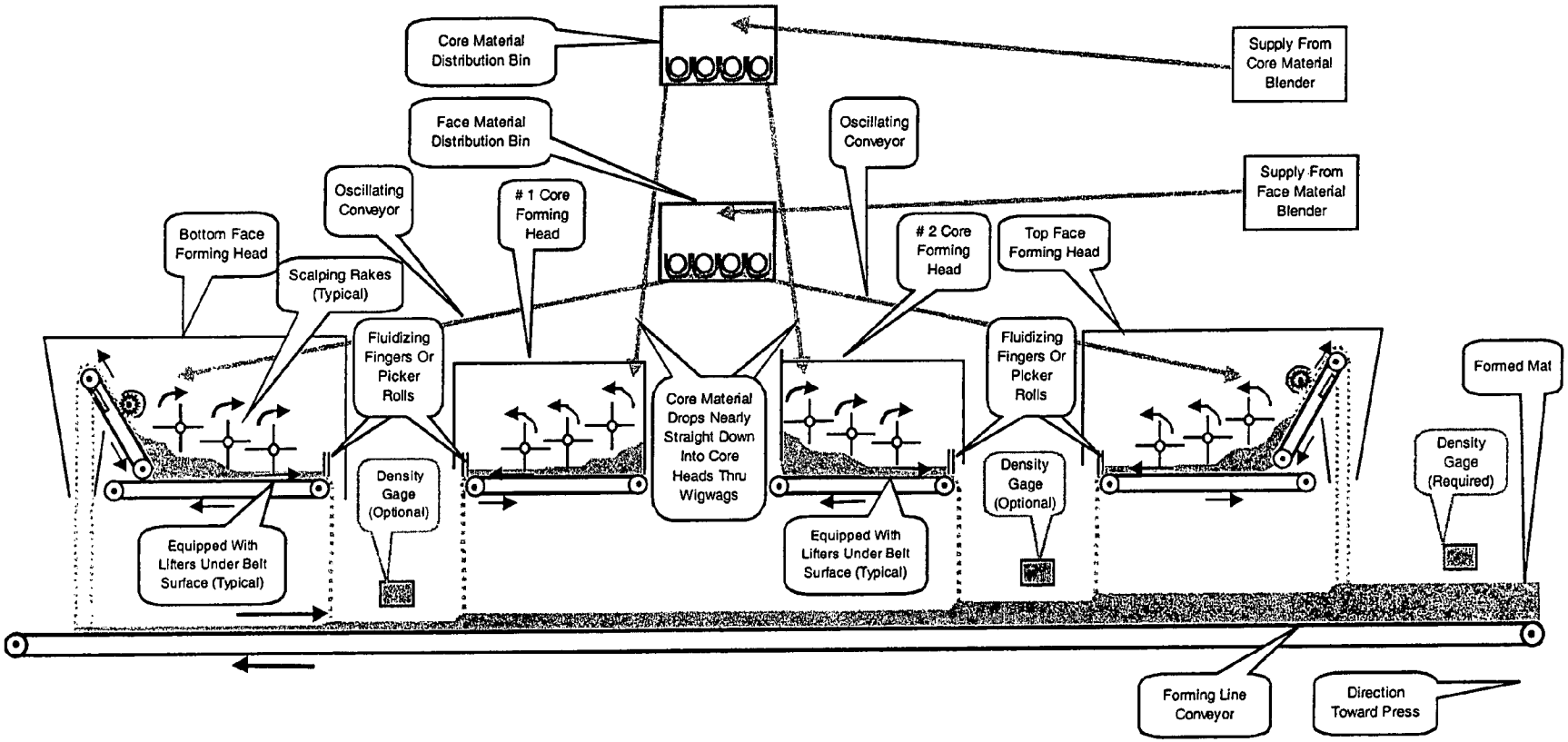
FIG. 52 shows Particleboard Forming Machine With Fluidizing Tines PB Configuration 6.

If the method of fluidizing shown in FIG. 22 is not utilized for some reason, Configuration 6 of FIG. 52 herein illustrates the incorporation of fluidizing tines.

Figure 47:
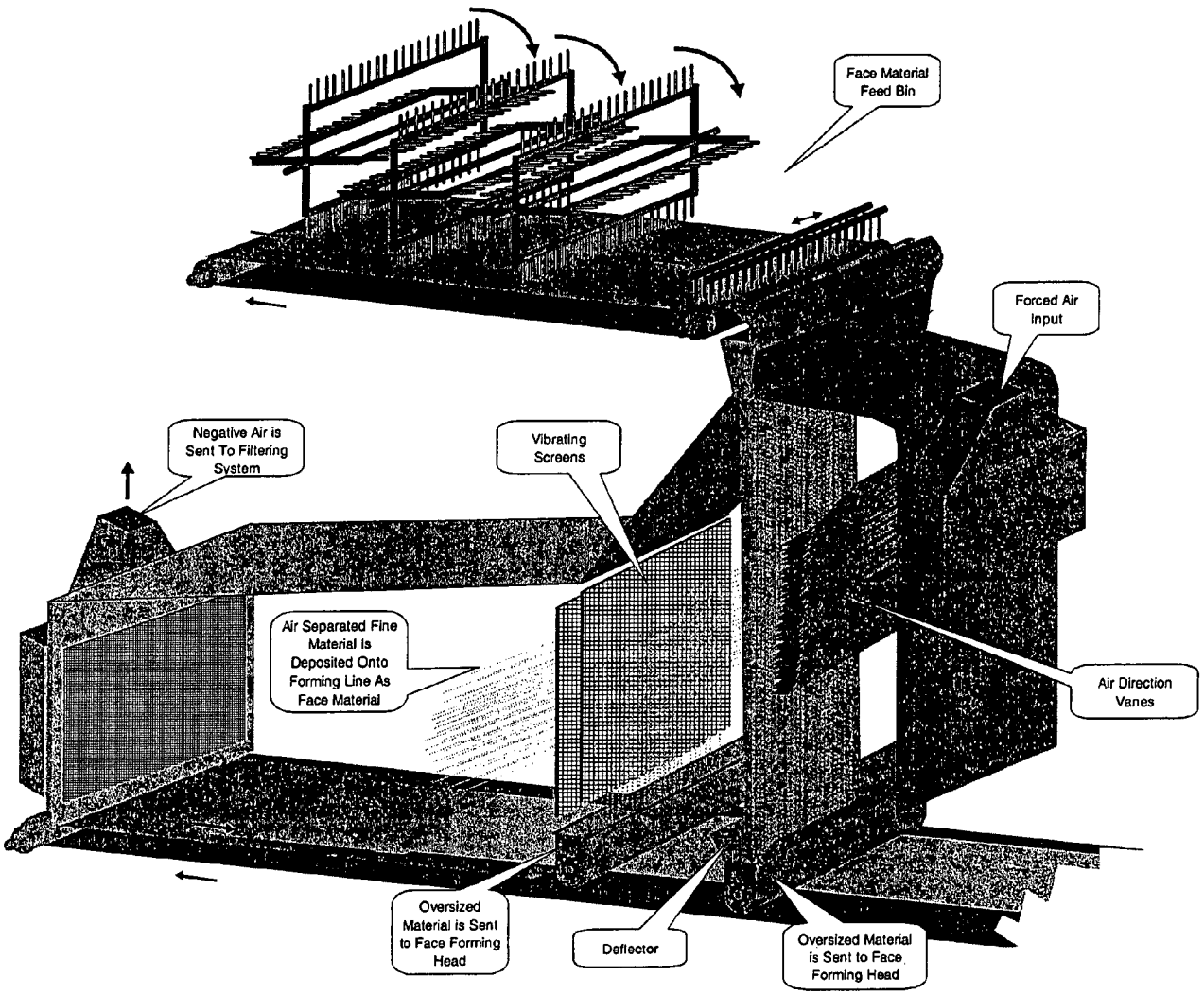
FIG. 47 shows Particleboard Air Separation Face Forming Head.
Figure 48:
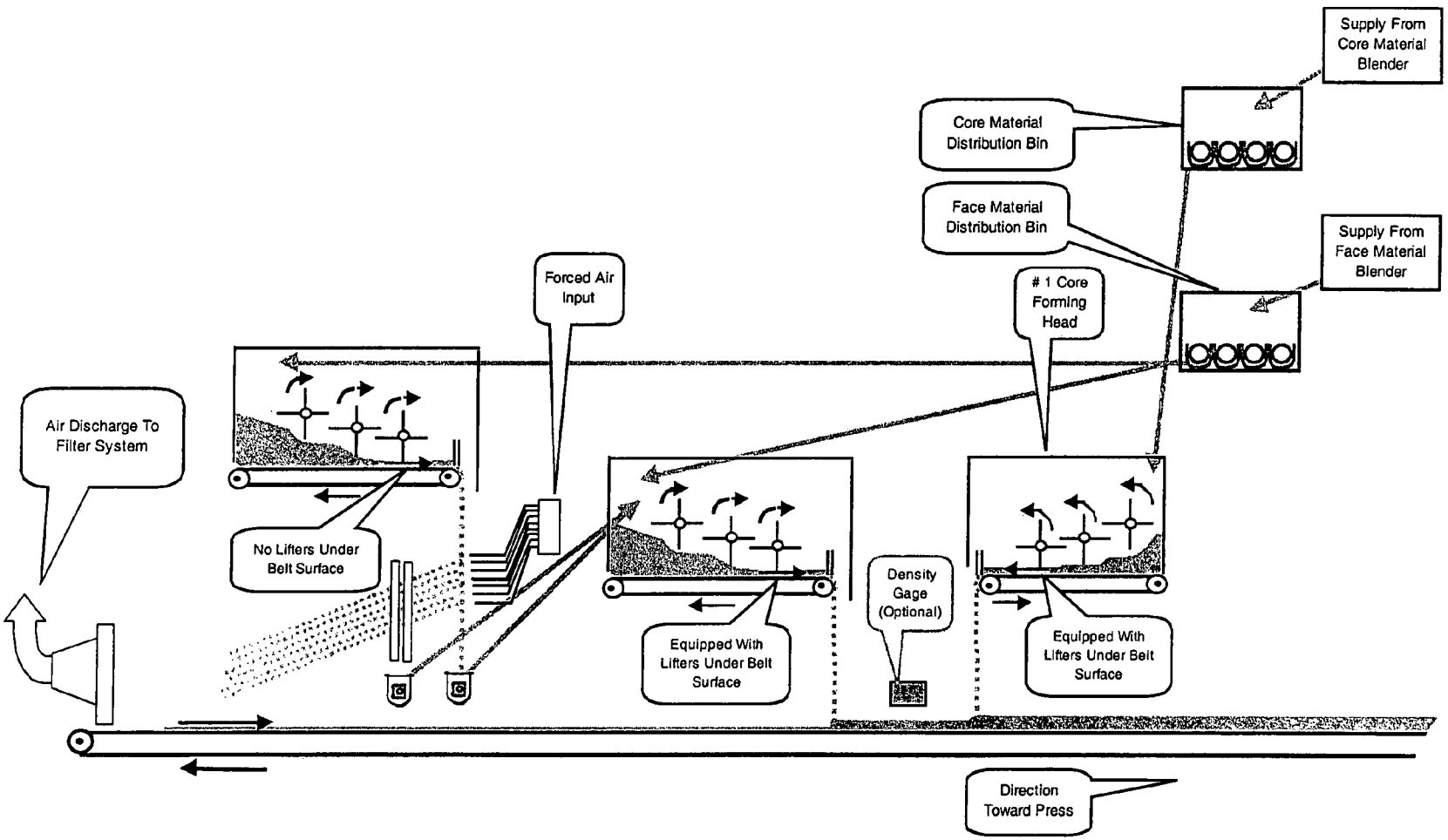
FIG. 48 shows Particleboard Forming Machine With Air Separation View of Bottom Face and Bottom Core Heads Only.
Figure 49:
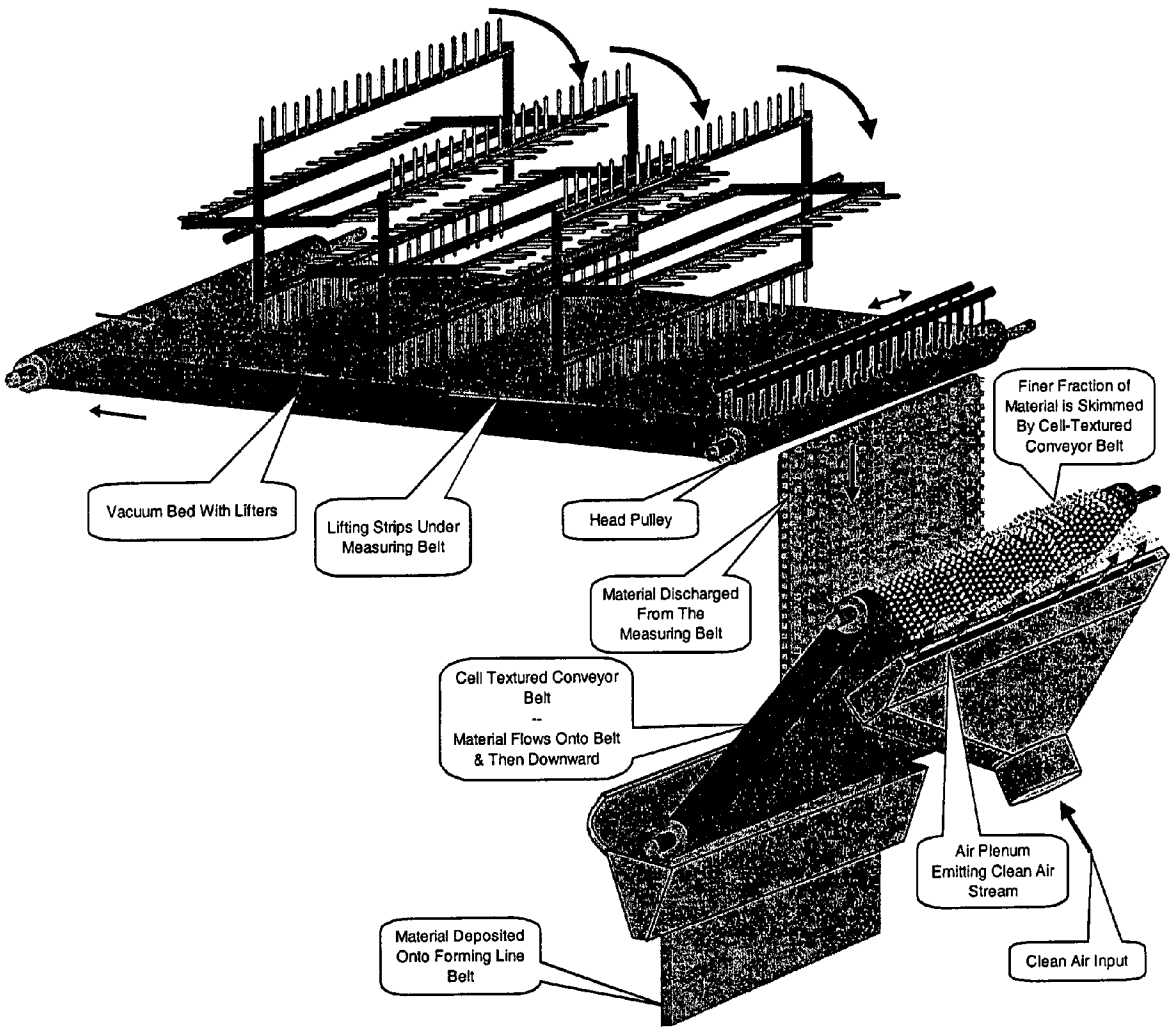
FIG. 49 shows Particleboard Face Forming Head Combines Lifters, Fines Skimming and Air Nozzle Fines Separation.
Figure 50:
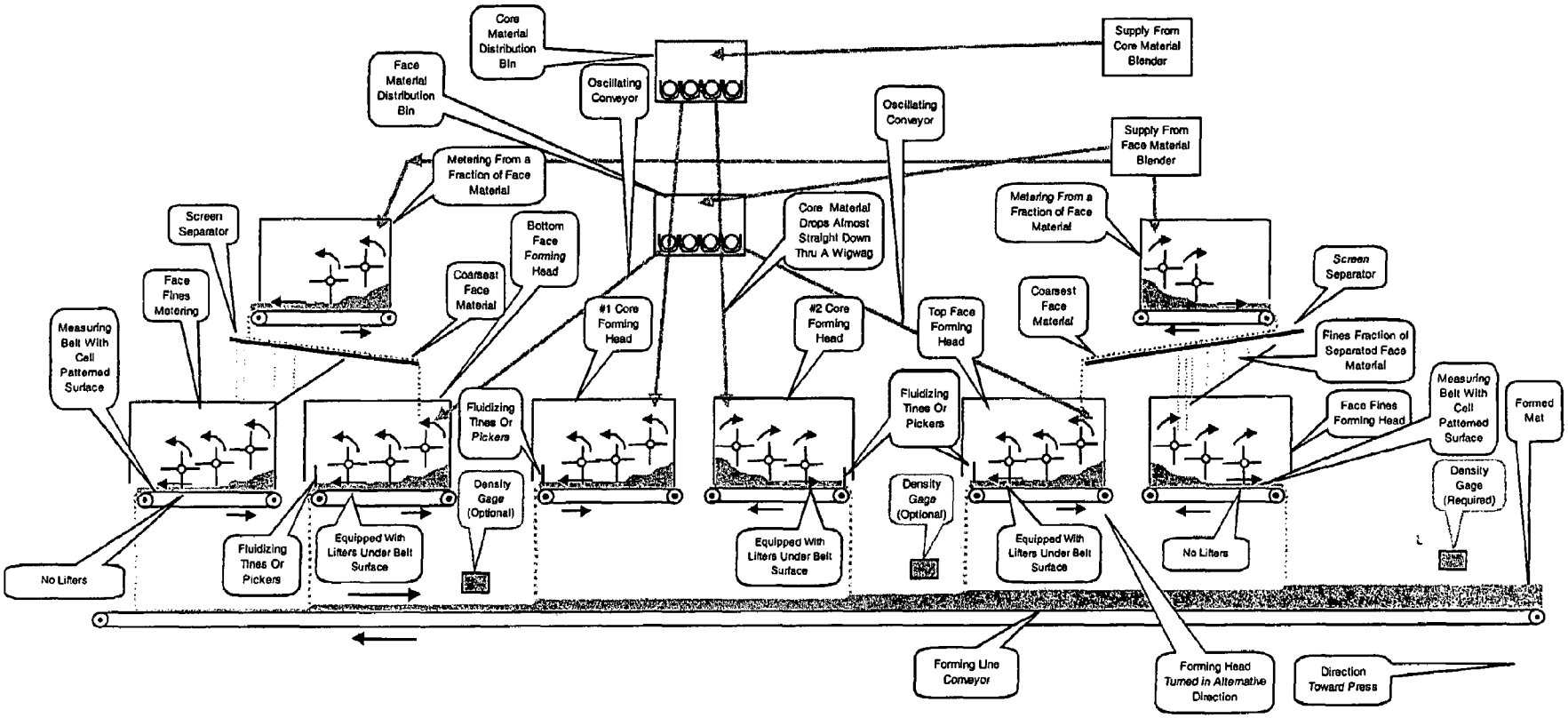
FIG. 50 shows Particleboard Forming Machine With Screening PB Configuration 4.
Figure 51:
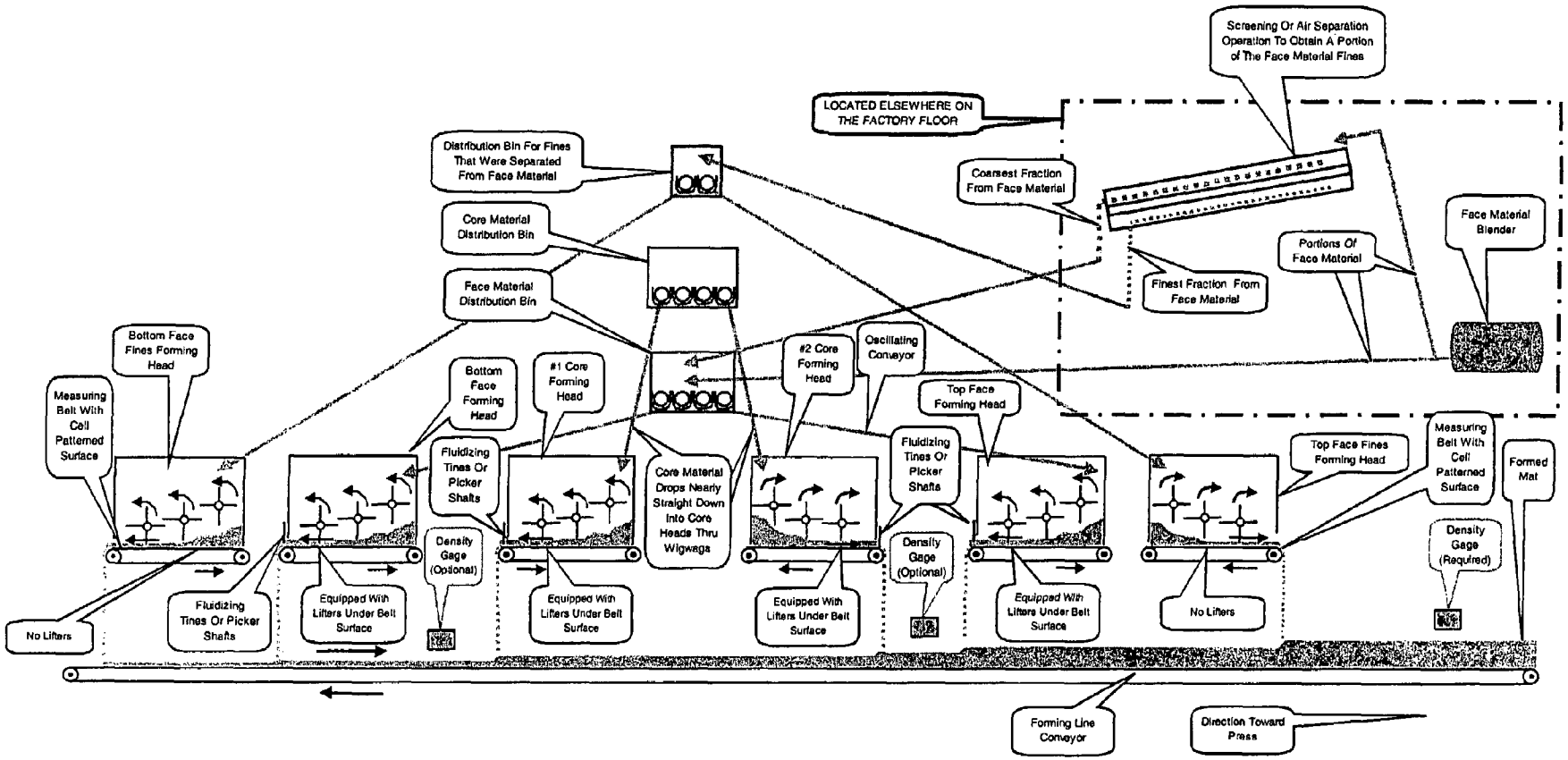
FIG. 51 shows Particleboard Forming Machine With Remote Screening PB Configuration 5.

If the skimming method shown in FIG. 20 is not chosen for some reason, then other means of providing surface fines must be utilized. Air separation can be utilized and combined with other controls described here. FIGS. 47, 48 and 49 illustrate air separation combined with the controls previously described. FIG. 49 functionally illustrates the Christoffersen air-separation forming head combined with the lifter controls. However, if the objective is to devise an all-mechanical former, FIGS. 50 and 51 illustrate how machines with such features may be alternatively configured. It should be noted that these configurations require substantially more hardware and are much more complex to operate. Both factors relate to cost. Regardless, such cost may not be out of reason considering the massive size and mechanical complexity of competitors' forming machines. Still, previously illustrated methods seem much more efficient.

Section III

MDF Forming

Figure 23:
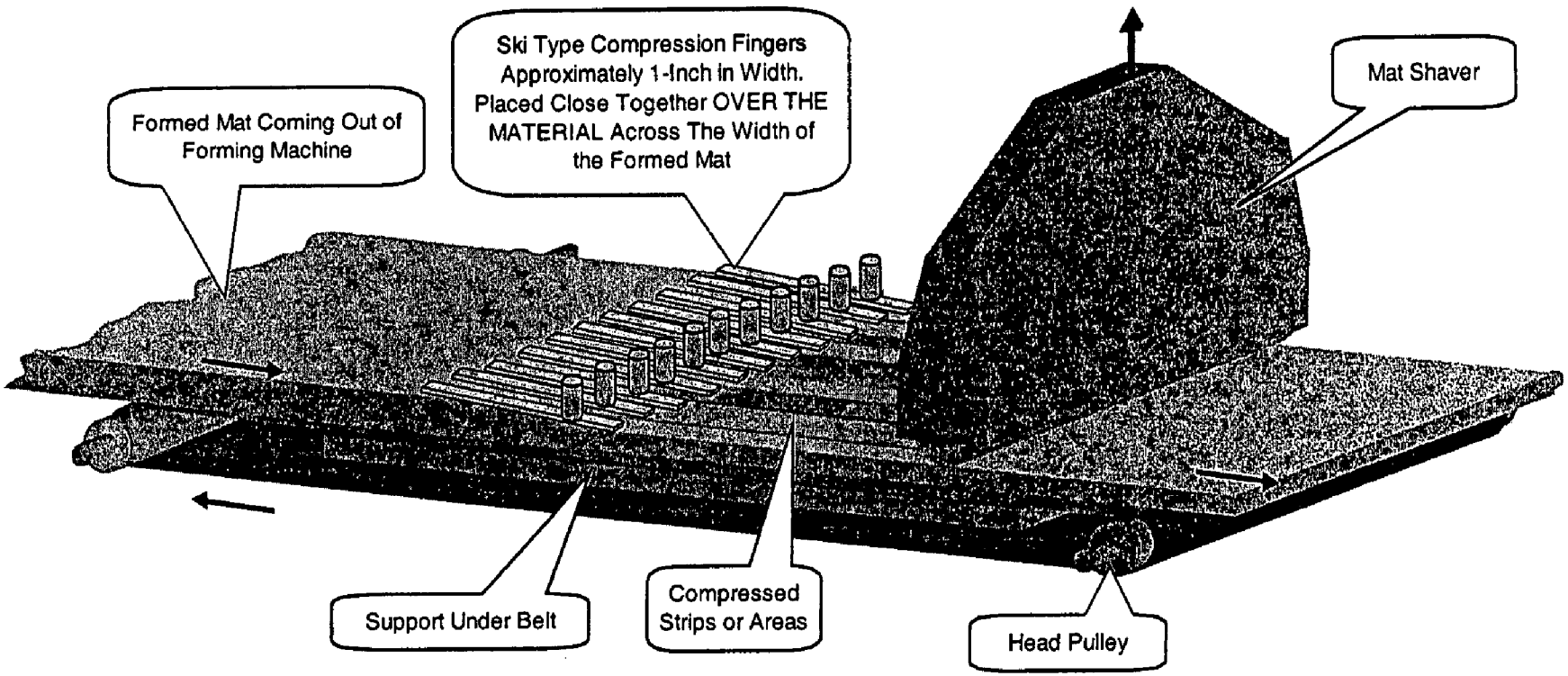
FIG. 23 shows MDF Mat Compressing.

The Christoffersen MDF forming machine concentrates on dealing with cross-panel density after the mat has been formed. Accordingly, existing vacuum and mechanical forming methods already commonly in use may be utilized. Subsequent to forming, the mat is measured for cross-panel density and overall density by CNC methods as previously discussed. Compressing areas that are too low in density and then sending the mat through the mat shaver makes density profile corrections. FIGS. 3 and 4 covered the subject earlier. However, FIG. 23 is applicable more directly to MDF.

As discussed in Section I, the skis may be replaced with wheels to accomplish the same function.

The machinery required for cross-panel density may be retrofitted onto existing production lines because of its simplicity. Already, some production lines utilize a ski type compressor on the production line to increase the mat density along the edges. The space required for retrofit then may be already available in some facilities. All that is needed is to remove the existing skis and add the new compression ski assembly, add CNC process to control the activation of each ski and then connect the system to the density profile gauge.

Section IV

OSB Forming

The Christoffersen OSB forming machine makes use of the density control ideas previously discussed and adds a unique strand orienting system.

The forming heads are similar to those described previously for particleboard. The method of fluidizing the material coming off the conveyor is also slightly modified utilizing rotating shafts with spikes at the proper spacing. Also, the concept of funneling the material into a tight stream longitudinally after it leaves the measuring belt aids in accomplishing good density control. A scalper with solid rakes will not work well. Therefore, rakes with tines should be utilized. However, an angled scalper can be placed over the lifters to sweep the material sideways to be captured and reintroduced to the forming head. Such a final scalper would be an alternative to a conventional scalper.

Fluidizing tines can also be utilized but the spacing across the width of the panel will likely be greater than that required for particleboard. As with the particleboard forming previously described, the lifters under the forming head measuring belts are CNC driven through feedback from a density gauge or multiple gauges.

Figure 24:
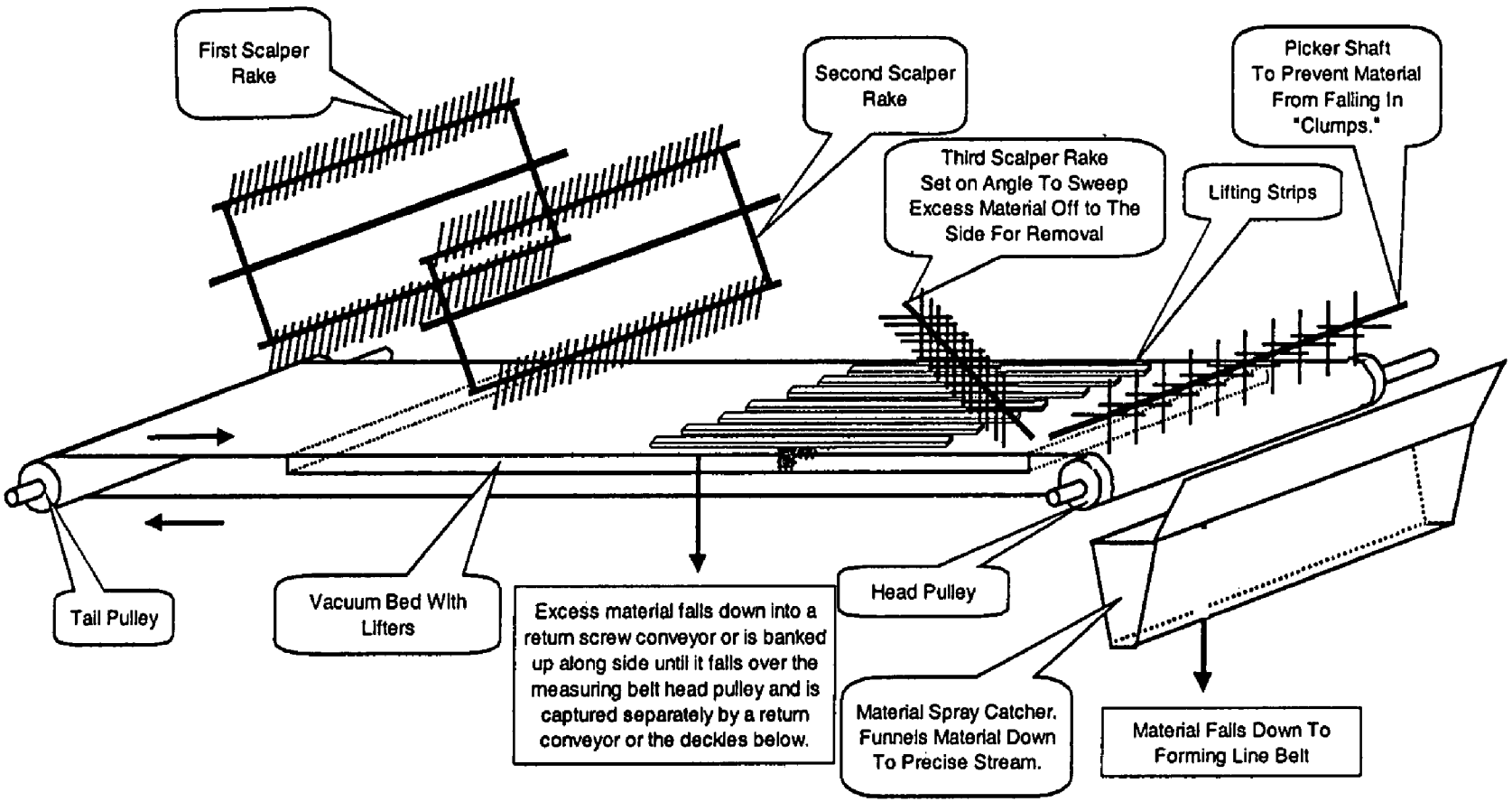
FIG. 24 shows Forming Head with Angled Scalper & Material Funnel.

FIG. 24 provides another configuration example utilizing the angled scalper rake.

Proper strand orientation is accomplished on the faces by depositing the wood strands onto a bed of bars placed on edge that are oriented longitudinally with the OSB mat orientation. These bars are arranged and fastened together into two sets. Every other bar across the panel width belongs to the first set while the remaining bars belong to the second set. Such sets are made to move in a "walking floor" kind of motion with each other. More specifically, as the first set is moved from the starting position upward and downstream toward the press, the second set is moved downward and back upstream into a starting position.

The Rader Company designed and sold a similar device for the purpose of screening larger pieces of material from smaller ones. They called the machine a "bar screen" or a "blade screen" depending upon the thickness of the bars utilized for walking the material. Steel bars of approximately ⅜ inch and thinner were considered "blade screens" while machines with thicker bars were considered "bar screens."

On the Christoffersen OSB orienting machine, the walking movement is very rapid and lifts the strands sufficiently high so that the strands are fluidized. They are taken from a jumble to an orientation sufficiently adequate to allow them to drop through between the bars and down to the forming belt. Some strands will fall through immediately while others will become sufficiently oriented to fall through later as a result of the fluid action. The speed of forward travel is matched to that of the forming line conveyor below. This locks the density to that originally determined by the measuring belt above.

The spacing of the bars is determined by the degree of orientation required by the customer. The bar length (or more appropriately "the length of the orienter") is determined by spacing of the bars and line speed. Therefore, if tighter control of strand orientation is desired, greater bar length is required to assure all strands will have dropped through the openings. Otherwise, some strands will eventually fall off the end of the bars without orientation. Similarly, any other material such as larger foreign objects will be conveyed over the end of the bars and may be captured by a trash conveyor.

The bar height and distance from the mat below will also influence the degree of orientation. Therefore, the height should be more than is expected to be required for the length of strands to be cut by the customer. The proximity of the bottom edge of the bars to the formed mat below must be adjustable so that it may be placed very close to the mat no matter what thickness OSB may be required by the customer.

Figure 25:
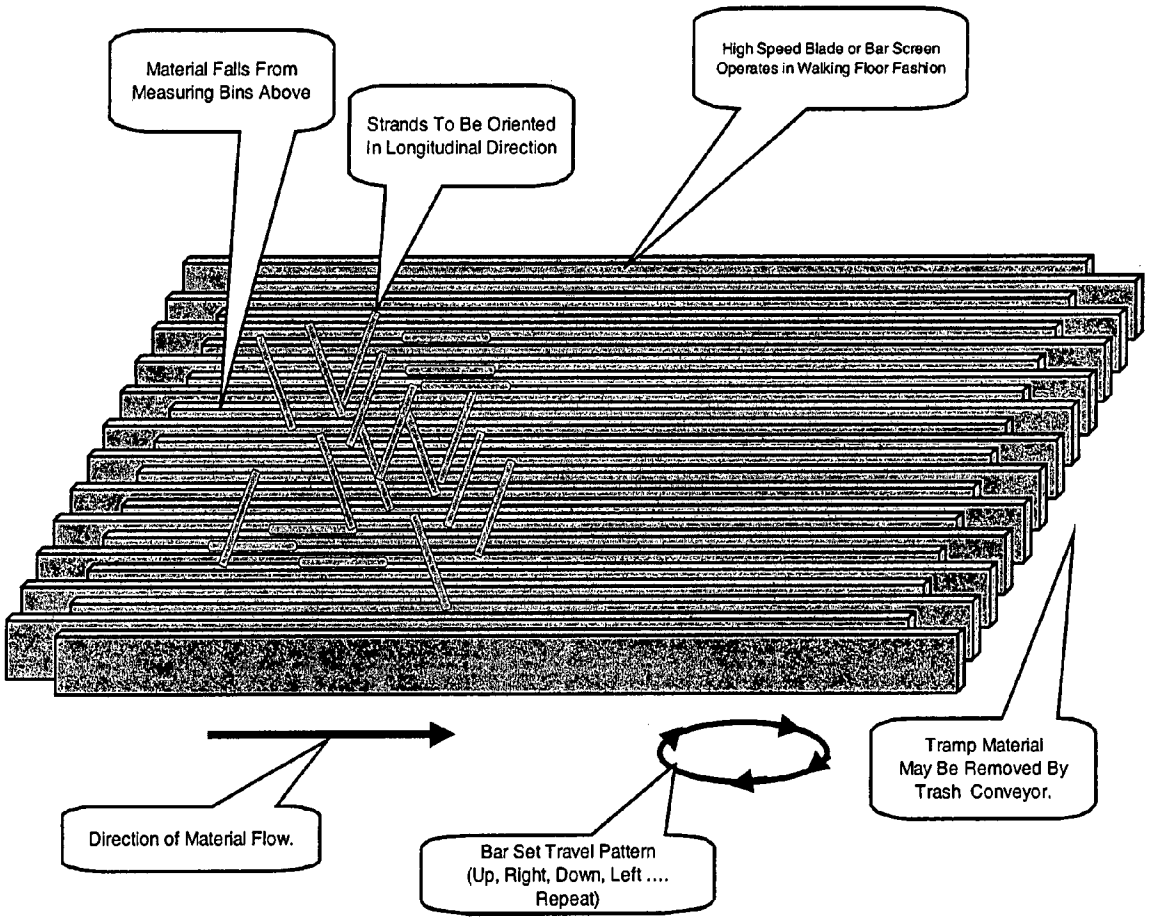
FIG. 25 shows Longitudinal or Lengthwise Orienting Device.

FIG. 25 illustrates the Christoffersen longitudinal orienter.

Figure 26:
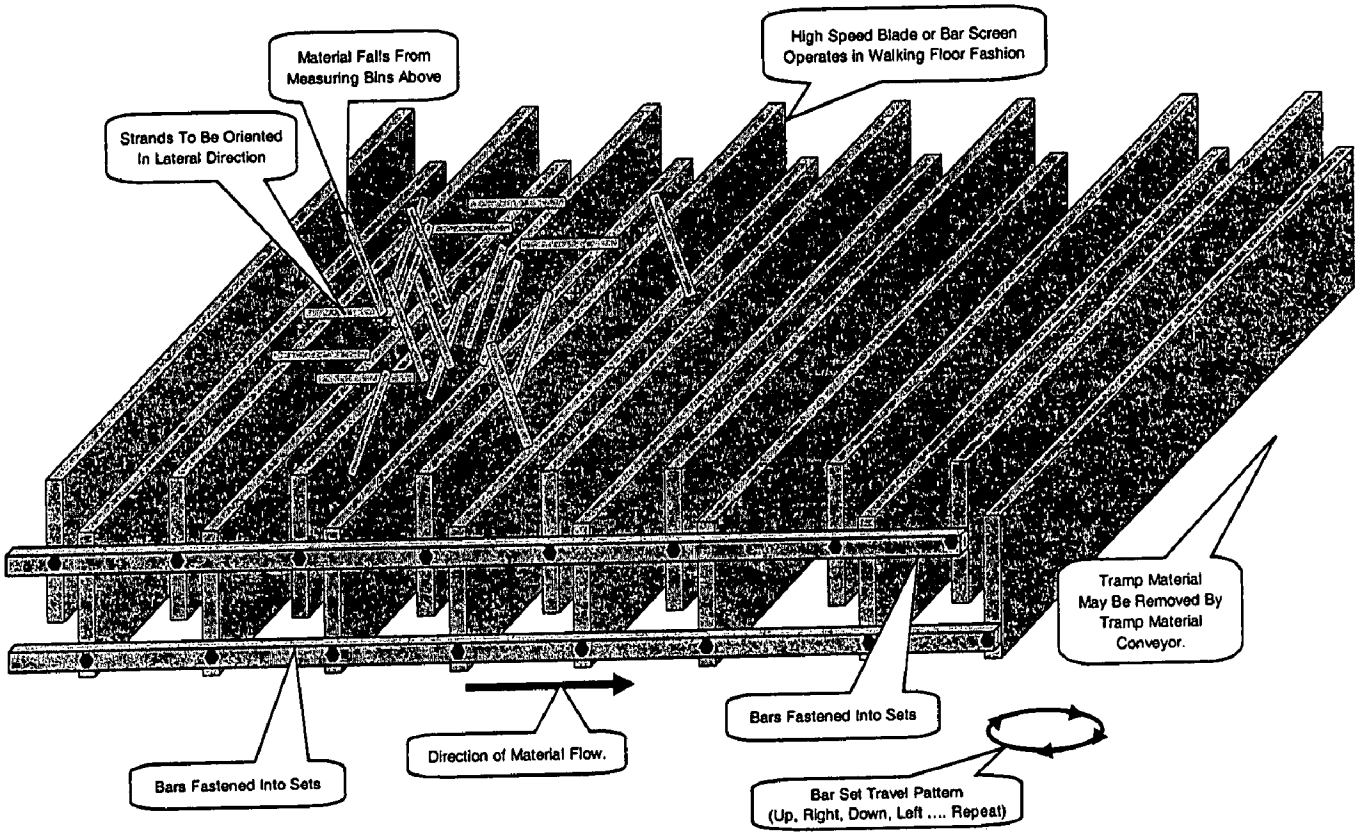
FIG. 26 shows Crosswise Orienting Device.

FIG. 26 illustrates the Christoffersen latitudinal or crosswise orienting device.

As with the lengthwise orienting device, the bars of the crosswise orienter are configured into sets. Every other bar becomes a member of the first set and the remaining bars are members of the second set. The difference from the lengthwise orienter is in the orientation of the bars. In order to lay the strands in a crosswise orientation to the length of the mat, the bars must be placed crosswise.

The walking motion is the same for the cross orienter as for the longitudinal orienter. Each set walks the material forward toward the press at a rate of conveying speed equal to that of the forming line conveyor below. The cross orienter motion is vigorous and forceful enough to create a dynamic fluidized motion of the strands similar to that of the longitudinal orienter. As strands move forward they become sufficiently oriented to fall through the bars.

The length of the crosswise orienter is determined by a function of time the same as for the lengthwise orienter. Therefore, the distance required for the strands to become oriented is dependent the spacing of the bars and upon line speed.

In contrast to the lengthwise orienter, the crosswise orienter must be placed sufficiently above the product to allow the strands to clear the bottom edge of the orienting bars before making contact with the formed mat below. Otherwise, the "dragging" motion of the mat against the strands may adversely affect orientation; whereas, with the lengthwise orientation process, dragging can assist in providing proper orientation. Distance from the formed mat with the crosswise orienter, then, is primarily dependent upon strand length.

Alternatively, I have devised the means of conveying and orienting by utilizing a simple fluidized conveyor with oriented bars providing the conveying surface. (No illustration is provided here.) However, the walking floor action can contribute a considerably better control of the strand dynamic movement. It is also a proven method of filtering.

Figure 27:
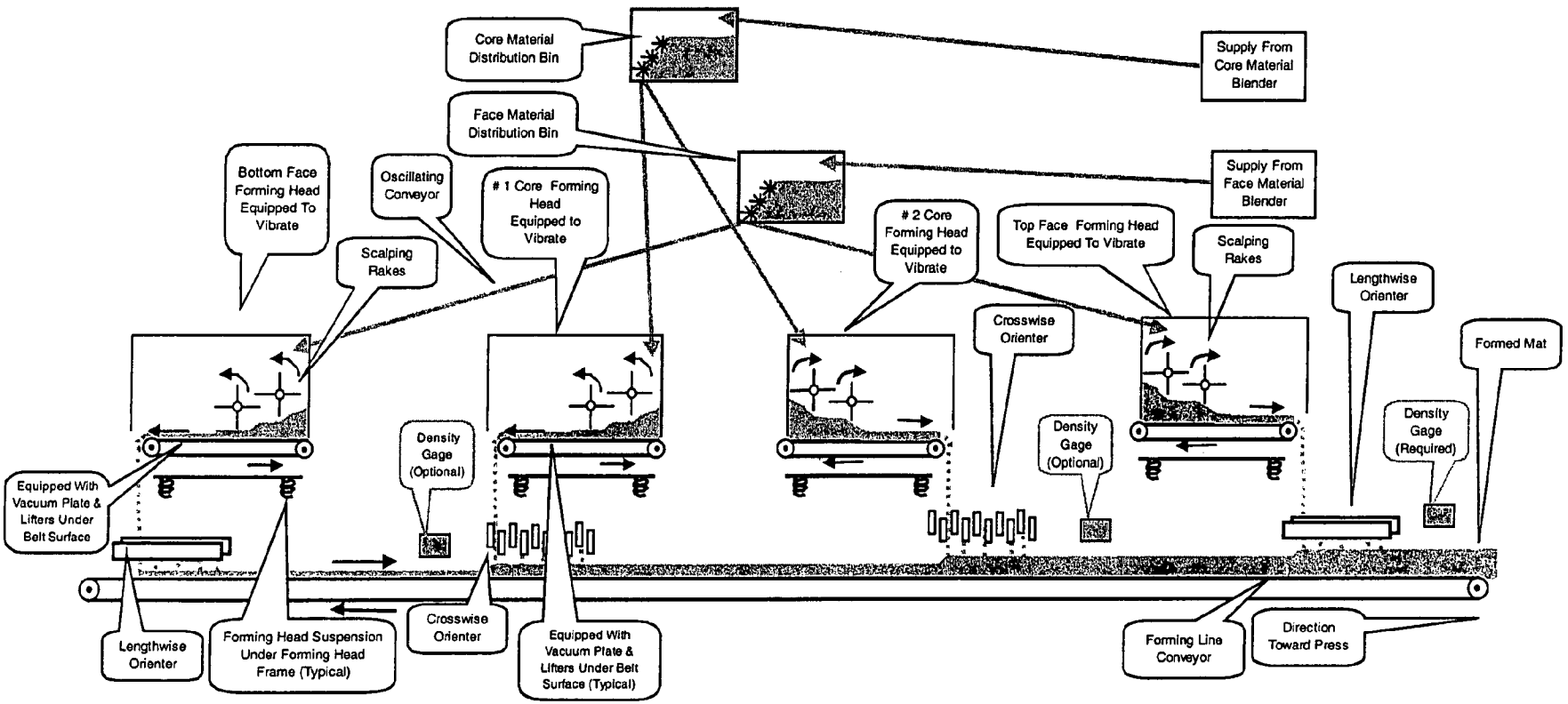
FIG. 27 shows 4-Head OSB Forming Machine.

FIG. 27 illustrates the best configuration for a 4-head OSB forming machine.

Section V

Additional Density Control Methods

In addition to all of the above density control devices and forming methods there are some additional controls in the Christoffersen forming machine methodologies that can be implemented. They are addressed here because they seem to fit only isolated circumstances for this point in time. Regardless, it is also conceivable that OSB forming can create board product with random patches of low density due to the unpredictability of how strands will be oriented. It is also somewhat true for particleboard but to a much lesser degree. These patches will be normally corrected to a great extent if sufficient density gauges are utilized on the forming line. Nevertheless, the last forming head (the top face) could possibly still create random patches in the product with lower density that will not be corrected. This discussion will deal with that issue so that the reader can maintain a very high confidence in the Christoffersen forming machine methods.

It should again be kept in mind that we are seeking a system with super-tight density variation parameters. The minor density variations we are "tweaking" here would have previously been ignored. Indeed, such variations will likely pass the average customer's ideal standard today for density. Furthermore, it seems no other forming machine design deals with the issue.

Figure 28:
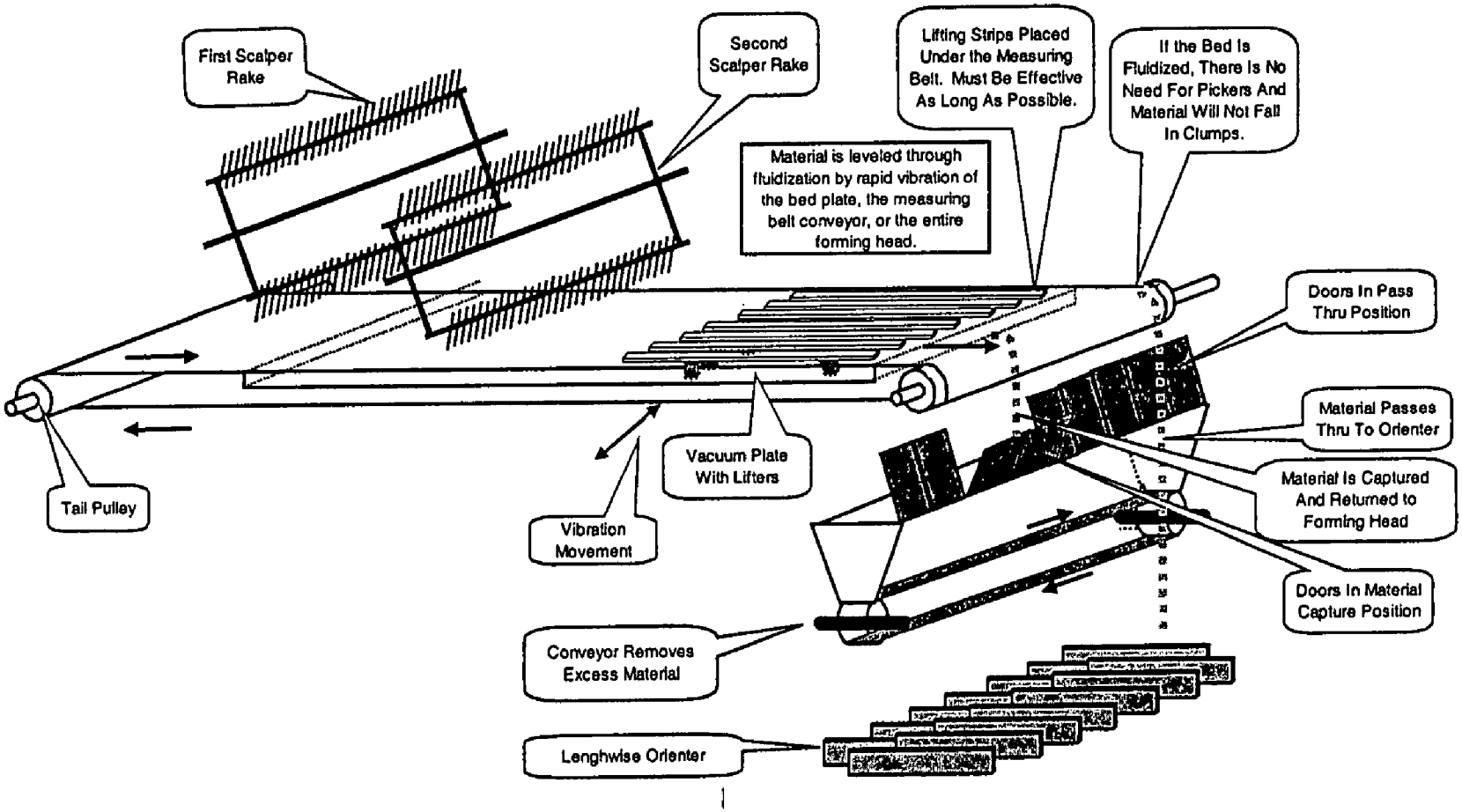
FIG. 28 shows Fine Tuning Forming Head (Final Stage)

FIG. 28 illustrates the configuration of a "fine tuning" forming head that has the capability of turning on and off in various areas across the panel width. Also, the machine can form product full-width or be turned off entirely for short interludes or for extended periods of time.

The key element is a conveyor placed under the measuring belt so that it normally allows the wood material to pass by and down onto the forming line or onto a lengthwise orienter in the case of OSB. Doors or flaps ("flaps") pop to the "on" or "off" position to allow pass-through position or capture position.

Figure 29:
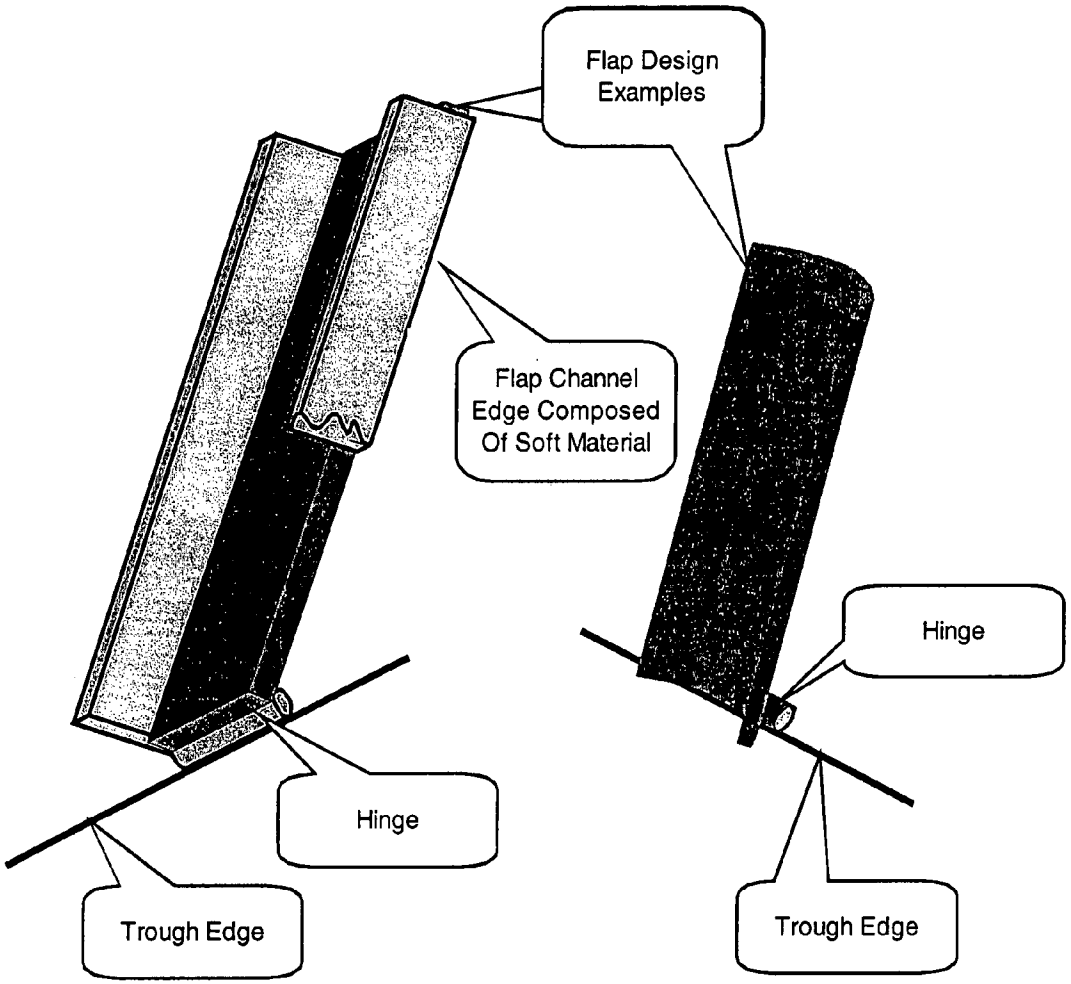
FIG. 29 shows Flap Design With Capture Trough.

The flaps are CNC operated in response to feedback from the density gauge similar to that described for lifters, pushers and positioner devices previously described. Note that the flaps are illustrated with a width larger than is desired for maximum density control. Additionally, these should be manufactured so that wood material is contained within channel edges on the "capture side." This will assure that wood pieces being captured will be better prevented from wedging between the flaps. FIG. 29 illustrates two possible designs of flaps.

FIG. 28 shows the assembly mounted upstream of the head pulley break-over point with the flaps hinged to the downstream edge of the conveyor. However, the assembly could be mounted downstream of the break-over point and the flaps hinged to the upstream edge of the conveyor.

A funnel is located adjacent to the material removal conveyor to redirect the pass-through material straight downward to the forming line.

FIG. 28 also shows lifters incorporated into the forming head. However, these are not imperative because the flap mechanism will control density. This layer of wood material will be very thin regardless of what type board product to which this system is being applied.

Figure 30:
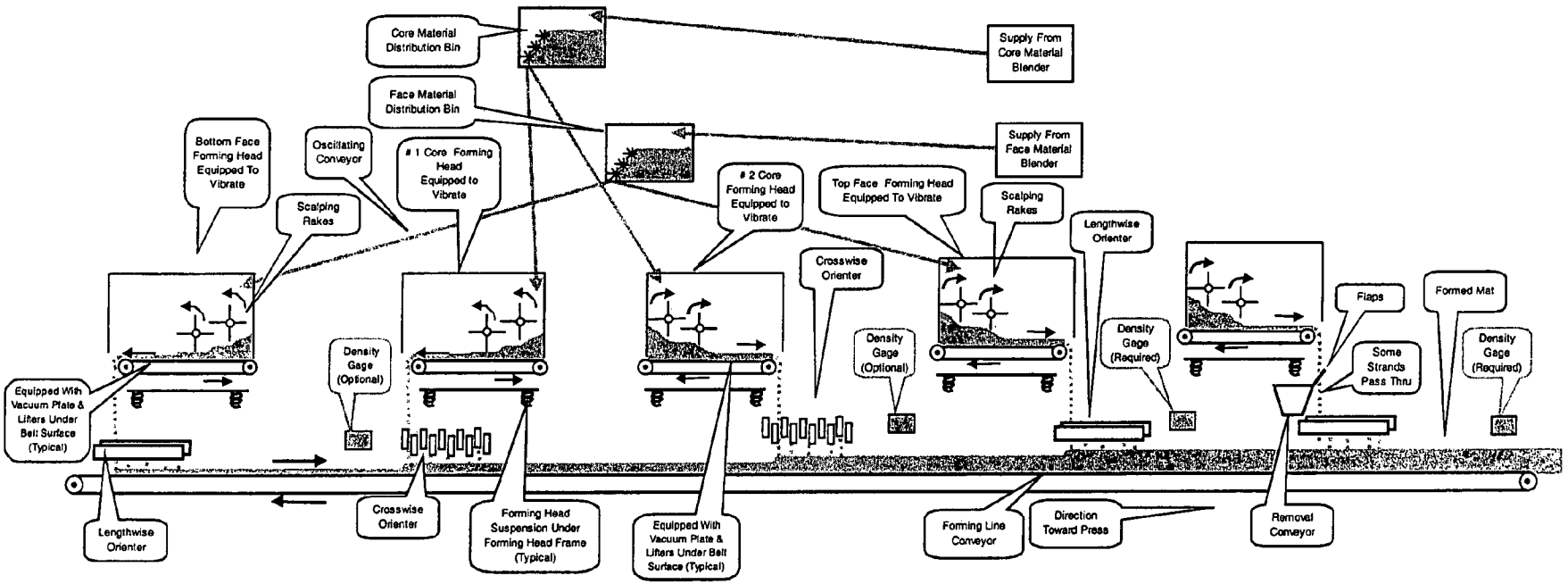
FIG. 30 shows 5-Head OSB Forming Machine Configuration.

The forming head is placed onto the forming machine in addition to what has already been illustrated. For example, on an OSB forming machine that utilized four forming heads as shown in FIG. 27, there will be five forming heads as shown in FIG. 30.

If the forming head is to be applied to particleboard, only fine surface material will be distributed from this head. The configuration will be similar to a particleboard fine material head as previously shown but with the capture trough added underneath.

Section VI

Extruder Forming Methods

This section describes another method of forming mats for MDF and portions of particleboard. It does not apply to OSB due to the issues of orienting strands and of crushing strands in the extrusion process. Extruders are generally expensive to manufacture and this fact might preclude this concept from competing in the market. However, the concept is included here in the interest of providing a more complete presentation. Besides, there are advantages to this type of system over more conventional ones.

The key element of density control is similar to that previously described. Specifically, this method is CNC controlled but the mechanical devices to be activated by the system are placed in a chamber on the exit end of the extruder after the augers. These devices constrict those areas of the extruder where the density should be reduced. The amount of constriction is in relation to the amount of density reduction. The chamber allows the material to be moved more freely due to the absence of any augers.

Figure 31:
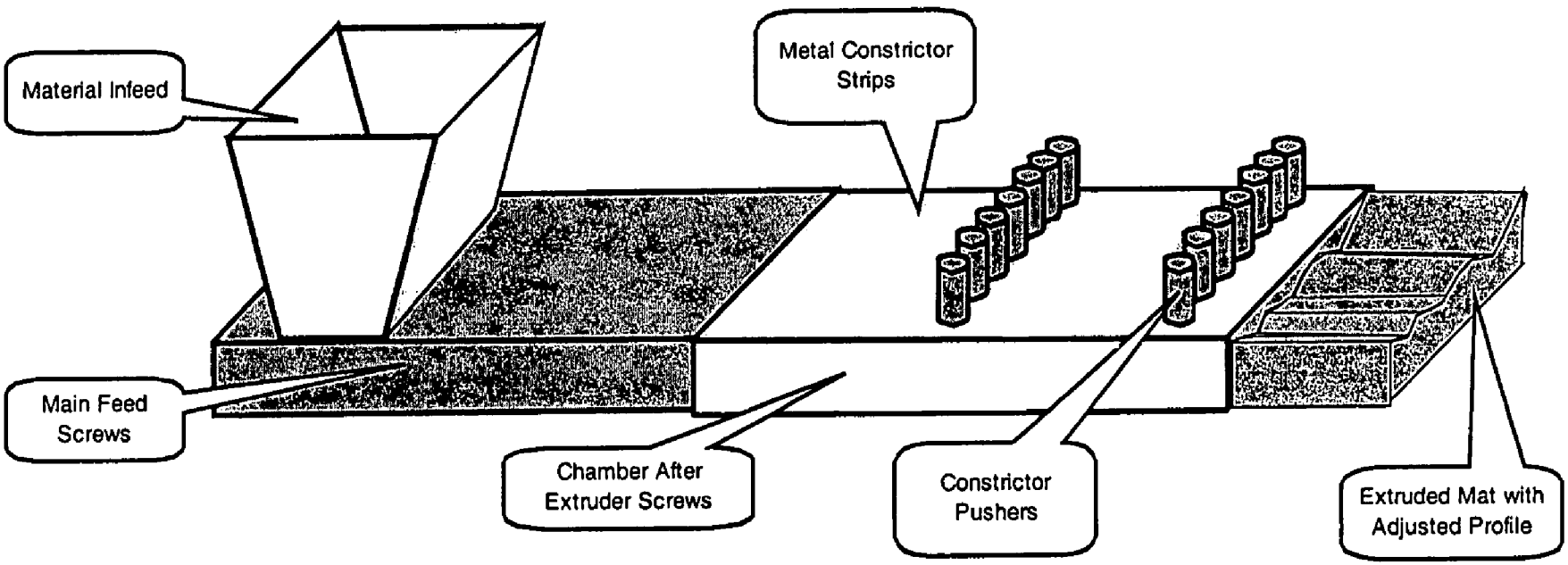
FIG. 31 shows Extruder Forming Head.

Since the amount of material passing through the extruder must still exit someplace regardless of the constriction at various points, the less constricted areas must supply more material in percentage and an increase in mat density for that area. This causes the extruder main feed screws to be reduced in speed through control of the CNC system. This speed reduction amount can be determined in two ways: by feedback and correction based upon a subsequent cross-panel density measurement or by an estimated cross-panel reading prior to the actual measurement. The estimated reading is an anticipated one and can be based upon historical data for amounts of correction or based on calculated volume of the extruder orifice. Either way, the subsequent cross-panel measurement will provide a new pattern that becomes the new baseline to correct. Nevertheless, this baseline will be closer to uniform than the previous one. FIG. 31 illustrates an extruder type of forming head.

This method allows all of the wood material to be moved sideways from several points as required as it travels forward through the extruder to exit onto the forming line at an optimum cross-panel density profile. FIG. 31 above also shows an exaggerated profile of the mat as it leaves the extruder. The pattern is illustrated from the top as the constrictor devices are shown only on the top surface. Regardless, constrictors may be placed on the bottom as well. Constrictors can also be designed with the capability to entirely close off areas along the edges so that the width of the formed mat can be controlled. Additionally, if the feed screws are constructed so that they are independent of each other, their speeds can be varied independently.

As previously stated, MDF and portions of particleboard may be formed utilizing this method. If the product to be formed is MDF, then one or more forming heads of this type may be utilized on a production line. If the product is particleboard, then this type of forming head cannot separate the fine material from the courser and so it cannot form the top and bottom fine surface layers. Particleboard surface fines must be formed by a surface fines forming head such as those previously illustrated in FIG. 22 for the "face fines" or as that shown in FIG. 32.

Figure 32:
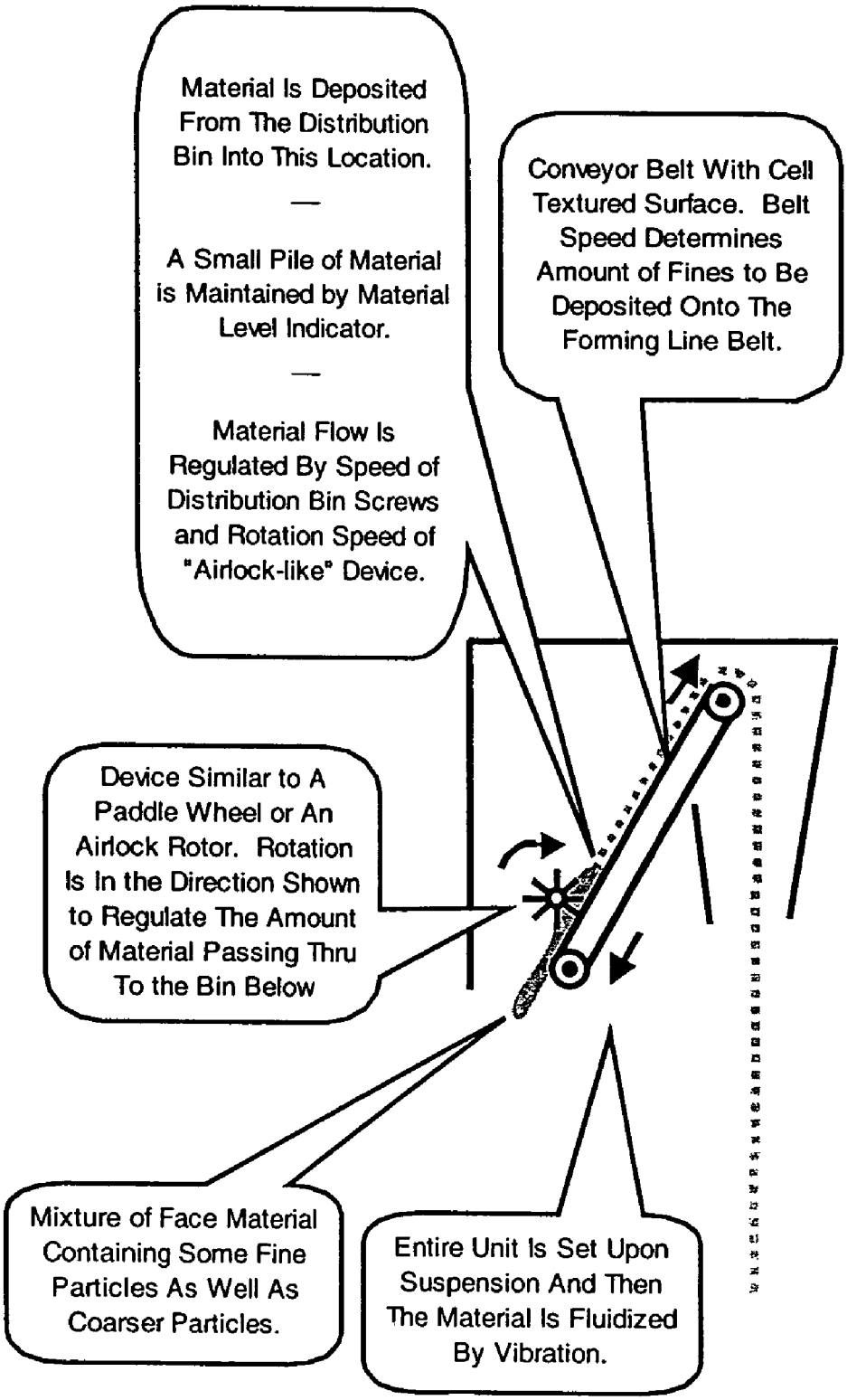
FIG. 32 shows Fines Only Forming Head.

An advantage to this method over more traditional forming methods includes the concept of delivering the material to the mat with little delay. Scalpers utilized in other types of forming heads create dwell time due to the mixing of the fresh material with older material in the forming head. The advantage is somewhat diminished in particleboard faces because scalpers are required in the face fines forming head. Reducing the number of scalpers will substantially alleviate the problem. The goal is to assure there is plenty of wood material covering the textured belt full width. FIG. 32 illustrates a more efficient way this can be accomplished.

Figure 33:
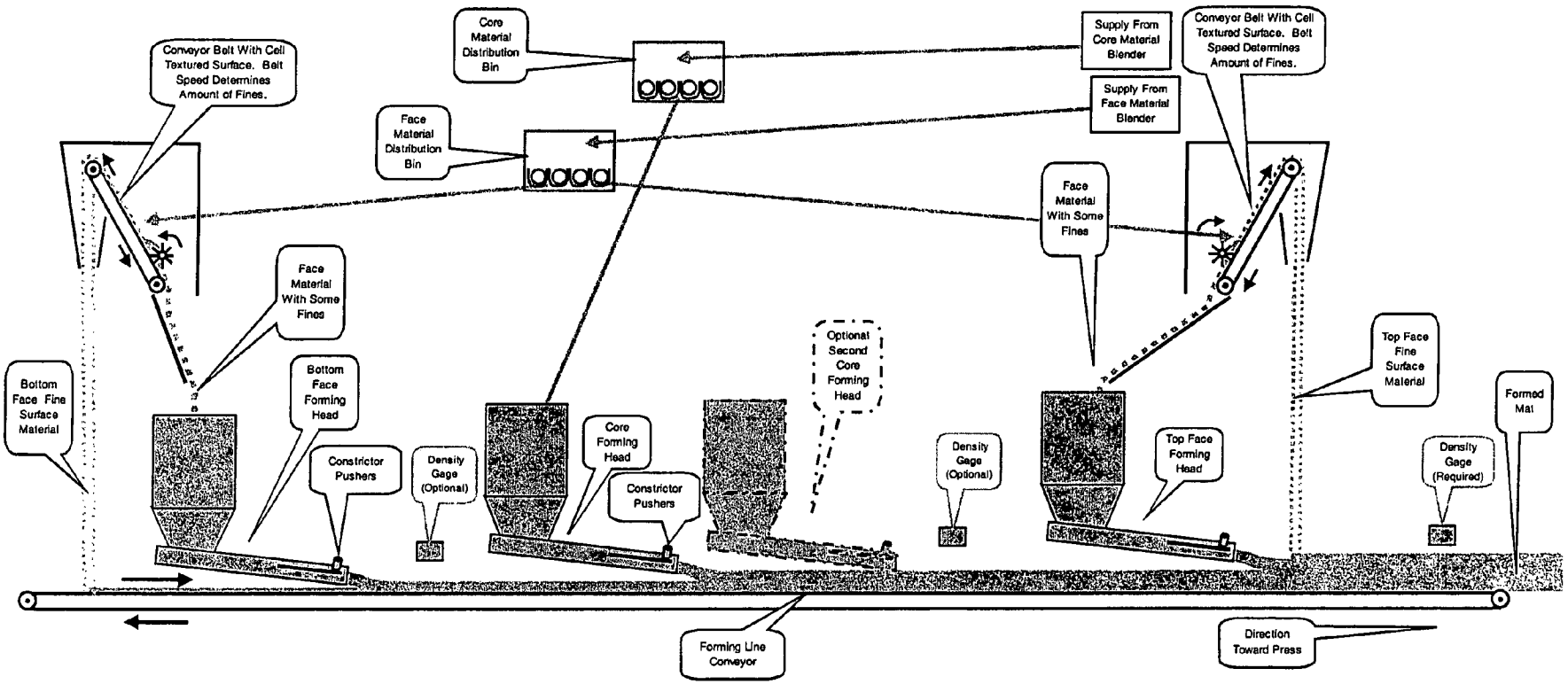
FIG. 33 shows Particleboard Forming Machine Utilizing Extruder Forming Heads PB Forming Machine Configuration 2.
Figure 34:
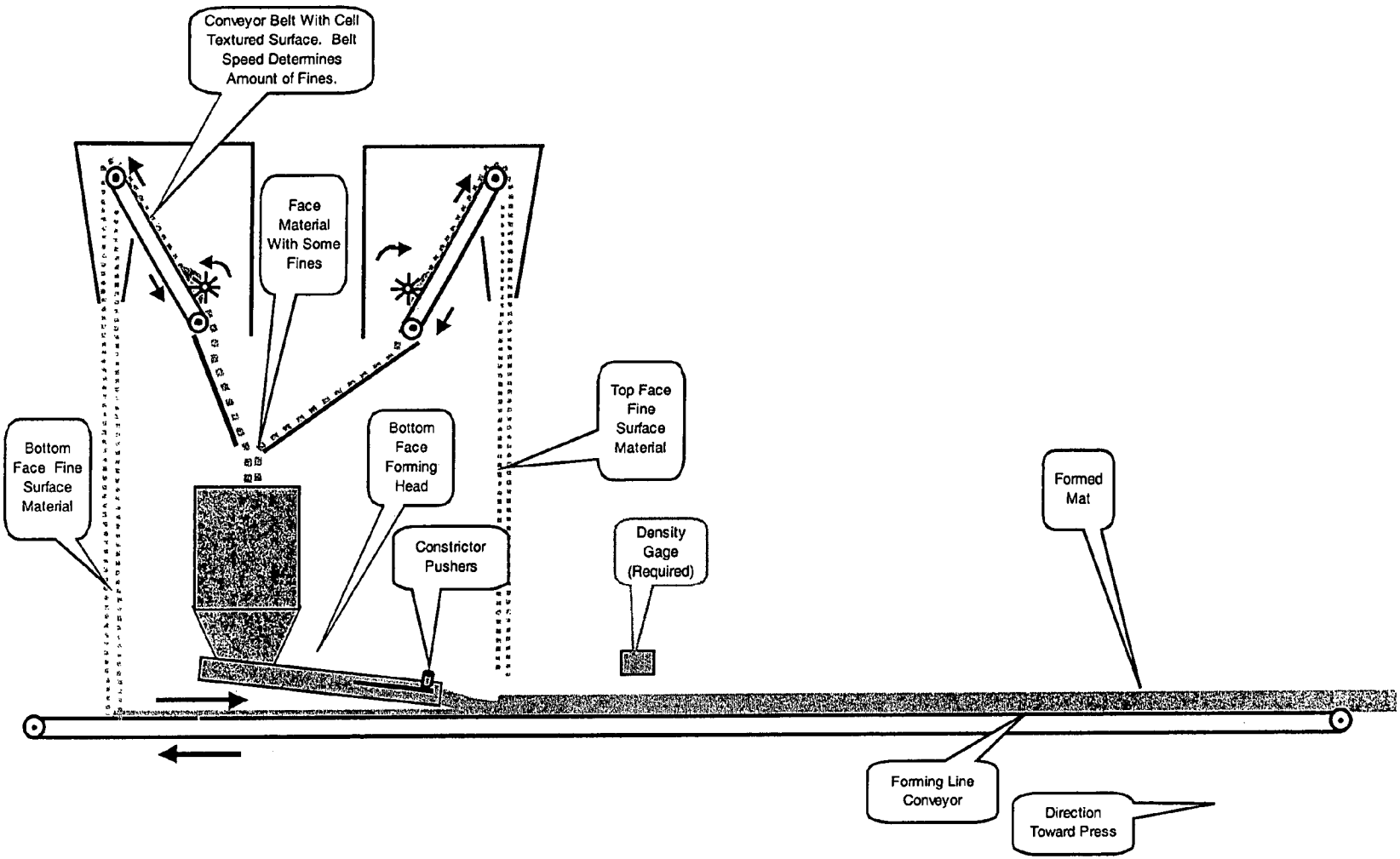
FIG. 34 shows Smaller-Capacity Particleboard Forming Machine Utilizing Extruder & Fines Skimming Concept PB Forming Machine Configuration 3.

FIG. 33 illustrates an example configuration of a complete particleboard forming machine. FIG. 34 represents a small capacity particleboard forming machine utilizing the extruder system concept.

An inherent difficulty in applying this method of forming to particleboard is in maintaining a very smooth application of the two face layers and any core layers onto the forming line over the bottom surface fines layer. It is important that this fines layer is not disturbed so that the integrity of the board surface and the related surface strength are preserved. This is not an insurmountable problem but it must be considered. It involves the speed coordination of primarily the first extrusion and the forming line belt. The top face surface layer is applied subsequent to the extrusion processes and, accordingly, will not be disturbed.

Figure 35:
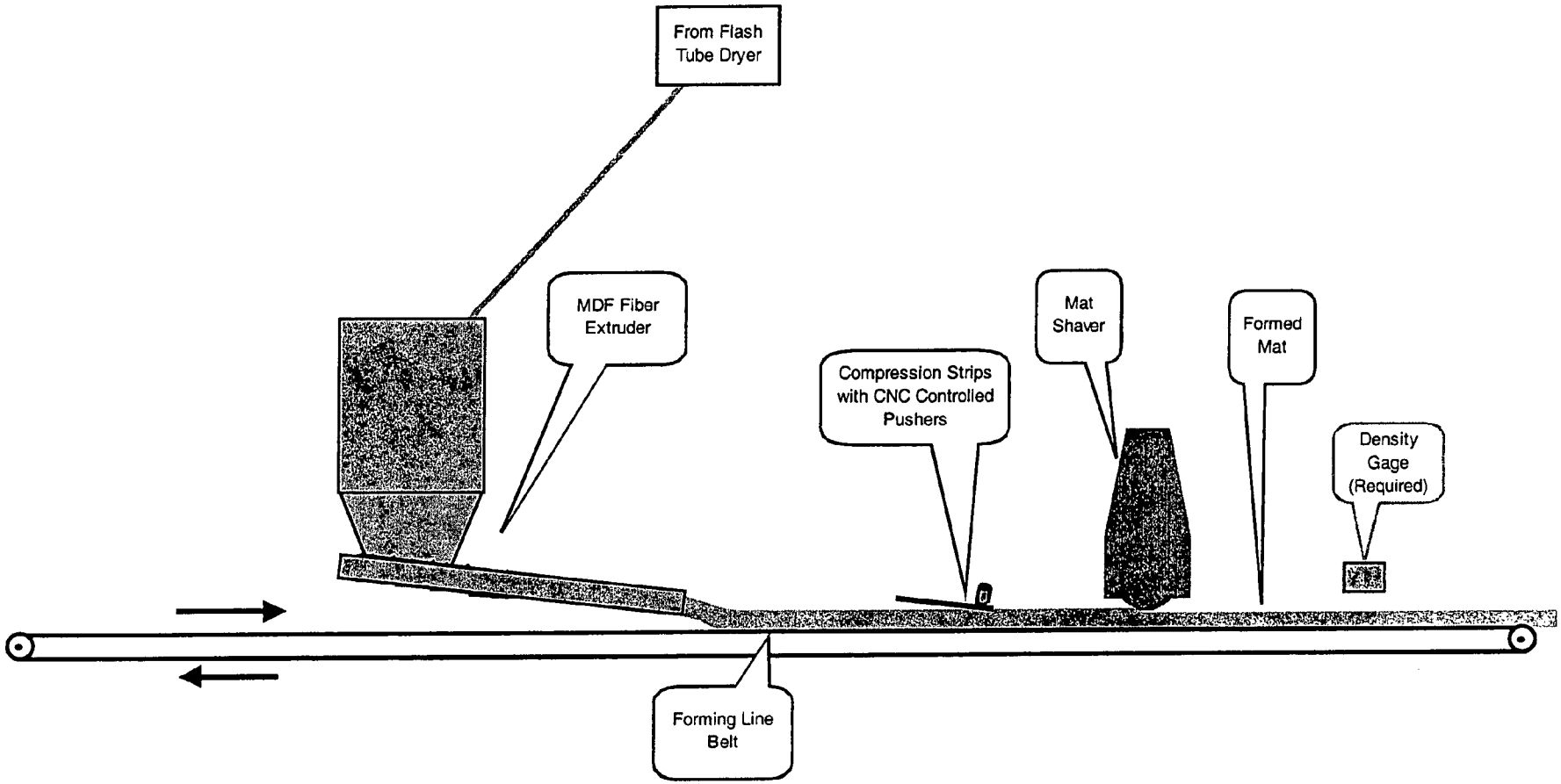
FIG. 35 shows MDF Forming Machine Utilizing Extruder Forming Head & Mat Shaver.

The MDF forming machine utilizing this method is comprised of one or more forming heads configured as FIG. 31 located directly over the forming line. Another method of accomplishing essentially the same result for MDF is illustrated in FIG. 35. The extruder is not equipped with the constrictor elements. Rather, the mat is treated after leaving the extruder. It is compressed and then shaved level by a mat shaver as similarly shown in FIG. 23.

Extruding these materials is more easily accomplished with an increase in moisture content. Therefore, the extruder systems will work best with the Christoffersen continuous press as it is expected to be much more tolerant of higher moisture content than are other presses on the market today.

There are other Christoffersen techniques that apply to this method of forming. However, they are not included here as they also apply to a variety of extruder applications.

Section VII

Cost Perspective

The issue of cost must be considered when developing any new idea. In order for an idea to be valuable it must either provide a lower cost means of manufacturing or a better one in some other way. If the capital cost of implementing the idea is too high, the cost of manufacturing the end product will be too high. Additionally, if the capital cost is excessive, many would-be buyers will be less likely to make the commitment. Consequently, the costs of the CNC controls described in this document warrant some comment.

In analyzing the cost of generally implementing CNC control, the methods appear to be extremely viable. To illustrate, one particular linear actuator that can meet the design parameters for several devices is retailed at approximately three hundred US dollars. If the number of controls on each forming head in a non-extruder OSB or particleboard forming machine is 50 across the width of 8 feet, then the cost per head is fifteen thousand dollars. If the application requires 4 forming heads, the total cost for the actuators is sixty thousand dollars. The cost of the other components will be a modest several thousand dollars per forming head.

Competitors' forming machines also require costs for components in addition to the dosing bins. Therefore, by this example, it seems very feasible to implement these ideas.

Other factors will also enter into the feasibility evaluation. Among these are the values of purchasing in large quantities and manufacturing to the design specifications. Granted, the cost of durability and engineering must be considered, but the potential for manufacturing in-house or purchasing on an OEM basis will probably reduce the cost and increase the sales margins.

In summary, the ideas are not precluded from competing due to excessive cost.

Section VIII

Forming Line Heating

The plates to be placed under the measuring belts or under the forming line belt as discussed in the above sections can be adapted to include thermal oil heating. Similarly, heat can be added to the extruders as well. The heat added to the mat as it is being formed will enhance the press cycle. Optimal temperatures are probably between 50 and 60 degrees C.

Section IX

Alternative Christoffersen Scalping Methods

Figure 36:
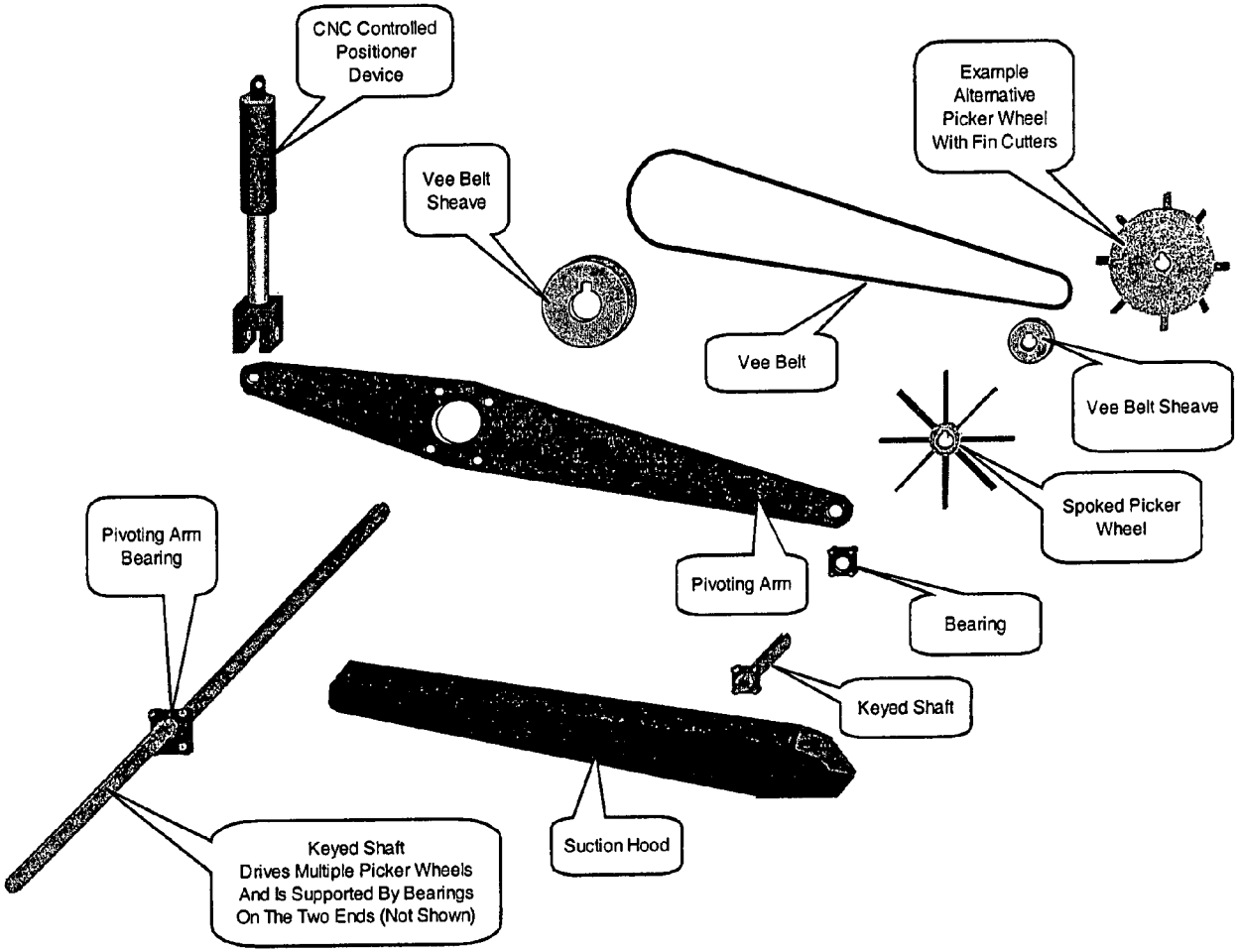
FIG. 36 shows Pivoting Arm CNC Scalping Device Components.

FIG. 36 illustrates the components and configuration of one of several alternative scalping or shaving devices that may be utilized in place of those previously discussed.

Figure 37:
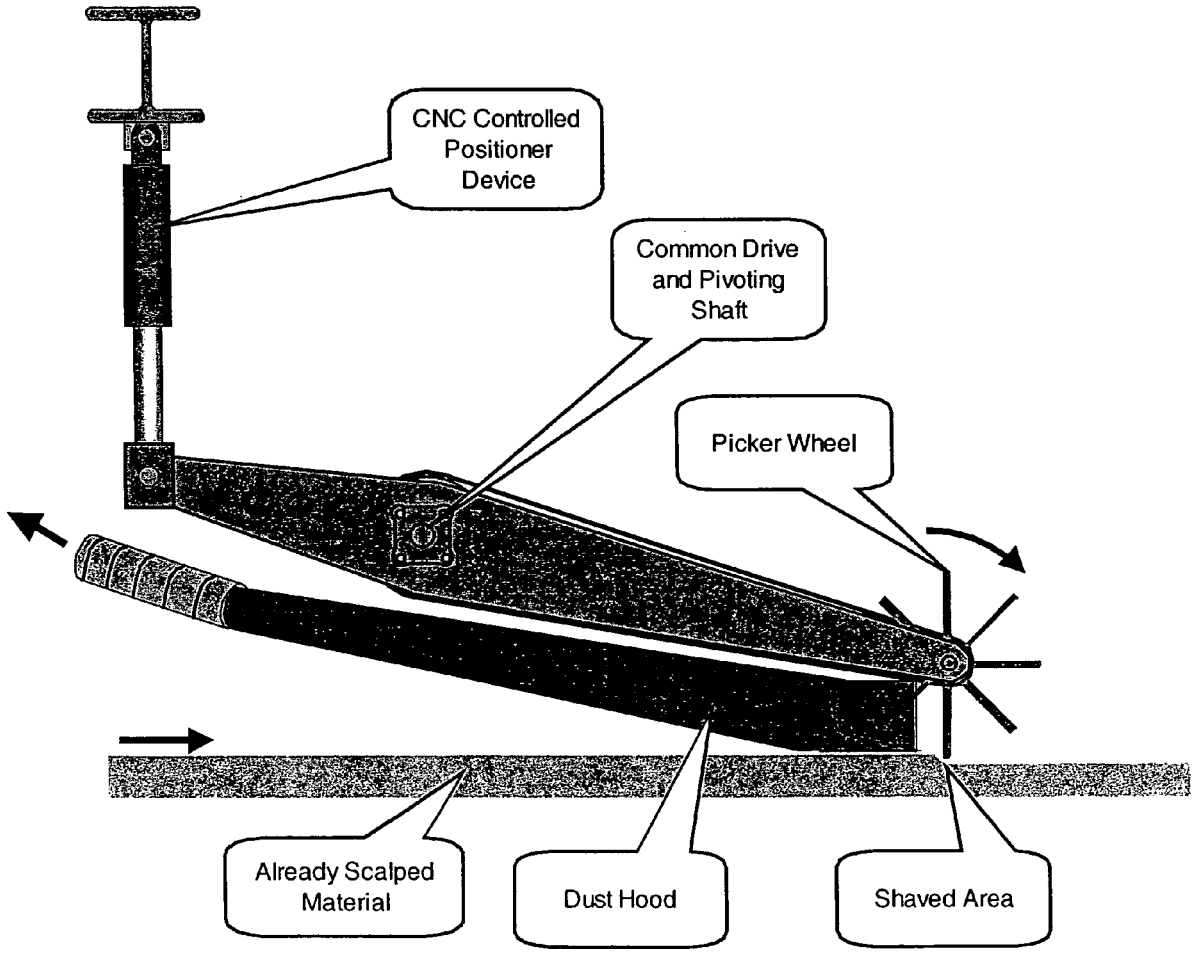
FIG. 37 shows Pivoting Arm Scalping CNC Device Side View.
Figure 38:
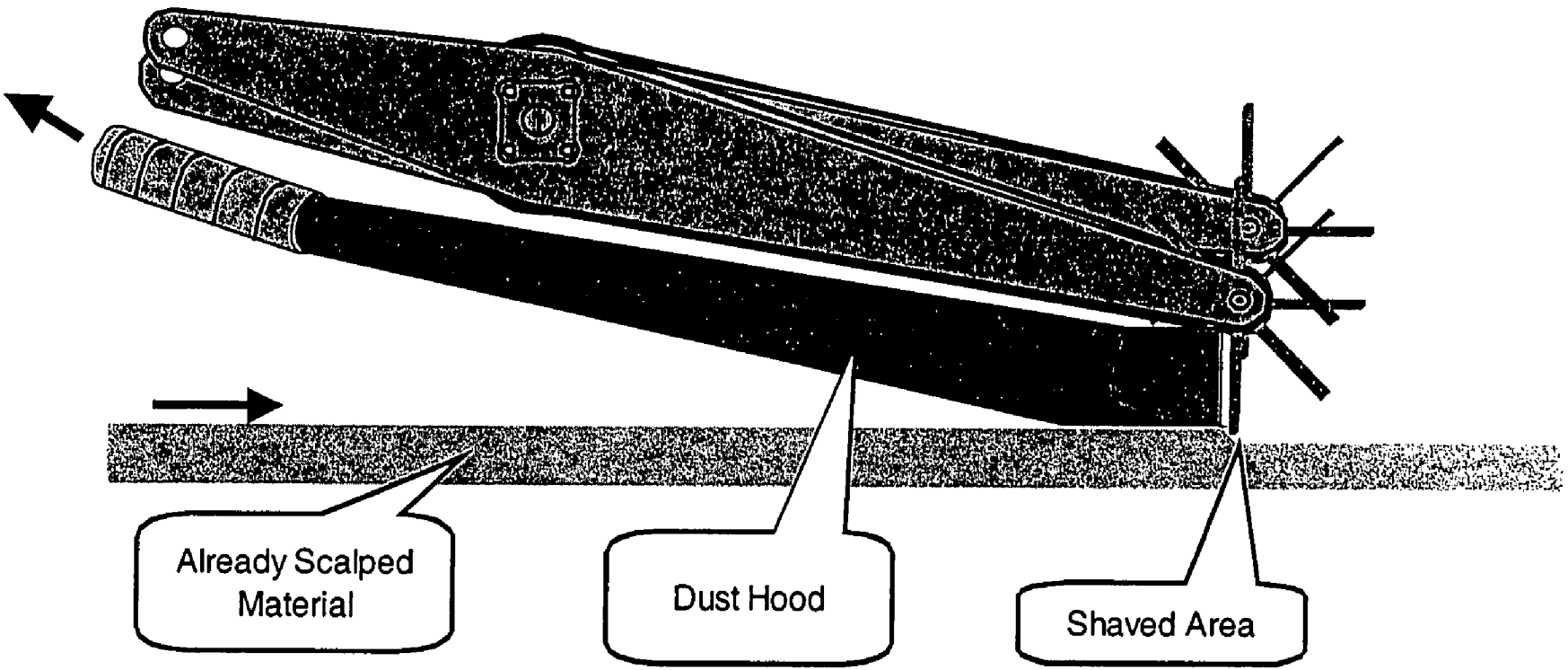
FIG. 38 shows Pivoting Arm CNC Scalper Multiple Assembly Side View.

The main drive shaft serves two functions. First, it becomes the pivot for multiple arm assemblies. Secondly, it drives the picker wheels for each arm assembly. FIGS. 37 and 38 illustrate side views of the assembled pivot arms.

The main drive shaft can be automatically adjustable in height. Material is taken away by a suction hood that is situated immediately above the material to be swept. Should the material level be changed because the scalper height is changed, the automatic height adjustment of the shaft maintains the hood height above the material.

The width of the assembly should be narrow for best control of the mat density profile. For example, if the arm sweep width is 1-inch (25 mm) wide, there will be 100 arm assemblies across the width of the mat. This is a substantial number of assemblies, particularly if this function is applied to multiple heads on the forming machine. Conversely, if the arm assemblies sweep a path of 4 inches, 6 inches, or even 12 inches each, the control will probably still be sufficient and the cost lower.

Figure 39:
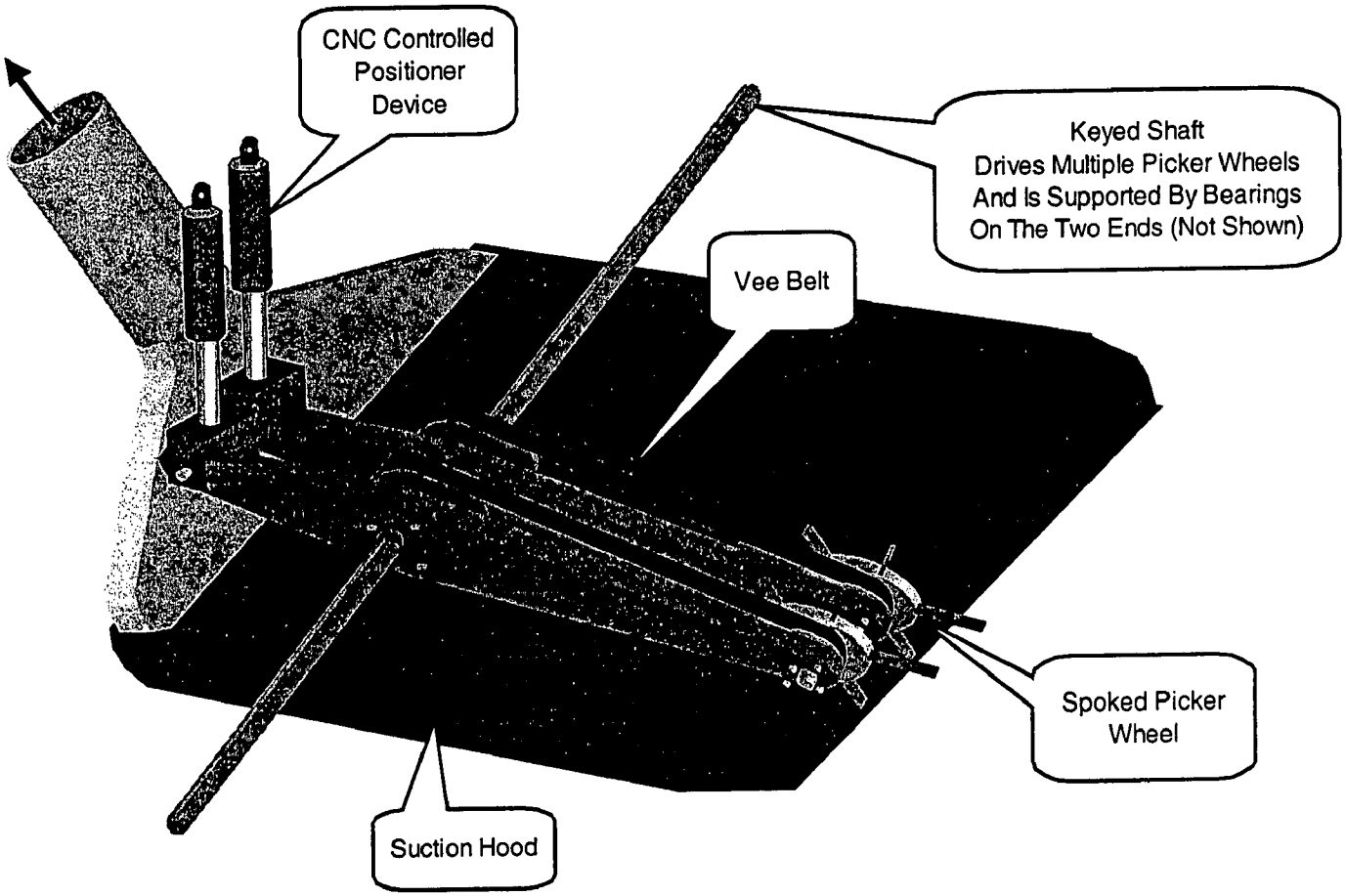
FIG. 39 shows Pivoting Arm CNC Scalper Assembly With Large Dust Hood Overhead View.

The dust hood shown in the above figure is for a single arm assembly. However, a single larger hood can be utilized to carry away the material from multiple arm assemblies. FIG. 39 illustrates the configuration.

The difficulty in getting the arm assemblies close enough together becomes noticeable when studying this figure. Although improvements to the design shown can be made, there will be some space between the arm assemblies that the picker wheels cannot sweep. There are several solutions to the problem.

One way is to turn all of the assemblies a few degrees away from the longitudinal direction. The material that would otherwise be left between the arms will be all or partially swept, depending upon how much of a gap between the picker wheels is left in the design.

Figure 40:
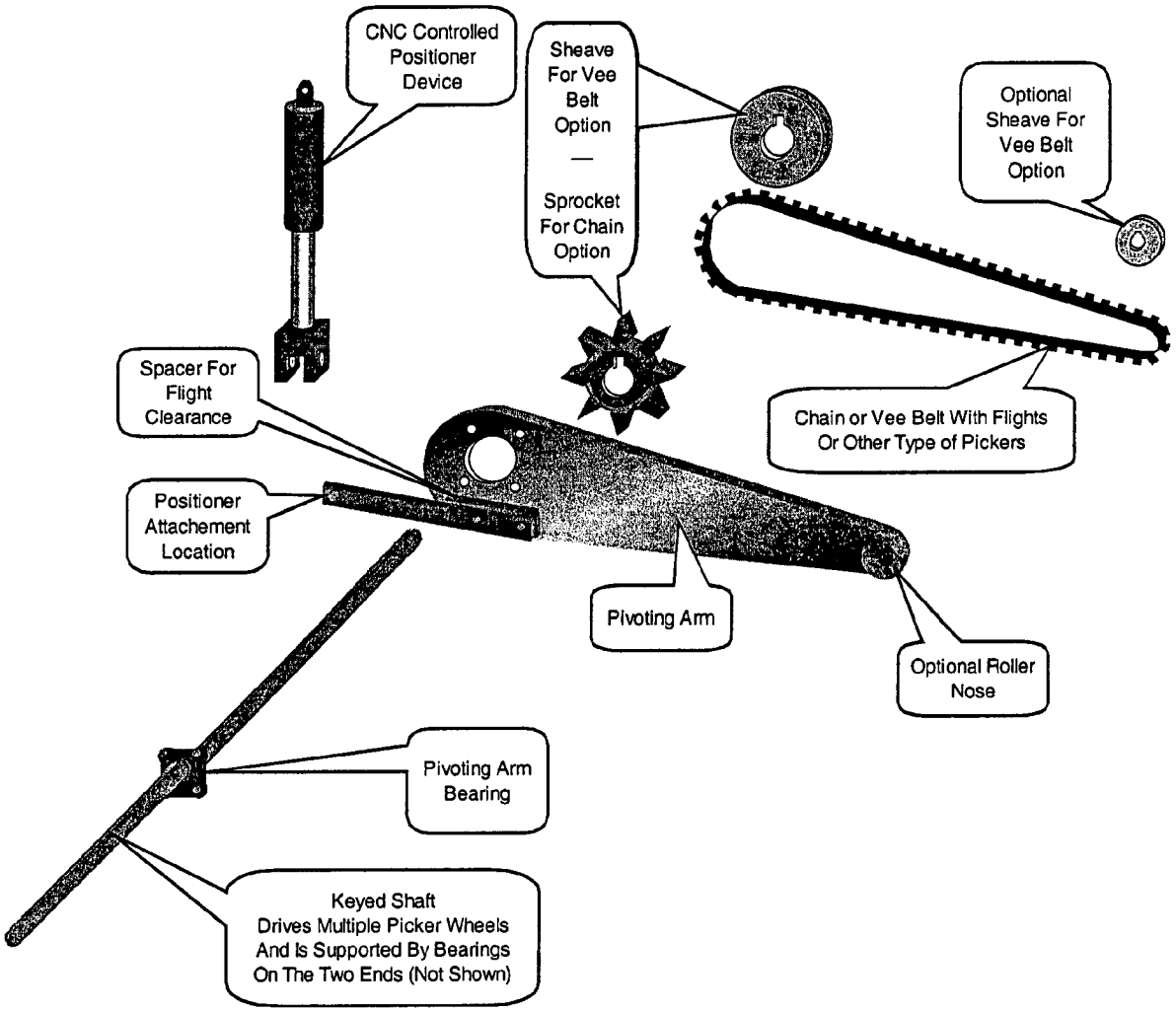
FIG. 40 shows Pivoting Arm CNC Scalper Chain or Belt Picker Configuration Components.

Another way is to build an arm assembly that is configured something like the bar assembly on a ditcher or on a chainsaw. The pivot arm is constructed so that a chain or even a v-belt can track on the outside like the chain on the chainsaw bar. The chain or v-belt is to be configured with flights or pickers attached. Additionally, as with the chainsaw, the end of the bar can be equipped with an optional roller nose. The flighting on the chain/belt can be the widest component on the assembled pivot arm. This allows all of the pickers to be very close together yielding only enough gap to eliminate collisions between assemblies. FIG. 40 illustrates an example assembly configuration. Consideration must be given to lubrication that might be required with various designs.

A third way to deal with the problem is to utilize more than one main drive shaft. For example, if two shafts are utilized one could be fixed above the other and located so that both sets of pivot arm assembly sweep at the same longitudinal location. Every other picker will belong to the first set and the remaining pickers will belong to the second set.

In order to keep the arm assemblies of the first set from colliding with the arm assemblies of the second set, the two sets must have different diameter wheels or noses at the picking end. Alternatively, the two sets can be located apart so that they are unrelated and cannot collide. The best design for that configuration will include slightly wider picker widths on the downstream set. This will assure that all of the excess material will be swept.

Figure 41:
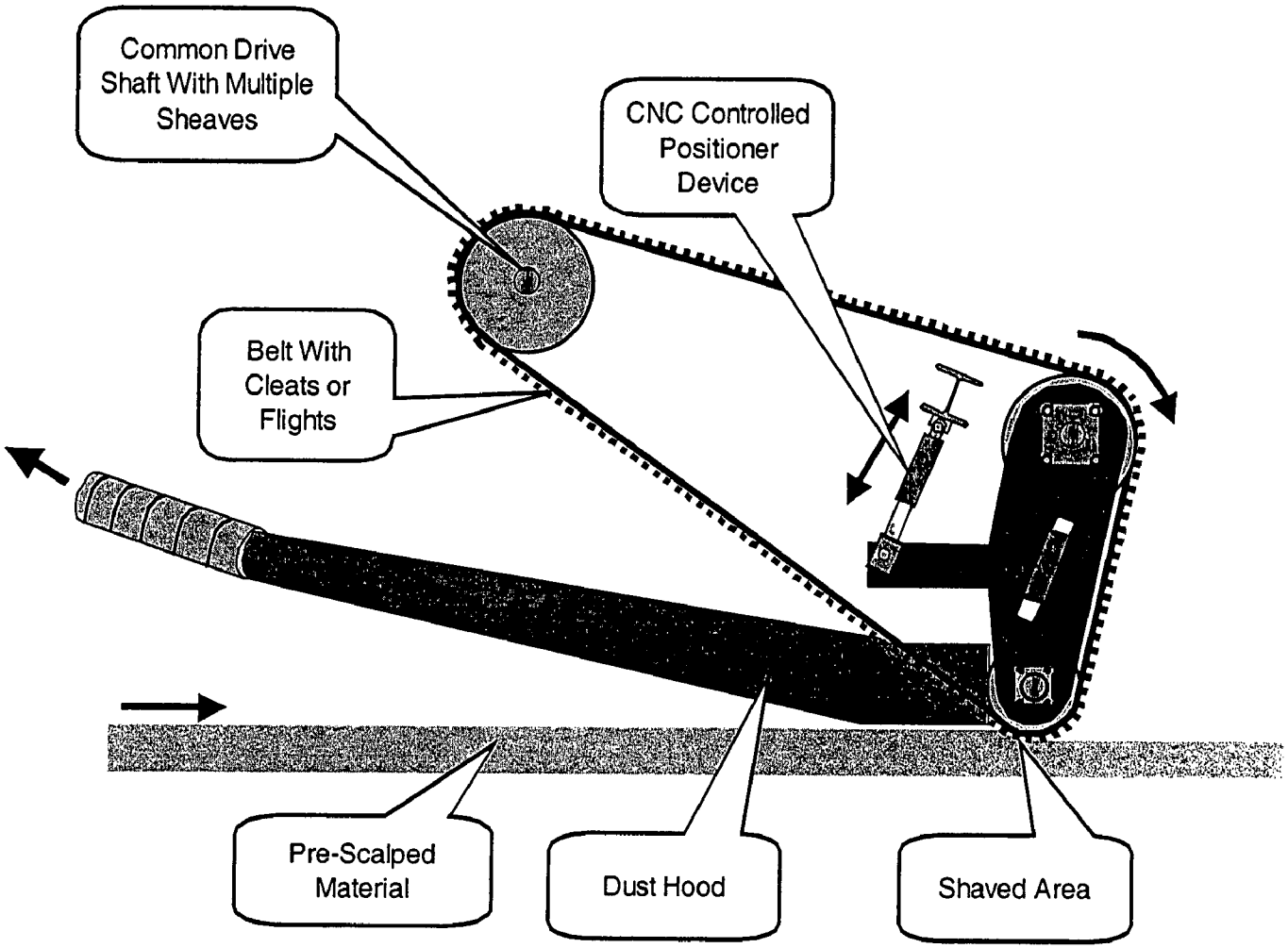
FIG. 41 shows Pivoting Arm CNC Scalper Chain or Belt Picker Configuration Side View.

A variation of the picker is illustrated FIG. 41. Rough surface belts or belts with cleats are to be powered by a common shaft. The controlled end is able to move up and down on an assembly controlled by CNC. This variation is a fourth way to deal with the gap between the pickers.

Figure 42:
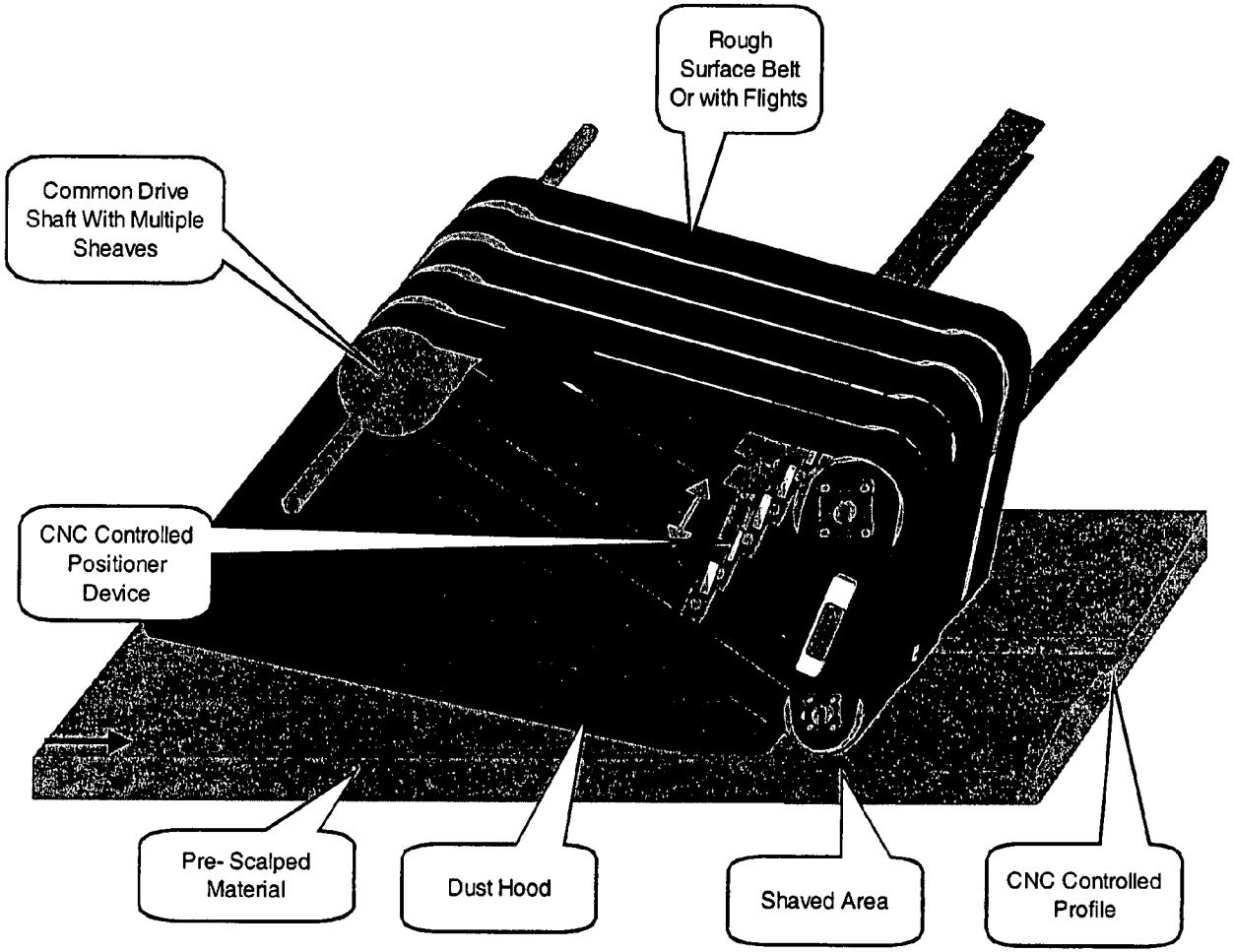
FIG. 42 shows Pivoting Arm CNC Scalper Chain or Belt Picker Configuration Overhead View of Multiple Assemblies Mounted Onto Main Shaft.

FIG. 42 illustrates several belts arranged across the material width.

Figure 43:
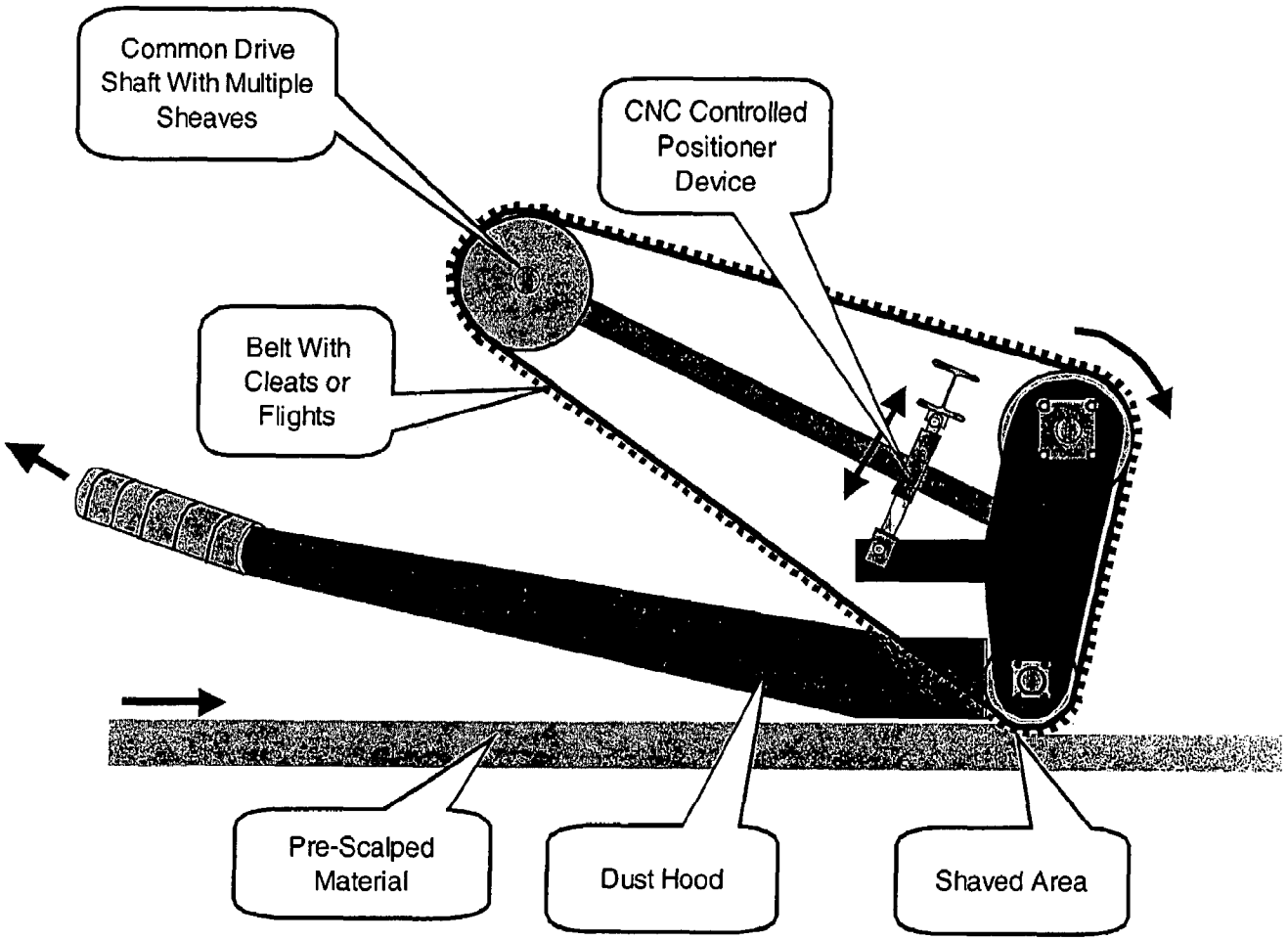
FIG. 43 shows Pivoting Arm CNC Scalper Chain or Belt Configuration Side View Illustrating Means of Eliminating Slider.

FIG. 43 illustrates a variation to the previous arrangement. Rather than attaching the shaving head to a slider, this pivots the device from the drive shaft. Two CNC activated positioner devices can be used on each shaving head. This allows the belt to be tilted for better control. The optimal value of tilting will be achieved by a wider belt arrangement.

The fifth way to solve the problem of the gap between the pickers also deals with the issue of the number of arm assembly units. Rolls are situated above the material in the forming head in a staggered arrangement so that two sets are capable of sweeping the entire width of the material. The rolls can be covered with a rough surface material or can be affixed with pickers of some sort.

Figure 44:
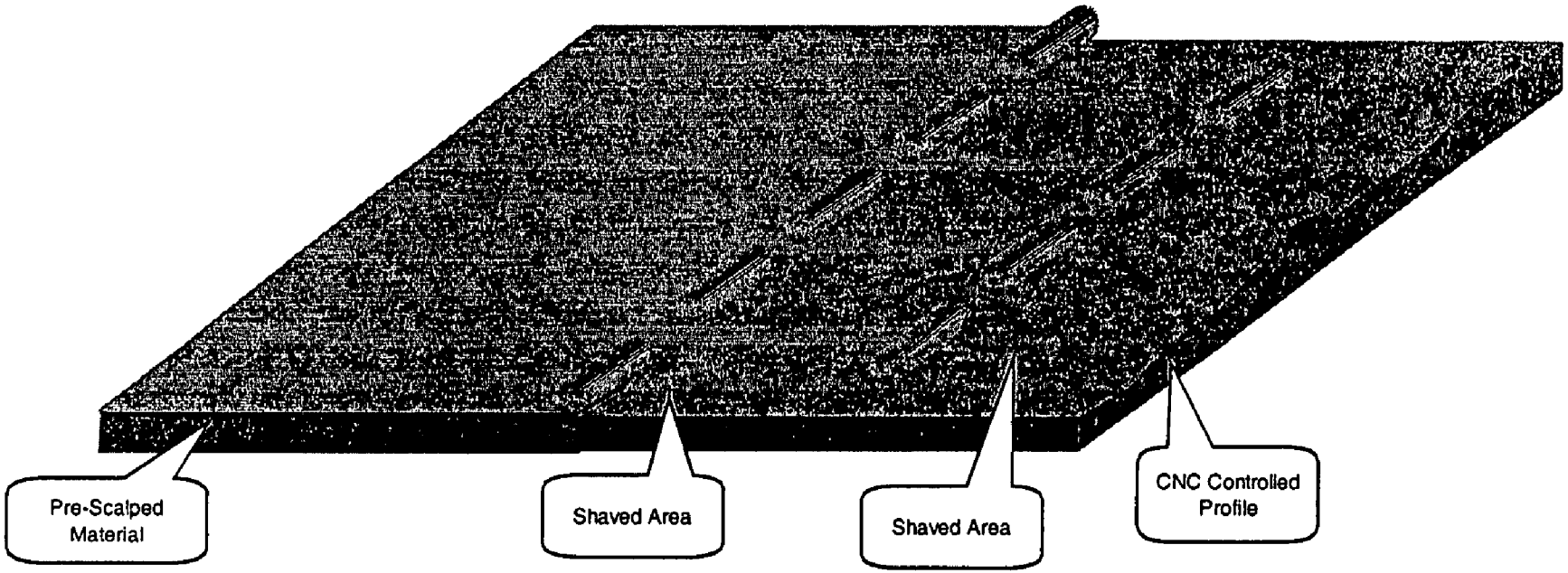
FIG. 44 shows Banana Roll or Bow Roll Position Layout.

Flexible rolls similar to those known as "bow" or "banana" rolls utilized in the laminating industry may be substituted so that another dimension of control can be implemented. These rolls can be set up to be CNC controlled to rotate almost 360 degrees and to bow up or down as required for optimal density profile correction. FIG. 44 illustrates an example layout of the roll positions. No dust hoods are shown.

Figure 45:
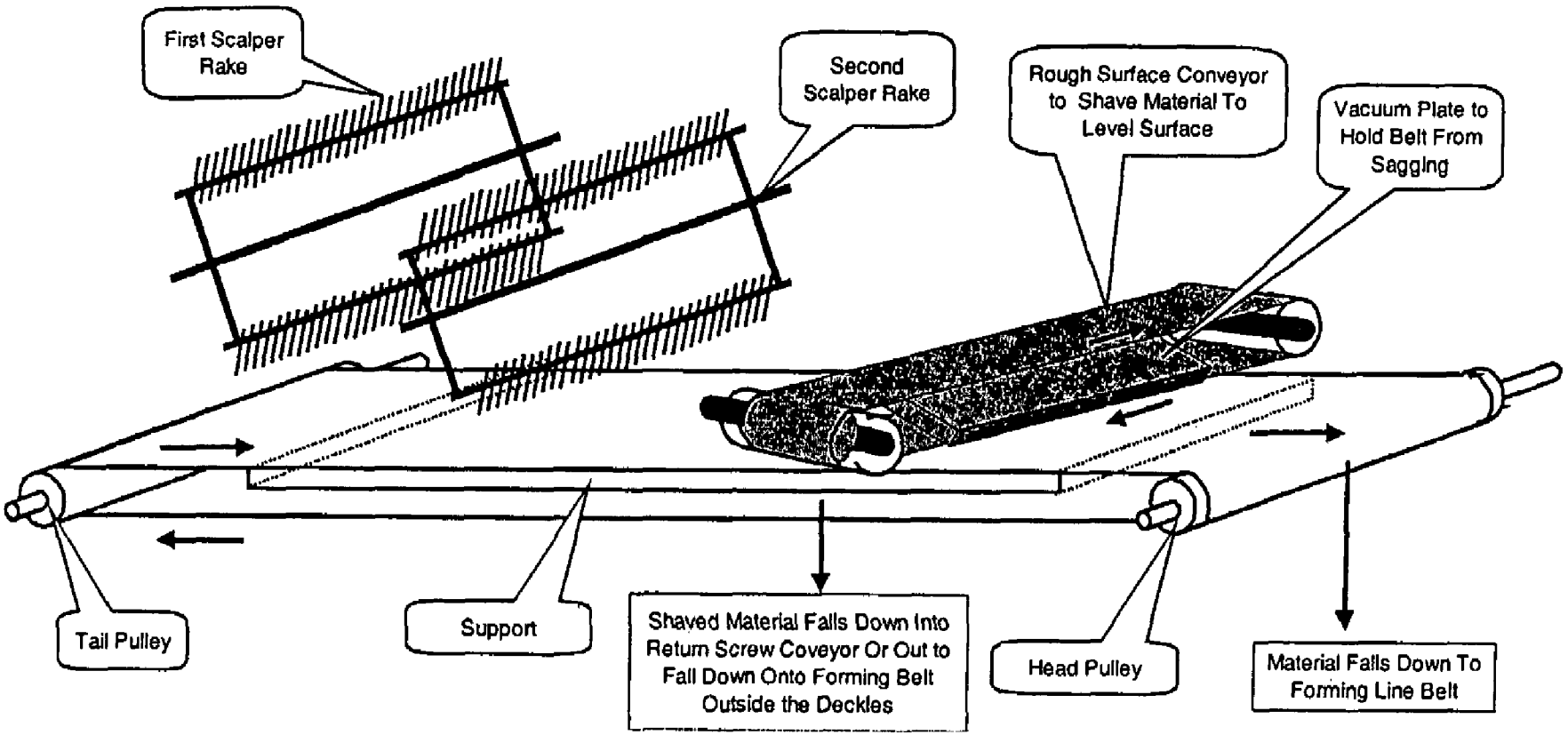
FIG. 45 shows Scalping Belt Configuration.

Particleboard forming machine Configurations 4 and 5 found in the following Section X require precise control of the material layer being spread onto the measuring belts for the surface layers. This is especially important in utilizing the cell-textured belt surface. FIG. 45 illustrates an alternative method to accomplish this.

The rough surface belt shown sweeps the excess material sideways to be returned to face material bin. A similar device may be utilized elsewhere in the forming machine as well to level the material on the measuring belt in other forming heads. The angle shown may be flat or tilted obliquely several degrees depending upon the amount and size of material being shaved or scalped off. Furthermore, the design could include an angle adjustment for the owner.

A similar configuration can be combined with pushers placed into the vacuum plate to provide CNC scalping control or with lifters under the measuring belt.

Alternatively, it could be aligned with the measuring belt to replace the scalping rakes shown. The angle would be flat across the width but would be sloped downward toward the exit end of the forming head. It would then send all of the excess material to the back of the bin as do the scalping rakes. This arrangement would be best suited for the surface fines forming head.

Figure 46:
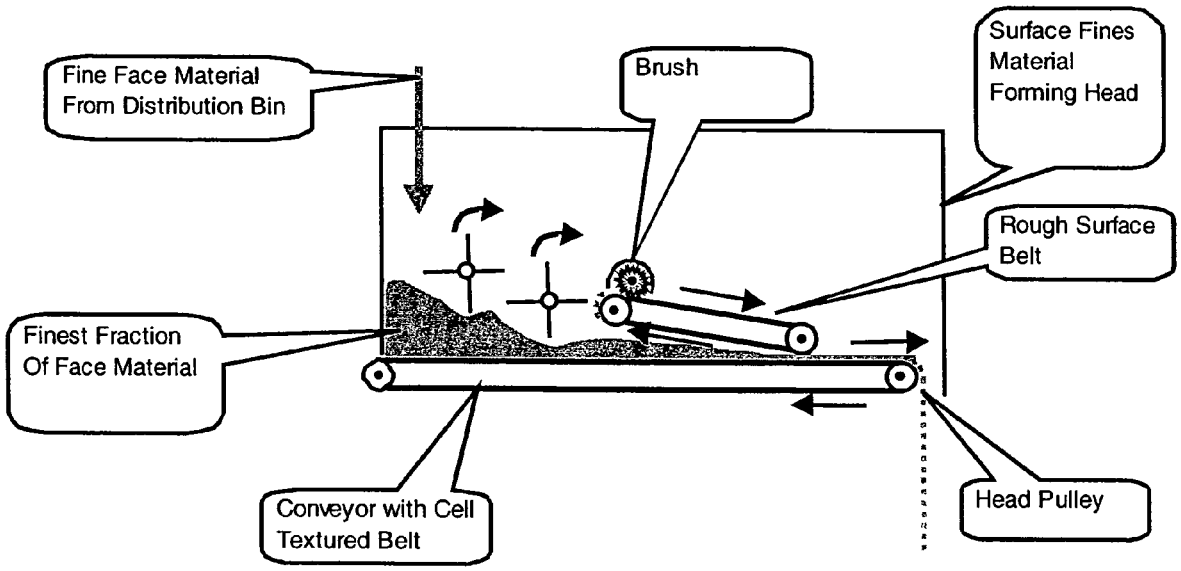
FIG. 46 shows Longitudinal Scalping Belt Method.

FIG. 46 illustrates this concept.

Section X

Alternative Christoffersen Forming Machine Configurations

Air Separating

As previously stated in Section II, FIGS. 47 and 48 illustrate how machines with air separation and screening separation features may be configured. It should be noted that these configurations require substantially more hardware and are much more complex to operate.

These two figures also functionally illustrate a method of air separation that is combined with the Christoffersen density control methods. A disadvantage of air separation is that the larger material particles are pushed forward by the wind along with the fine dust particles. When as these larger particles fall onto the forming line, they are sporadically deposited transversely and longitudinally off-the-mark. Therefore, the density of the panel will vary too much in both directions. A solution to that problem is illustrated in these two figures. All of the material except the fine dust is captured and sent to another face forming head. So, an additional head is required with this method. FIG. 48 shows only half of a 6-head forming machine incorporating this configuration.

FIG. 49 illustrates another and probably a better method of air separating. It is actually a hybrid of air separation and skimming separation combined with the lifter method of controlling density. This allows the material to be deposited directly onto the forming line while a portion of the finest particles is skimmed off and then further separated by air. An air plenum and nozzle provide a high velocity but low air volume stream to separate the particles and push them longitudinally outward to fall onto the forming line. Ever-finer sized particles are carried ever-farther the same as with other air separation methods.

It is important to assure that the nozzle air volume and velocity illustrated in the above figure is uniform across the width of the mat so that the material is ejected evenly. Particles evenly fall off the cell-textured skimming belt toward the air stream and are pulled into the stream due to the greater velocity of the air. The velocity of the particles leaving the cell-textured belt in the mat longitudinal direction is negligible.

It is also possible to utilize the air nozzle concept with a screening type of separation in place of the skimming method shown. However, that concept seems less efficient than the method shown in FIG. 49.

Screening

FIG. 50, which is also identified as "Configuration 4" makes use of screening operations directly in place for each face. Material is taken from the face material blender and screened for "fines." The remainder goes back into the coarser face material stream. A metering bin is shown feeding face material onto the screen. That process might be simplified by utilizing only a screen without some elaborate feeding system. Nevertheless, the forming machine will still need two more forming heads than shown in Configuration 1. Otherwise, some control of cross-panel density profile is lost.

FIG. 51 which is also identified as "Configuration 5" makes use of screening operations elsewhere on the plant floor. One particular weakness in this sort of arrangement is the time element involved between blending and forming. The surface fines will be held up in the screening, the distribution bin, and then again in the surface fines forming head. Conveying this material also becomes more complicated due to distances traveled.

Fluidizing

FIG. 52 (Configuration 6) illustrates a particleboard forming machine similar to FIG. 22 (Configuration 1) except that it incorporates the use of fluidizing tines in place of vibrating the entire forming head in each position.

It should be noted here that there are several arrangements of direction for the various forming heads. The designer's choice of direction of travel will usually be dependent upon the delivery point of the material being the shortest distance from the distribution bin. This is most important for the core forming heads whereas the face heads are not so important. Therefore, the two core forming heads will normally remain facing outward to maintain a direct drop of material into these heads while the other heads may be faced in either direction.

Depositing Belt

Figure 53:
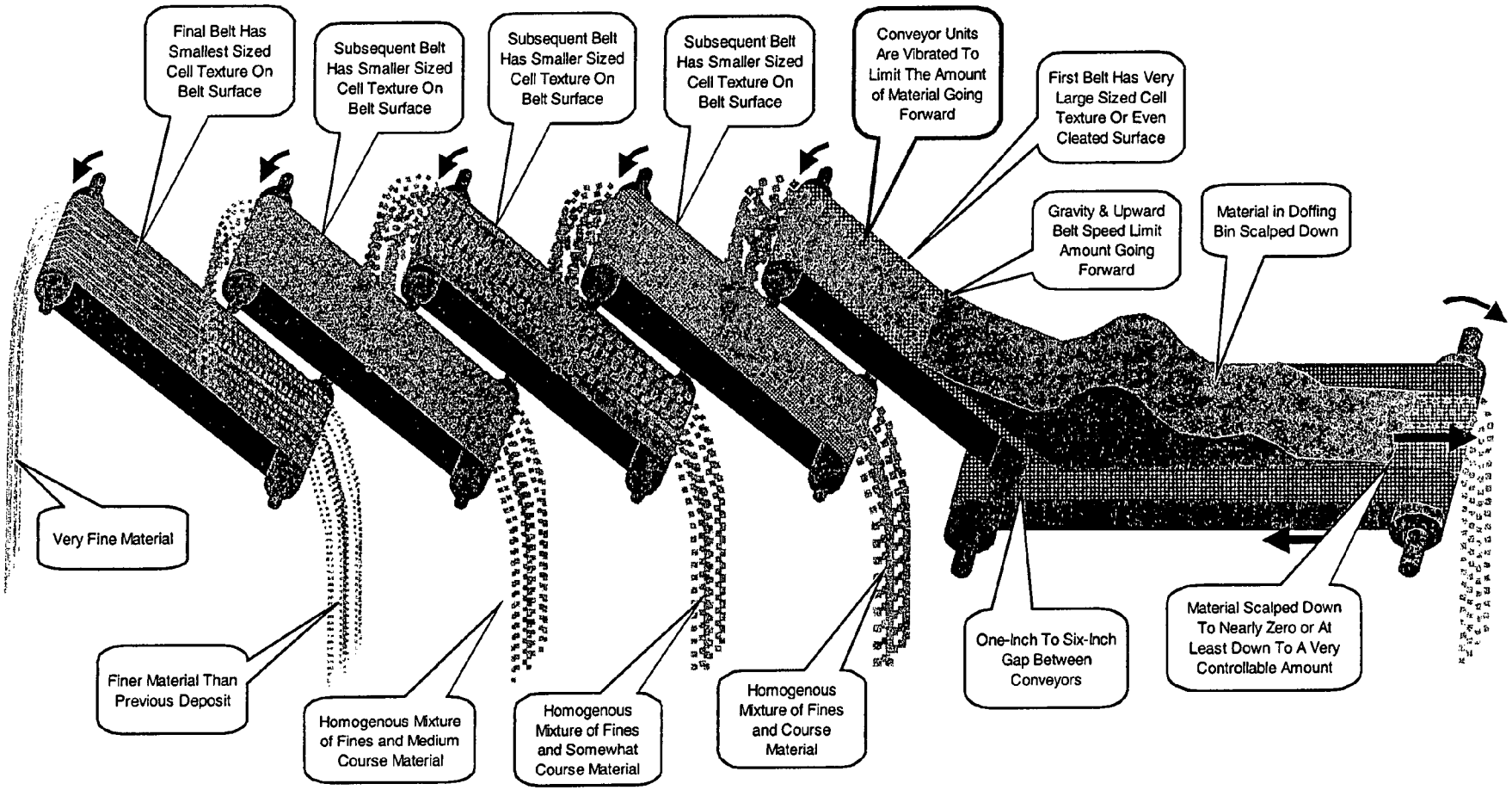
FIG. 53 shows Particleboard "Depositing Belt" Forming Head.
Figure 54:
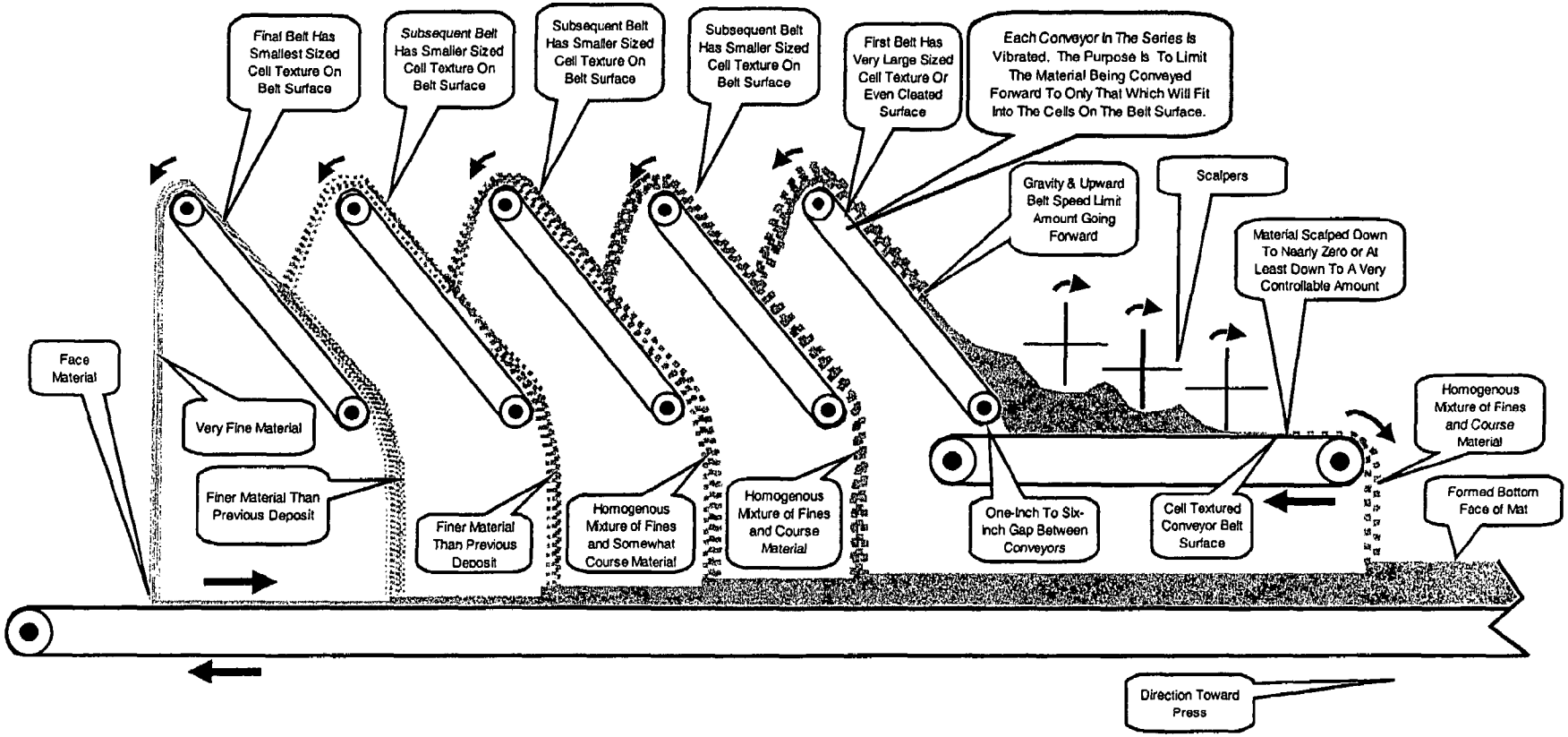
FIG. 54 shows "Belt Depositing" Bottom Face Forming Head Particleboard Forming Machine Configuration 7.

Another method of forming was briefly described in Section II above and is presented here in more detail. FIGS. 53 and 54 illustrate the Christoffersen "depositing belt" forming concept.

The method is comprised of a series of fine material skimming belts similar to those previously described. A doffing/dosing bin or similar device feeds material onto the first belt in the series. Some material will be conveyed forward by each of these conveyor units while some falls directly down onto the forming line below.

The material being fed forward is material that will fit into the cells on the surface of the conveyor belt. This is assured by vibrating the conveyors so that the effects of particle interweaving and friction are voided.

Material that is not being fed forward will fall uniformly downward due to the fact that it was fed onto this belt unit in a uniform volume across the forming width.

Thus, we have ever-finer material being fed forward while some is concurrently deposited onto the forming line below until the final belt unit makes its deposit of very finely powdered material. With every deposit except the last one there is a mixture of fine material and course material. Additionally, with every step there is a reduction in the size of the courser material in that deposit. The density deposited onto the forming line below is very uniform across the width at each step. Finally, we have a very fine surface for the panel product.

FIG. 54 illustrates the bottom face material being formed while FIG. 53 illustrates either the top or bottom face. Core material can be deposited with similar forming heads or by the integration of the core with the two face heads. In such an integration-type of forming machine, the courser material shown being formed in these two figures will comprise the core. Regardless, it seems more efficient to utilize a core forming head with density control features previously described such as the "lifter" method.

There are 5 upward conveyor units shown in each of the two figures. However, the optimal number is determined by the volume of material required at each head and the amount of fine material that is required for the mat surface. The conveyor belt speed has a similar effect. Therefore, speed and the number of conveyors required will depend upon the customer's need.

Figure 55:
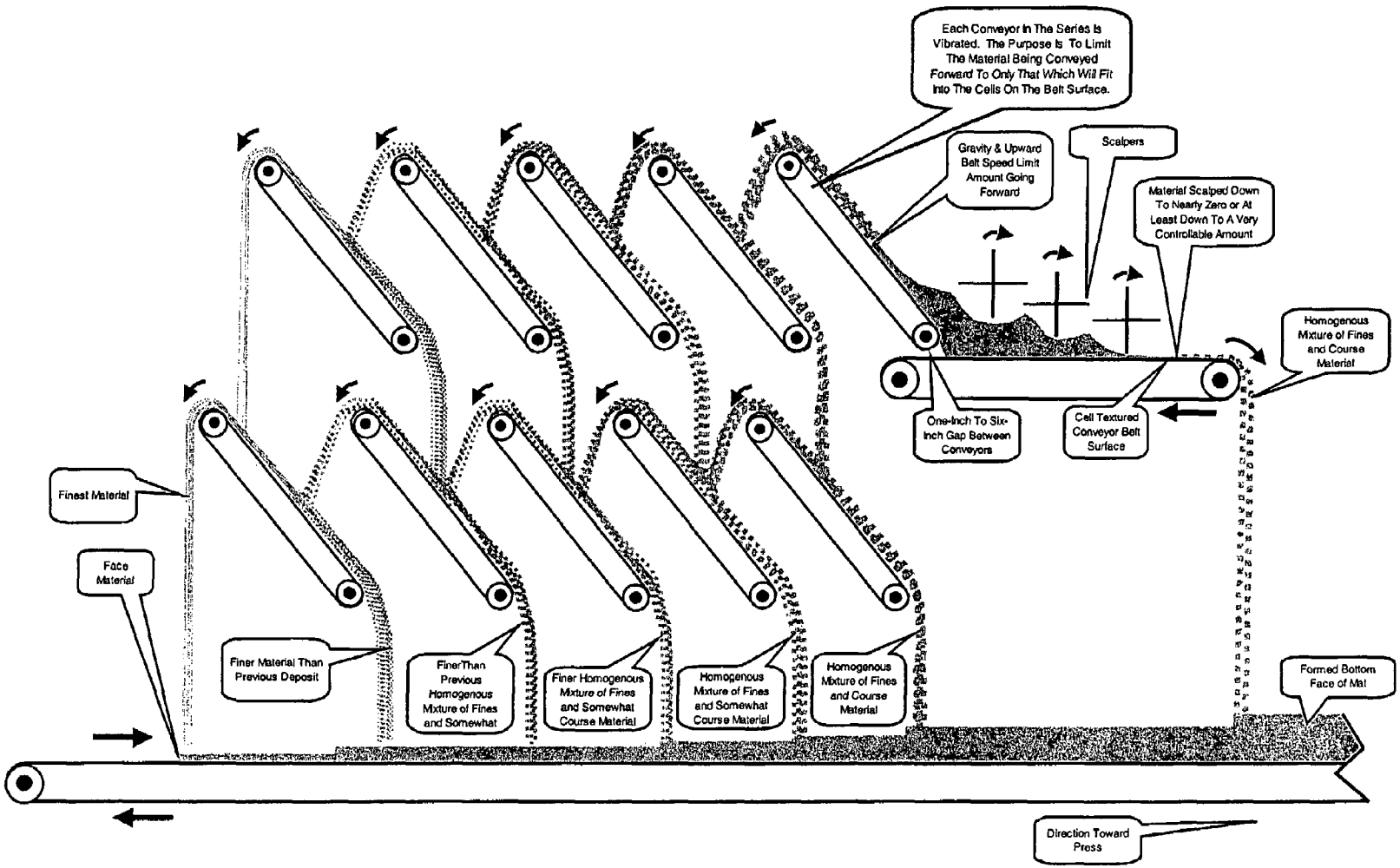
FIG. 55 shows Multi-Level Depositing Belt Particleboard Forming Machine Face Head Configuration.

It is possible to deposit layers of homogeneous mixtures with ever-decreasing sizes of mixtures with this method. However, another enhancement of control can be added. This is accomplished by installing additional levels of belt systems as shown in FIG. 55. The upper level carries larger material forward than the lower level does. Therefore, if the desired effect calls for more material of larger sizes to be placed into the layers closer to the surface, this system can be implemented.

Forming Machine Summary

This application has described a variety of methods of performing tasks required in forming particleboard, MDF, OSB, and related products on a board production line. The methods can be combined as components of a forming system in a multitude of ways to arrive at the optimum design for each individual customer.

As with any new method, these ideas have some associated potential problems. Most of the apparent and important problems have been identified in this document and solutions are discussed.

Section XI

Material Drying Machine Ideas

Dryer Introduction

The following presentation is made with the primary focus toward drying wood materials for the composite panel manufacturing industry. Nevertheless, similar materials may also be dried in machines with minor modifications. For example, tobacco leaves or aggregate may be dried in a machine incorporating the ideas discussed here. Therefore, the reader should keep in mind that materials, in general, can be processed in this machinery regardless of the end use of the product being dried.

Among the advantages of such machinery are:

(a) Direct contact of the material to a heated surface while conveying at the same time, (b) Temperature control in zones to promote drying efficiency, (c) Humidity control in zones to restrict case-hardening, (d) Lower capital investment; and, (e) Reduce energy consumption and operating costs.

In addition to drying, with slight design modifications this machinery can be utilized for preheating materials for processing. Startups are otherwise extended after production line breakdowns due to the reduced material temperature.

Another concept that is introduced here is that of re-activating resin "tack." By taking advantage of a little-known phenomenon, this machinery can be utilized to re-heat rejected particleboard or medium density fiberboard (MDF) materials that have lost tack. Thus, resin consumption is reduced.

The presentation assumes that not all those involved in the decision about purchasing the technology are thoroughly versed in the problems inherent in the board manufacturing process. Therefore, these detailed discussions will be review for some engineers and sales personnel who are familiar with such problems.

The Process

Currently, wood material for particleboard and oriented strand board (OSB) and similar composite panel products is dried in a rotary drum drier, otherwise known as a rotary kiln. This has been the practice in the United States and elsewhere since the 1950's. However, some composite panel materials such as wood fiber for MDF is currently dried in flash tube dryers. A significant difference is that the MDF fiber is usually blended with resin binder before drying; whereas, the materials for particleboard and OSB are normally dried prior to resin blending.

The dryer concepts described in this presentation are intended to replace rotary drum dryers where the material has not been treated with resin binder. Regardless, flash tube dryers can also be replaced if the machine is adapted to accommodate the fluffy fiber material.

It turns out that rotary dryers achieve the greatest portion of drying by making contact with the wood strand or particle. Although it may seem otherwise, the actual primary function of the air forced through the drum is to convey the material and to evacuate the moisture-laden air out to the atmosphere. The forced air could have a greater drying effect if it were to be impinged upon the product, but rotary dryers are not normally designed with this feature.

Therefore, incorporated into the dryer design presented in this paper (the "Christoffersen Dryer") is the concept of conveying the material over a heated surface. A fluidized bed or vibrating conveyor having a heated surface is the first characteristic in the Christoffersen Dryer.

General Assembly Configuration

Figure 56:
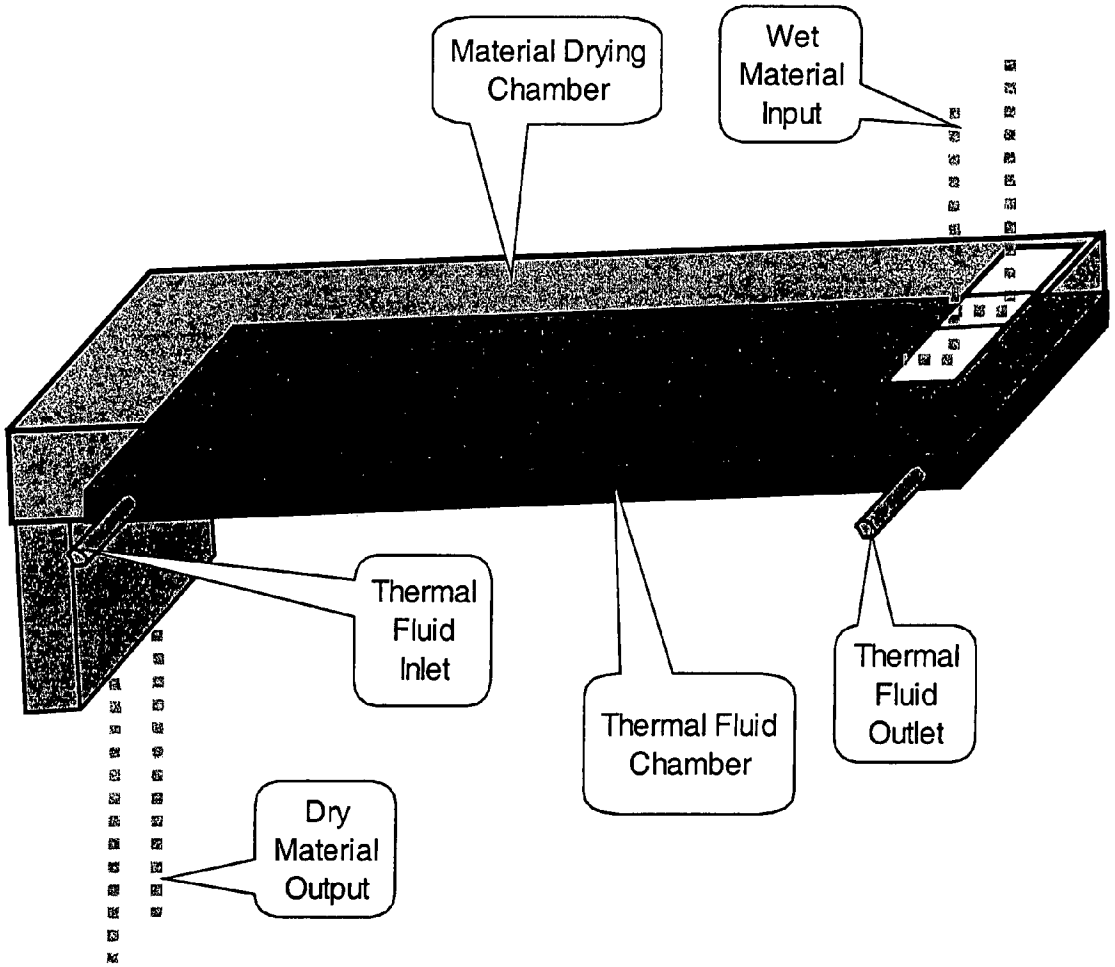
FIG. 56 shows Chamber General Configuration.

The dryer is built upon a type of fluidized bed design. The bottom surface upon which the material is to be conveyed is heated. This heats the material as it travels through the system. The entire unit should be enclosed so that the environment can be controlled for reasons that will be discussed later. FIG. 56 shows the general configuration.

Figure 57:
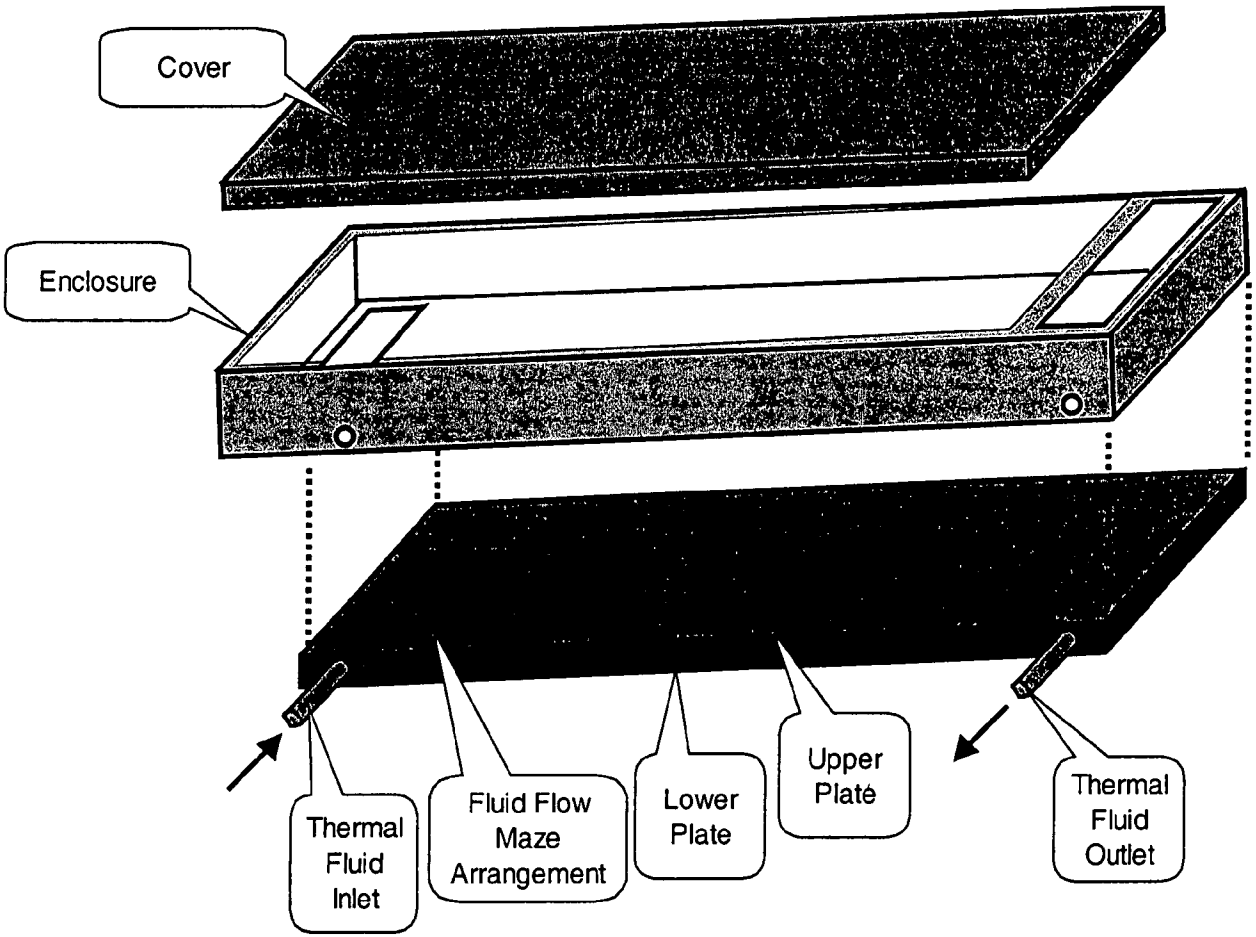
FIG. 57 shows Channels Conduct Heating Fluid.
Figure 58:
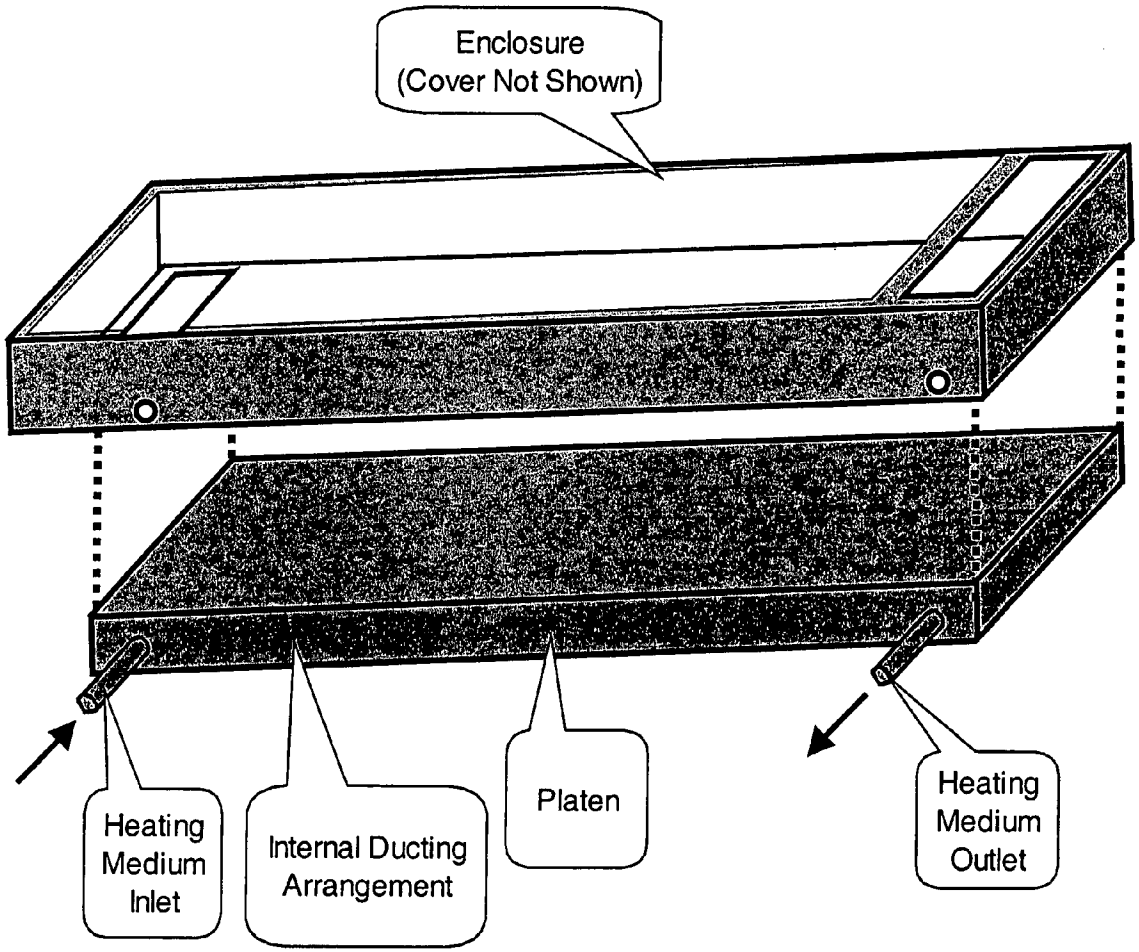
FIG. 58 shows Heating Medium Is Conducted Through Ducting In A Pressurized Plate.

The bottom surface is composed of another chamber in which channels conduct a heated fluid such as thermal oil to evenly heat the material-heating surface. This may be configured as the example shown in FIG. 56 or as some other method such as that shown in FIG. 57 where a pressurized heating medium such as steam may be used.

Drying Problems

There are two difficulties involved with drying wood and other agricultural materials. These are the release of volatile organic compounds (VOCs) to the atmosphere and "case hardening" of the material.

Blue Haze

VOCs are found within the materials and are released in greater abundance upon the application of higher temperatures. This produces a visual atmospheric effect called "blue haze" and appears to be a kind of smoke to the untrained eye. Blue haze occurs mostly where the dry material is subjected to high temperature. Often the effect is more evident when drying "green" material. This is because dryer temperatures can be increased without risk of fire. Therefore, the processing rate can easily be increased by simply increasing temperature but with the penalty of increased blue haze.

When wood material passes through the system, the outer surfaces of the material particles are often dry and thus become heated to much higher temperatures than would be possible if moisture were present within the material surface. VOCs are thus more rapidly driven off.

Blue haze is especially visible as it comes out of the dryer stack on cold days. On very warm days it may not be seen as easily at the stack but it will, nevertheless, frequently hang in a kind of pollution cloud over the community where the facility is located. To eliminate or alleviate the problem, facility owners have installed pollution control devices such as regenerative thermal oxidizers (RTO) or electrostatic precipitators (ESP).

Case Hardening

Case hardening is an effect on aqueous or agricultural products that is caused when the drying process is of a temperature too high. The result is that the surface is over-dried while water deeper within the material it trapped.

Water existing within the cells themselves is called "bound" water. This portion of "moisture" in wood is more difficult to dry from the overall particle. Under normal conditions bound water will migrate from cell to cell until it exits the particle at the surface. However, under conditions of case hardening, bound water cannot easily migrate from the cells deeper within the particle though the adjacent outer cells and ultimately to the surface because the outer cells no longer function.

This problem is common in lumber kilns where the drying speed is a direct result of the temperature. Case hardening can occur when operators "push" the limits too much in an effort to increase drying production.

Stickiness

In addition to the drying issue, there is a problem known as "sticky material" that often results when heat is applied directly to wood and other agricultural materials during the drying process. Sap migrates to the surface of the material. The problem that this causes is the collection of material on the conveying equipment in the dryer and machinery subsequent in the handling process.

Drying Solutions

The Christoffersen Dryer solves the issues of blue haze and case hardening by providing a means of reducing dryer temperatures and controlling the surface moisture. The capacity of the dryer can be increased easily by increasing the length and/or width of the fluidized bed surfaces. In other words, the contact time, otherwise known as dwell time, is increased. Since capacity is a function of time, the temperature can be reduced to dry the same volume of material within the given time period. When the temperature is reduced, blue haze is reduced. In addition, the case hardening effect is reduced.

Another means to solving these problems is incorporated into the Christoffersen Dryer. This is to control the humidity in which the drying to be achieved. When the humidity is high, the effects of case hardening and blue haze are markedly reduced. The reason is because the humidity protects the outer "shell" of material from being totally dried. Therefore, the bound water found in cells deeper within the particle or chip is able to efficiently migrate to the surface. Therefore, the temperature may actually be increased to accomplish the task within a shorter period that would otherwise be necessary with a better effect on blue haze.

This hypothesis is born out in a comparison of triple-pass drying as opposed to single-pass drying. Although the single-pass drying was conducted under higher temperatures, the blue haze effect was much better than it was with lower volumes of triple-pass drying even when the single-pass dryer produced two or three times the volume. This example is not uncommon. Indeed, the Rader Company claimed that a single-pass dryer would normally out-perform an equivalent capacity triple-pass dryer for blue haze under equal conditions with the same wood species. There are others in the industry that also make the same claim.

Pollution Control

A third means to controlling blue haze is in the lesser amount of pollution control equipment required in the Christoffersen Dryer compared to current systems. The amount of air that is required to sweep the system of moisture-laden air is only a fraction by comparison. Where the rotary dryer requires 200 or 300 HP to drive the main fan, the Christoffersen dryer is expected to be 10 to 30 HP. Therefore, the ESP or RTO pollution control devices need only be sized to 10 percent of that required under older methods. Alternatively, these small amounts of air can be directed into the forced draft fan intake on existing boilers or other furnaces.

Zone Configuration

The best performance for drying agricultural materials, particularly wood, is to begin heating the material in a zone of higher temperature and humidity. After the material is heated and begins to lose some of its moisture, the temperature may be reduced. In the third or final phase, the temperature and humidity should be reduced until the desired drying target is achieved.

Figure 59:
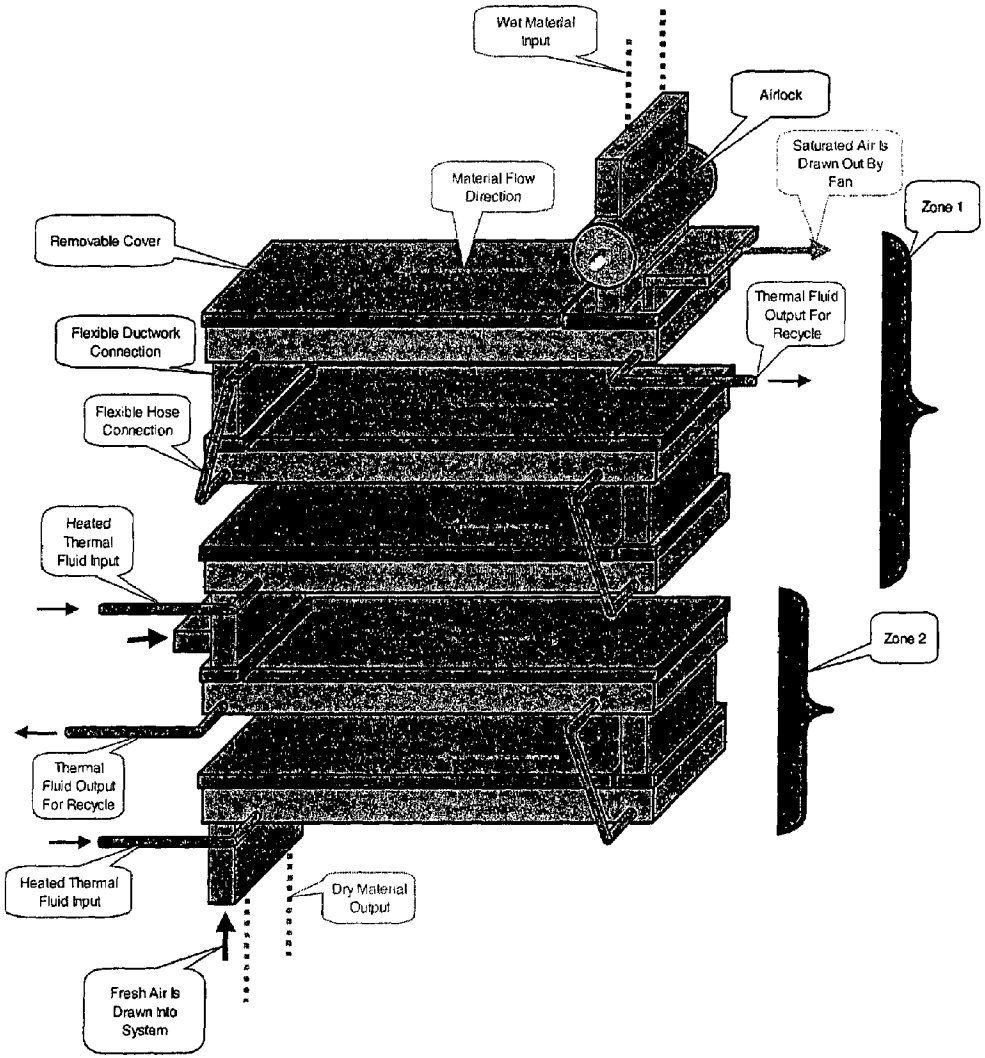
FIG. 59 shows Stacking Arrangement.

The Christoffersen Dryer can be configured with zones so that temperature and humidity are optimally controlled. There is no limit to the number of zones of individual temperatures and zones of humidity(s) that may be designated. FIG. 59 on the next page illustrates the concept of multiple fluidized bed units configured in two zones. The zones of temperature and humidity are configured in the same zones together for illustrative purposes. However, zones of humidity are not necessarily optimally configured when matched to the zones of temperatures. In addition, more zones may be added with or without adding more fluidized bed units.

The fluidized bed units in FIG. 59 are illustrated in a "stacked" configuration in order to reduce the required floor space in the plant facility.

Material Input

The material should be evenly spread as it is introduced to the dryer. An even distribution of material across the width will increase the process efficiency in speed and moisture control. Therefore, a metering bin of some type should be utilized to feed the material in a uniform manner. An airlock in the position shown in FIG. 59 above will assist in providing an optimal control of airflow through the dryer system.

Airflow

Airflow is controlled through the zones in order to control humidity at each zone. A single main fan can be utilized to pull air from a variety of ports through the dryer unit. Humidity is determined by the amount of air allowed to enter each zone. Humidity should be monitored automatically and dampers controlled by Computerized Numerical Control (CNC) or Programmable Logic Control (PLC) to achieve the desired humidity at each of the various zones.

Heating Medium Flow

The heating medium flow can be routed from one fluidized bed to another. The connections to rout the fluid either to another fluidized bed or back to the heater will determine the length of a zone. As with the airflow control, the heating medium or fluid flow and temperature should be monitored and controlled by CNC or PLC.

Sticky Material

The effect of controlling the humidity in zones as described has an additional effect upon the wood material that greatly reduces the amount of sap material migrating to the surfaces of the wood.

In addition, the effect of controlling the temperatures in zones, as also previously described, provides a substantial control of the "stickiness" problem. If the final zones provide some cooling to the wood, the stickiness is also reduced.

These two factors provide the means to prevent the sticky material build-up that might otherwise be created within the dryer and any material handling equipment subsequent to the drying process.

Fluidized Bed Drive Methods

Figure 60:
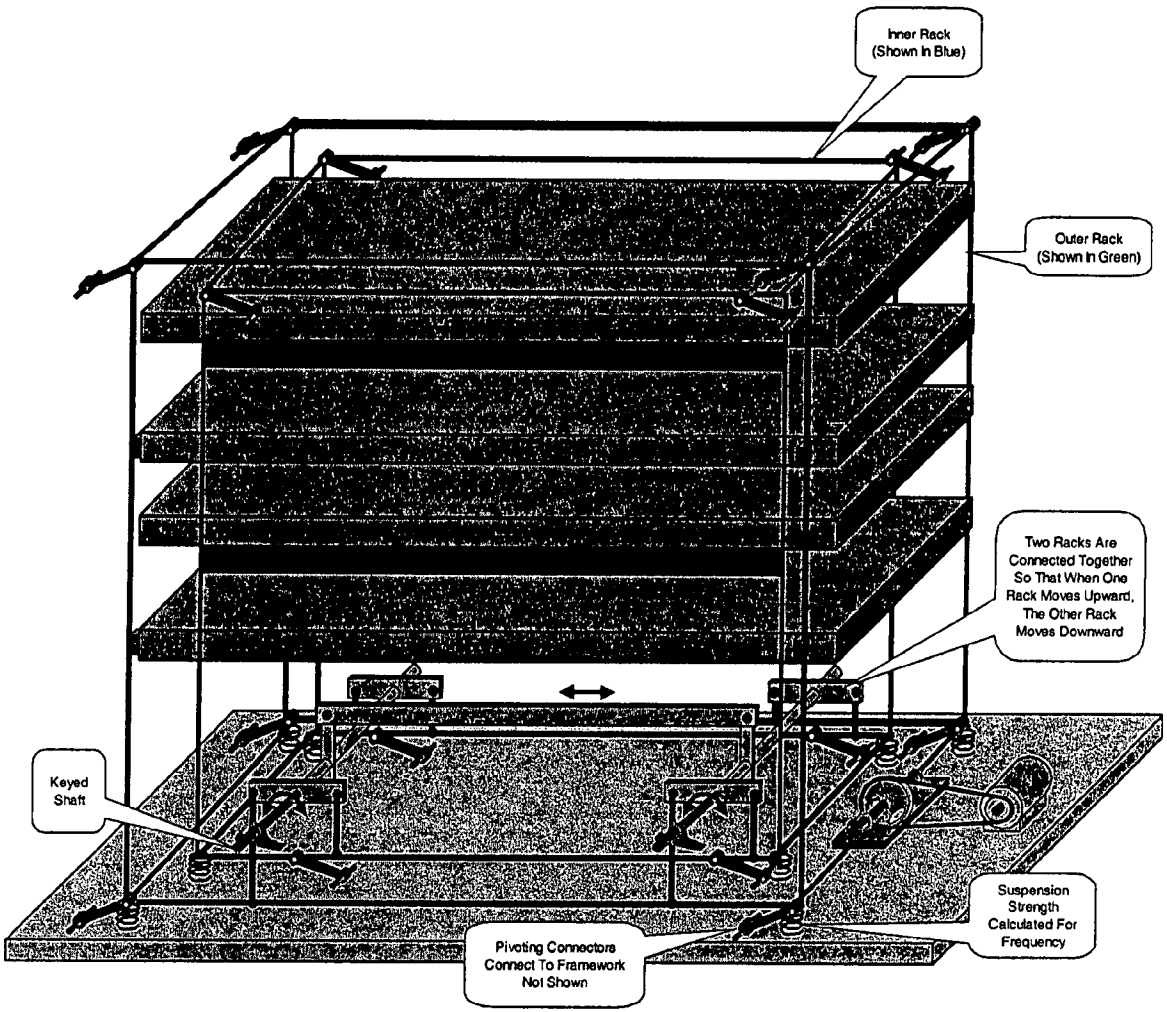
FIG. 60 shows Stacking Arrangement Mounted Into Two Frames That Are Nested Together.

The entire stack of fluidized bed units shown in FIG. 59 may be driven from a single drive. The proper sloping of the individual beds can be beneficial; every other unit sloped in the opposite direction. Even so, this will not be the best arrangement for optimal conveying. FIG. 60 on the next page illustrates a more efficient type of arrangement.

There are two sets of fluidized beds attached to two different frames. The two frames are arranged independent of each other so that they do not collide. Every other fluidized bed is attached to the first frame while the remaining fluidized beds are attached to the other frame. The two frames are then connected to the drives so that when one frame is moving downward, the other frame is moving upward. FIG. 60 also illustrates an example of such a connection.

The weight of the first assembly is balanced to the weight of the second assembly thereby eliminating the effect of gravity for even a very large dryer system. The momentum effect of the weight traveling in the up or down direction is converted into the work of compressing the springs.

Springs shown in FIG. 60 represent a suspension than might be utilized. It is important that the spring strength be calculated to a harmonic resonance at the desired fluidization vibration frequency. If this arrangement is properly calculated and the weights of the two assemblies are equal, only a minimal horsepower will be necessary to mechanically drive the system. For comparison, if a vibratory conveyor is designed correctly, only a small amount of power is normally required to drive it. Such conveyors are actually manufactured with a larger drive only to start and bring the system up to the harmonic frequency. Similarly, therefore, the Christoffersen Dryer system requires only a very small amount of power to mechanically operate the device and regardless of the size and number of fluidized beds or the size of the system.

Moisture Content By Material Size

Generally all particleboard material sizes have been dried together in a rotary drum dryer. Still, the smaller particles that dry faster are conveyed by air through the system faster due to their lighter comparative weight. Although not perfect, this phenomenon tends to produce particles that have more homogenous moisture contents. However, this becomes a non-issue as the material is introduced to the press. Besides, fine material tends to accumulate a higher amount of moisture in the blending operation.

Nevertheless, the Christoffersen dryer is able to maintain higher moistures in the finer fractions due to the higher humidity in the various zones. The greater the percentage of time the materials spend within the higher humidity zones, the more uniform the moisture final will be. The final zone temperature and humidity are reduced. This slower drying in the final zone produces a more uniform moisture content across the particle size spectrum. Thus, the moisture may be controlled evenly for particle size. Conversely, lower moisture contents in the finer fractions may be achieved by manipulating the humidity and temperatures in various zones.

Due to the risks of fire in the dryer, there has always been an optimal lowest moisture content limit in every drying operation for board production. However, this problem is greatly alleviated in the Christoffersen dryer. Indeed, it is conceivable that material moisture can be reduced to zero by extending the final zone drying period or increasing the overall temperature. Naturally, measures must be taken to assure fire is not caused downstream when the very dry material is subjected to further operations.

Preheating Function

The Christoffersen Dryer can be utilized to preheat material for process at an economical rate and without damaging the material already for process. This is a very useful advantage in startup conditions where a board manufacturing plant has been down for repairs or other stoppages. The startup period is often difficult and preheated material offers a solution that is not readily available otherwise. Preheating can also vastly increase board production because the material is already at a higher temperature before it is placed into the press.

The Christoffersen Dryer as a preheater should be placed in a position just before or immediately after the resin blender. The idea is to heat the material only enough to bring it to optimal manufacturing conditions. Too much heat too fast will initiate the resin curing process. Therefore, a gentle heating of the material is important.

Humidity control is not so important in a preheater configuration. Yet, it is possible to control the moisture content of the material in this manner.

Re-heating Function

In the process of manufacturing particleboard and MDF, it is common to reject material that has been prepared with resin ("furnish") as a result of mat trimming, mat reject or production line shutdown. This material is normally routed back and metered into the blender for reconstituting so that it can be re-used. It is important that the material maintain resin "tack" so that a mat can be formed with good holding qualities in order to be conveyed into the press without cracks or fissures. Without good tack, this is not possible. As material is rejected and a period of time has passed, the material loses its tack.

By all appearances it seems that this loss is due to a drying out of the wood material or is caused by the resin being absorbed into the wood material. However, it turns out that the resin within the furnish can be revitalized by simply warming it to the optimal operating temperature. A modified version of the Christoffersen dryer can be utilized to gently warm the rejected material for re-processing. If the temperature is low enough, the resin will not be cured prior to re-use and only a minute percentage of moisture is evaporated away. Therefore, rejected material does not need further resin application or other treatment thus saving the cost of additional resin. This is a tremendous advantage for board manufacturers, particularly where cold climate conditions heavily influence the board manufacturing process.

Retrofit Projects

The device or devices may be utilized as a new installation or a retrofit project. There is a particular marketing advantage in presenting the method as a retrofit project. States and power companies may provide financing rebates for projects based upon the reduction of energy consumption. Oregon, Washington, Idaho, and Montana are states offering such an energy program.

The United States government offers another program for reduced energy consumption. The advantage offered by states and by the federal government can be combined.

A dryer project replacing a rotary drum dryer system in the Pacific Northwest with the method presented in this document could easily be financed through the rebate. The entire project could be paid for out of energy savings within three years.

Dryer Summary

This application has described a material dryer and/or drying method that requires less capital investment, lower operating costs, and less floor space to achieve better drying control than devices currently on the market. In addition, the device may be utilized for preheating, and re-heating of materials at a location near the blender or forming line.

The device and method work well conceptually in retrofit situations as well as in new facility installations. As a new project, there are many opportunities for new equipment installations of pre-heaters and re-heaters in existing facilities as well as lower-cost systems in new plant installations. As retrofit projects, capacity increases, modernization, and reduced energy consumption projects represent a vast area of opportunity.

Section XII

The Pulse Continuous Press

Continuous Press Introduction

This section will present the Christoffersen continuous pressing concept. This machine can be considered a type of an extruder where material is formed to a profile during the extrusion process. The profile happens to be flat when normal particleboard, OSB and MDF panels are manufactured. However, with certain modifications the profile can be altered to become the extrusion shape desired. This means the machine can be utilized for a variety of products with adaptation to the material requirements. For example, if we desired to manufacture a solid aluminum extruded shape from an aluminum bar, this machine could conceivably be configured to perform the task. It may be that a roller type of machine would prove more efficient for such a task, but such an application concept is still viable.

A useful feature to the machine is its potential to tolerate much higher moisture content levels than ever possible before. For example, particleboard is normally manufactured on the production line at approximately 10 percent moisture content. Excessive moisture under normal operating temperatures and cycle times will create "blows" or "blisters" when the pressure of the press is finally relieved from the product. However, this press can tolerate moisture content values of 20 percent, 30 percent and perhaps more without failures to the product due to internal steam pressure. The principle will apply to the manufacturing process for OSB, MDF, particleboard, laminated veneer lumber (LVL) and similar products.

Another interesting attribute of this press is its potential to tolerate much higher temperatures without creating "blows" or "blisters" in the pressing operation. Again, the principle applies to this variety of products.

These two features combined, high temperature tolerance and high moisture tolerance, create a condition in which resins can be cured much more quickly. Faster cure is due to the potentially much higher operating temperatures. In addition, heat is transferred much more quickly due to the fast migration of steam through the product to the interior or core. The overall result is a much shorter pressing time requirement. This translates into higher capacity for a given press length. Conversely, the press length can be shorter than those available on the market today for a given capacity. Thus, the amount of energy required to press a given board product is considerably reduced.

A third feature is related to product thickness. Other continuous presses available are not very efficient in manufacturing board products at thicknesses much greater than ⅝ inch (19 mm). However, this press can conceivably operate at a very wide range of thicknesses. An operating range between ⅛ inch and 3 inches (3 mm-75 mm) is not beyond practicality. This means the concept can be applied to manufacturing laminated veneer lumber (LVL) and similar products as well as panel board products.

General Observations

Conventional continuous presses squeeze the material down to the desired thickness as it is conveyed through the press. The speed of closing to thickness is determined by the slope of the platens and associated conveying equipment at the input end. The closing speed relative to the platen temperature and material thickness determines the properties of the end product. Therefore, the speed must be precisely controlled to achieve the desired effects.

Once the desired product thickness is achieved, the distance between the parallel upper and lower platens is maintained through the remainder of the press length or cycle. The product is conveyed at a speed calculated to provide enough time to heat the product and cure the resin before the product leaves the exit end of the press.

The Pulse Press Concept

Figure 61:
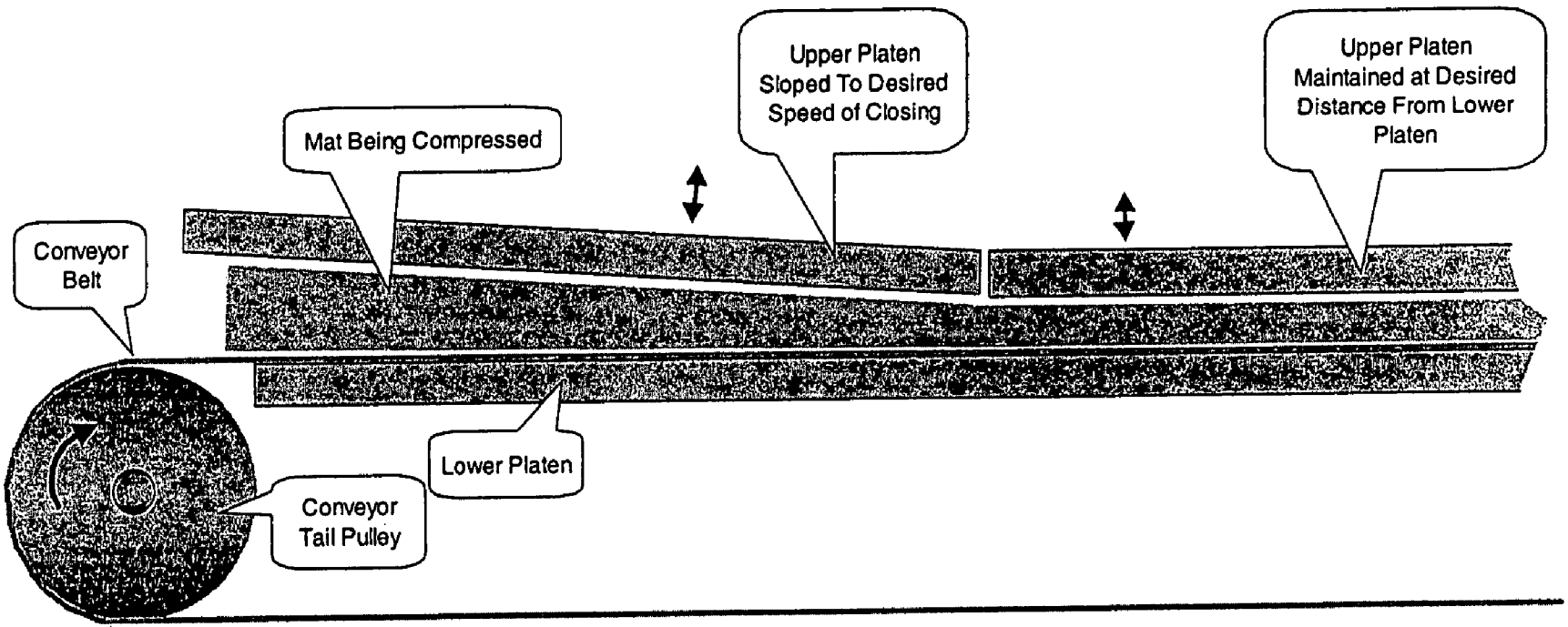
FIG. 61 shows Inlet of Christoffersen Continuous Press.

The Christoffersen continuous press utilizes a different concept to bring the product from an over-thickness mat down to board thickness. Rather than squeezing continuously until the proper thickness is achieved, the Christoffersen press utilizes the concept of impact to deliver the required force in pulses. This is accomplished by vibrating the platen within a precise distance range. As material passes under the vibrating platen, work is done to the material in controlled amounts that meet the required closing speed. The FIG. 61 illustrates the concept.

There are many conventions being challenged with this concept. First, the product is not always under pressure as with all conventional methods of pressing. This might raise a concern about the product relaxing or "spring back" occurring during those periods when the platen is not in contact with the product. However, if the frequency of the vibration cycle is sufficient, there will be no time for spring-back.

Ordinarily, spring-back is caused by two internal board forces, compressed material and steam pressure built up within the board during the press cycle. If the resin has not yet cured, there will be too much force to hold the proper product thickness when the pressure is released as the board exits the press.

In the Christoffersen press, the steam pressure is not being built up. Rather, steam is allowed to leave the product through the surfaces as it is being generated. This means that little internal pressure other than that of material under compression exists to cause spring-back. Spring-back pressure will decrease as the product moves through the press. This is due to the curing of the resin and to no build-up of internal steam pressure.

Additionally, steam will move both directions as it is being generated. That is, steam will move inward toward the core as well as outward toward the surfaces. This means that heat transfer does not rely solely upon contact as with conventional presses. Steam provides a much faster method of heating the product. Thus, the Christoffersen press heats the product very rapidly because heat is being transferred by steam.

In conventional presses, the product internal pressure is very high except toward the end of the cycle when pressure is released. Therefore, steam cannot be created until the end of the pressing cycle. In other words, even though the product has accumulated temperatures of greater than the boiling point of water internally, due to the pressure applied to the product no steam is generated from the moisture contained within the product material.

Since steam is being released throughout the entire pressing cycle in the Christoffersen press, higher percentages of moisture are tolerated in the product material. Additionally, higher temperatures of the platens will not create excessive internal steam pressures. Accordingly, the Christoffersen press is much more tolerant of higher temperatures and moisture contents than are conventional presses.

This means the capital and operating costs for drying material in preparation for the board production line process can be significantly reduced. Reduced drying capacity requirements will also reduce the capital and operating costs of pollution control. Emissions from the press area are already being controlled in modern plants and such associated air volumes are substantially less than those normally required in drying operations.

"Wind" Effect

When multi-opening presses are closed rapidly, there is a volume of air that must be pushed from each opening as the daylight is taken out. In addition, some air remains within the mat that is also pushed out rapidly for a short period. A wind is effectively created by these two amounts of air. If the press closing speed is not controlled properly, the wind will disturb some parts of the mat and cause defects.

In the Christoffersen continuous press the cycling of the platens up and down can create a wind effect. However, the distance of platen travel is very short. Therefore, the volume of air being displaced is small despite very large width capacity potentials. Even so, there are ways to address the problem.

Multiple Platen Configuration

Since the platen is not always in contact with the product, it is possible to have gaps between platens as shown in the above example where the two upper platens are not connected. Multiple spaces and multiple platens as shown in FIG. 62 are also possible.

This sort of arrangement makes it possible to evacuate excess air rapidly without disturbing the mat. Additionally, a negative balance can be placed at each gap to evacuate air and emissions. In this example, all of the upper platens would be connected to a single movable frame or perhaps to two movable frames. If two frames are utilized, then the sloped portion would be attached to one frame while the remaining platens would be attached to the other.

Conveying

Figure 62:
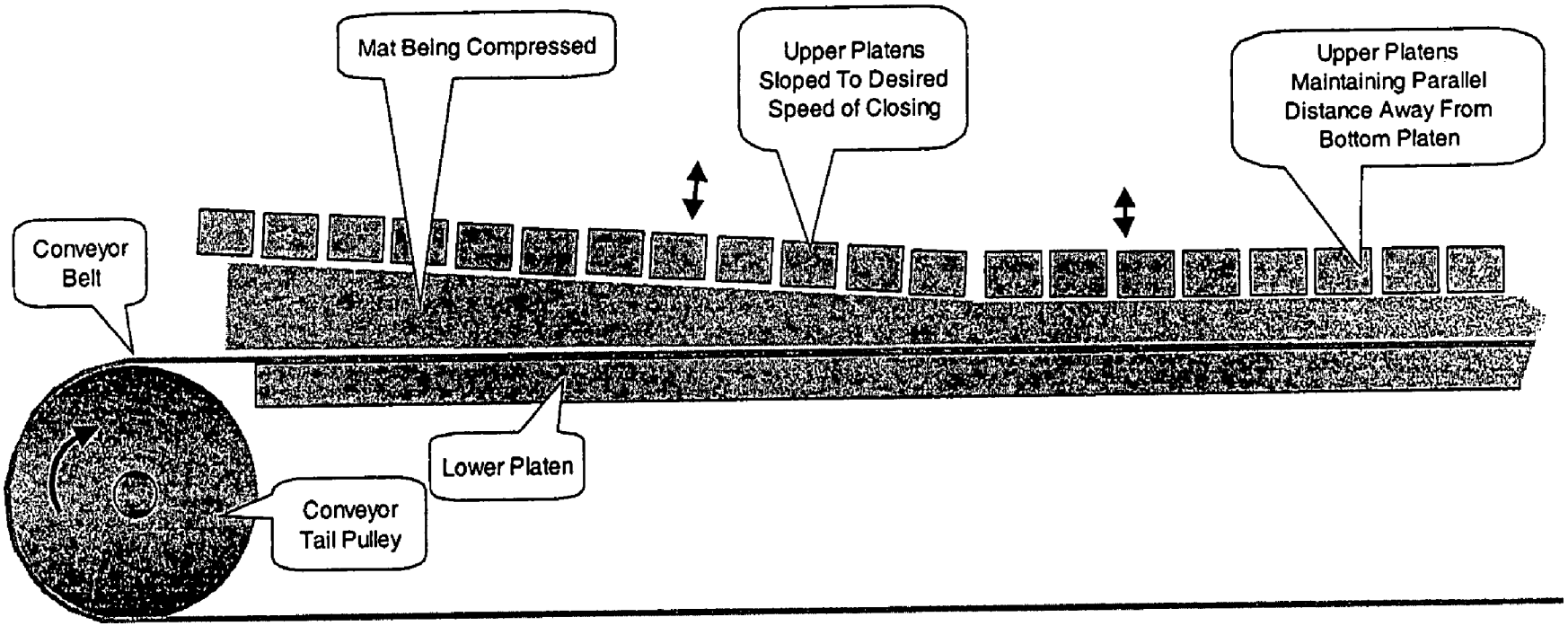
FIG. 62 shows Multiple Upper Platens.

The mat in FIG. 62 is shown being conveyed by a single belt below the product. However, this is not the only method of conveying possible. A belt top and bottom can also be utilized. It may seem as though the mat might be held together better with a two-belt design. It might also prevent sticking of the product to the platens. However, once the surface has been sufficiently cured there is no chance of the material sticking to the platens or of falling apart.

Sticking is not normally an issue. Indeed, this problem has been solved in the past. If the platens are properly designed and prepared they will not stick to the material. If the material does not stick, then there is little reason for the mat to fall apart if properly conveyed.

If a conveyor belt on the top and bottom is utilized, then part of the pulse effect will be lost. However, it should be pointed out here that although conventional continuous presses utilize steel conveyor belts, that is not necessary in the Christoffersen continuous press. This is because of the reduced friction. Therefore, Teflon belts or some other high-temperature fabric belt can replace the steel belt. This resolves a lot of issues inherent in conventional continuous presses. The issue of wind is different due to the fact that the conveyor belts will be in contact with the product.

Figure 63:
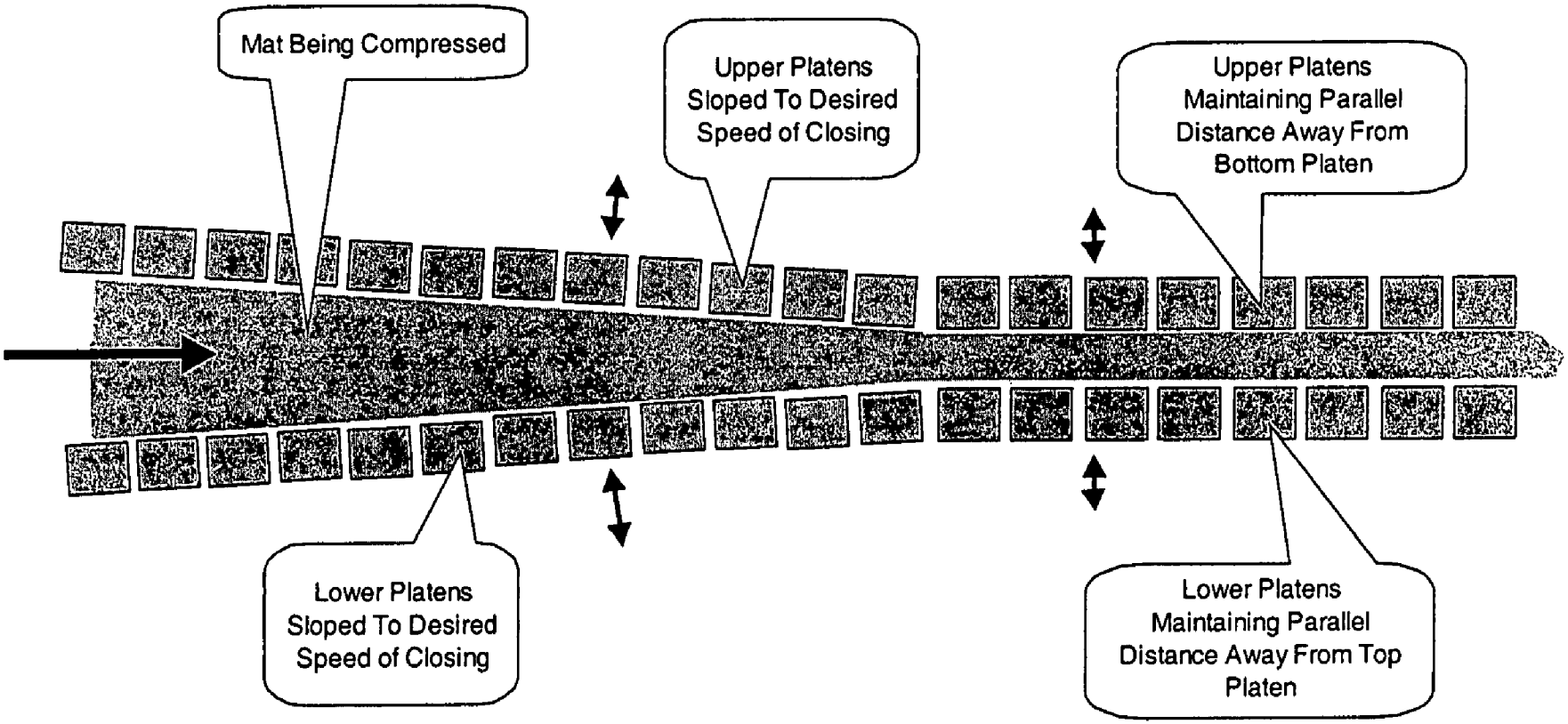
FIG. 63 shows Continuous Press with Vibrating Platens Top & Bottom.

"Beltless" conveying is an alternative method of conveying. FIGS. 61 and 62 have shown a fixed platen on the bottom and the vibrating platens on the top only. FIG. 63 illustrates another configuration where both the top and bottom platens are vibrated.

In FIG. 63 the top and bottom frames holding the top and bottom platens are connected in a way that allows the both platens to move toward the product and then away. That is, as one frame moves upward, the other moves downward and then the directions are reversed. Thus, we have the effect of gravity eliminated if both frame sets are equal in weight.

Figure 64:
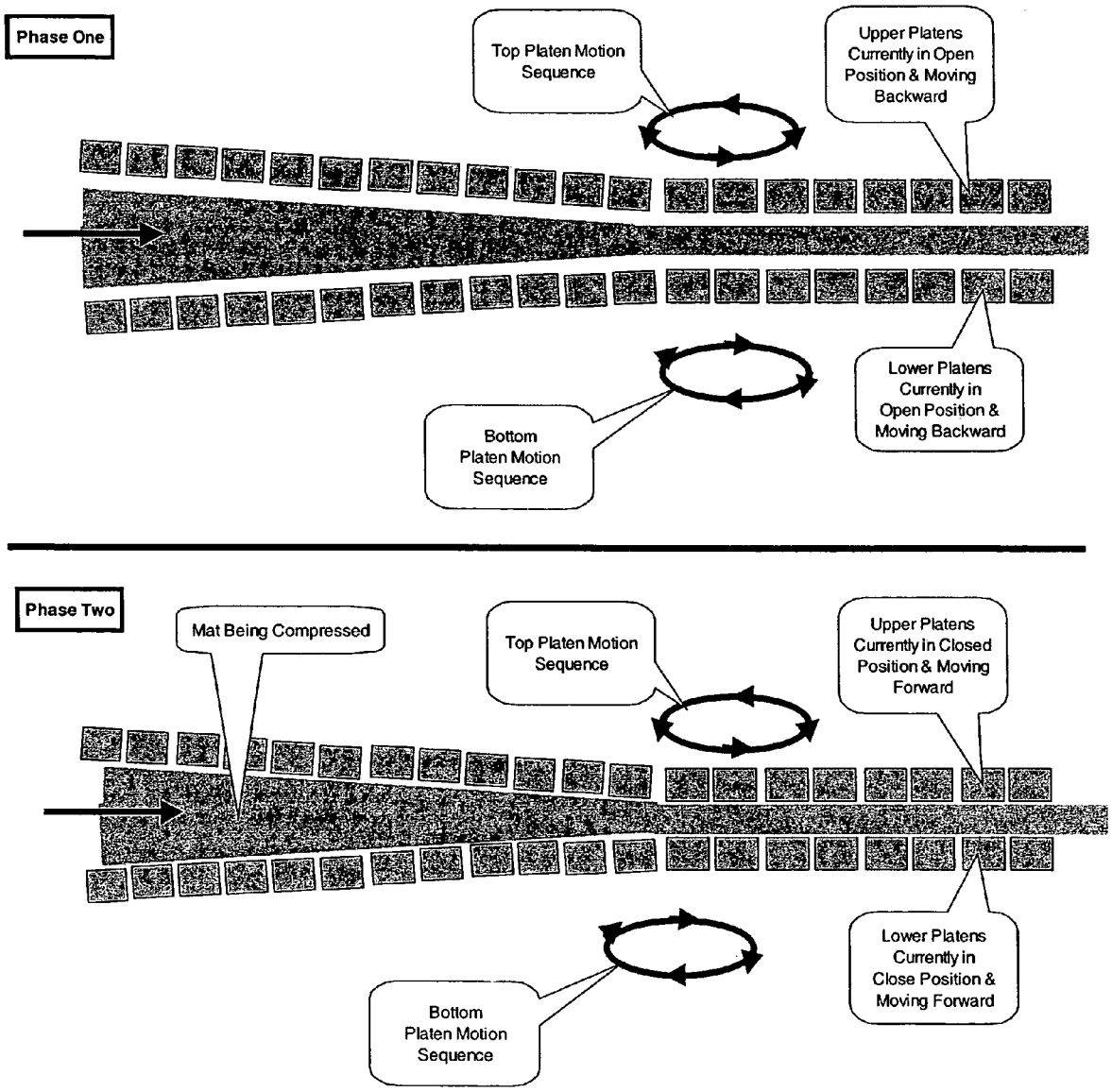
FIG. 64 shows Continuous Press Conveying Forward.

In addition to the up and down motion, a second motion of left-to-right is to be introduced. Gravity is not involved in this component. To achieve this motion, the two frames are mounted onto a framework that is suspended from a pivot or is made to travel in a slot. The drive for this component is connected to or is in phase with the up and down motion. At the moment when the top and bottom platens meet the product, the motion left-to-right conveys the material to the right. The following FIG. 64 illustrates the concept.

Figure 65:
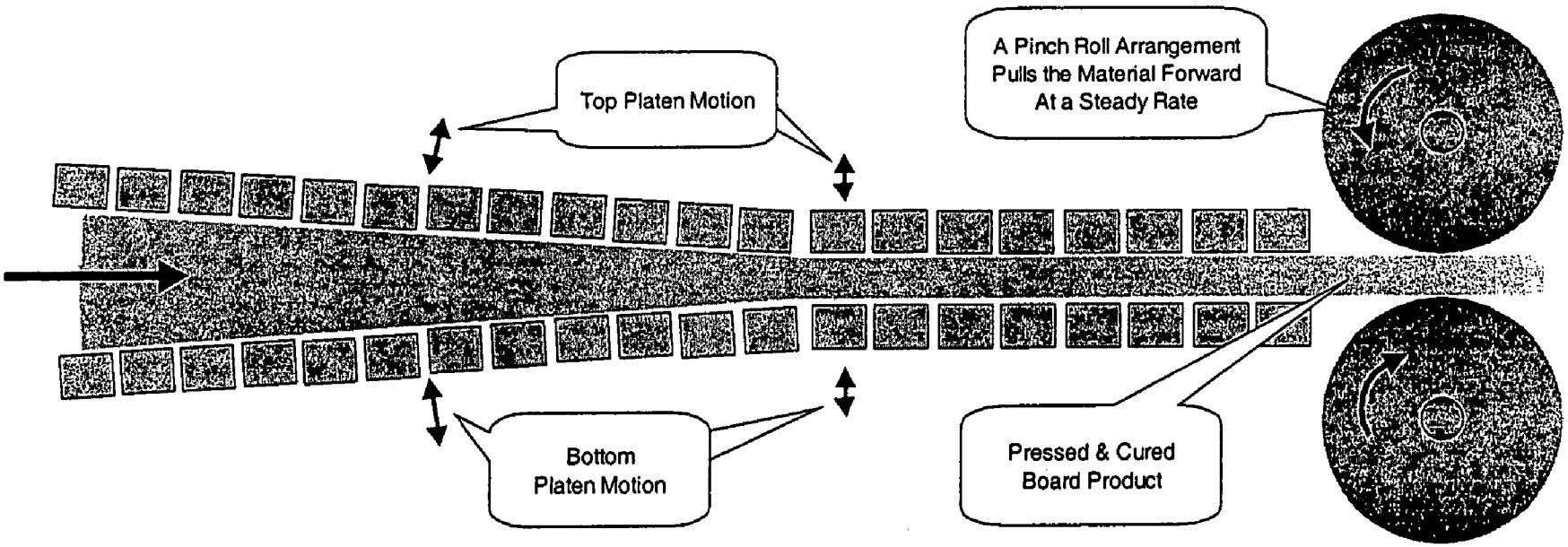
FIG. 65 shows Pinch Roll Conveying.

The resulting motion of the platens illustrated above is an elliptical or orbital pattern. This is achieved by increasing speed of the left-to-right motion over the speed of the up and down motion. Therefore, if the speed is greater during the same period, the distance is greater. This conveying motion has been demonstrated on computer in a software program called "Working Model." Although the motion is somewhat unpredictable due to the brief period the product is captured between the two sets of platens, it does convey forward. There are ways to improve this predictability. FIG. 65 illustrates one method.

The pinch rolls pull the board product forward at a steady rate. This rate can be pulsed in sequence with the platen closing. Optionally, platen conveying can be added.

Figure 66:
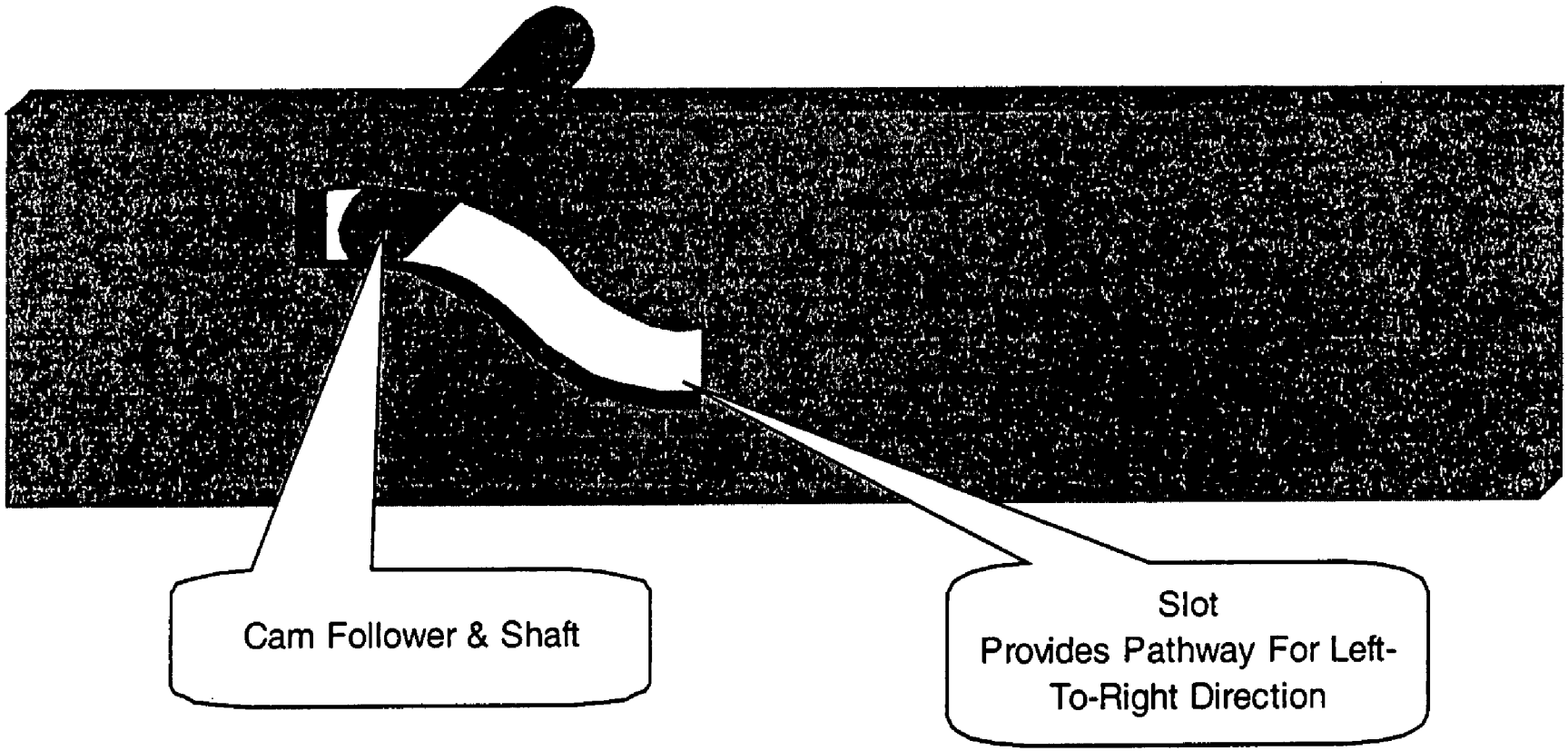
FIG. 66 shows Cam Follower & Slot Left-To-Right Pathway for Top Platen Framework.

Another method involves increasing the percentage of time the platens are in contact with the board product. This can be achieved in several ways. One example is by means of a slot in which the left-to-right framework is made to follow. (Conveying right-to-left is comprised of the same concepts.) FIG. 66 illustrates how this concept can be implemented.

Figure 67:
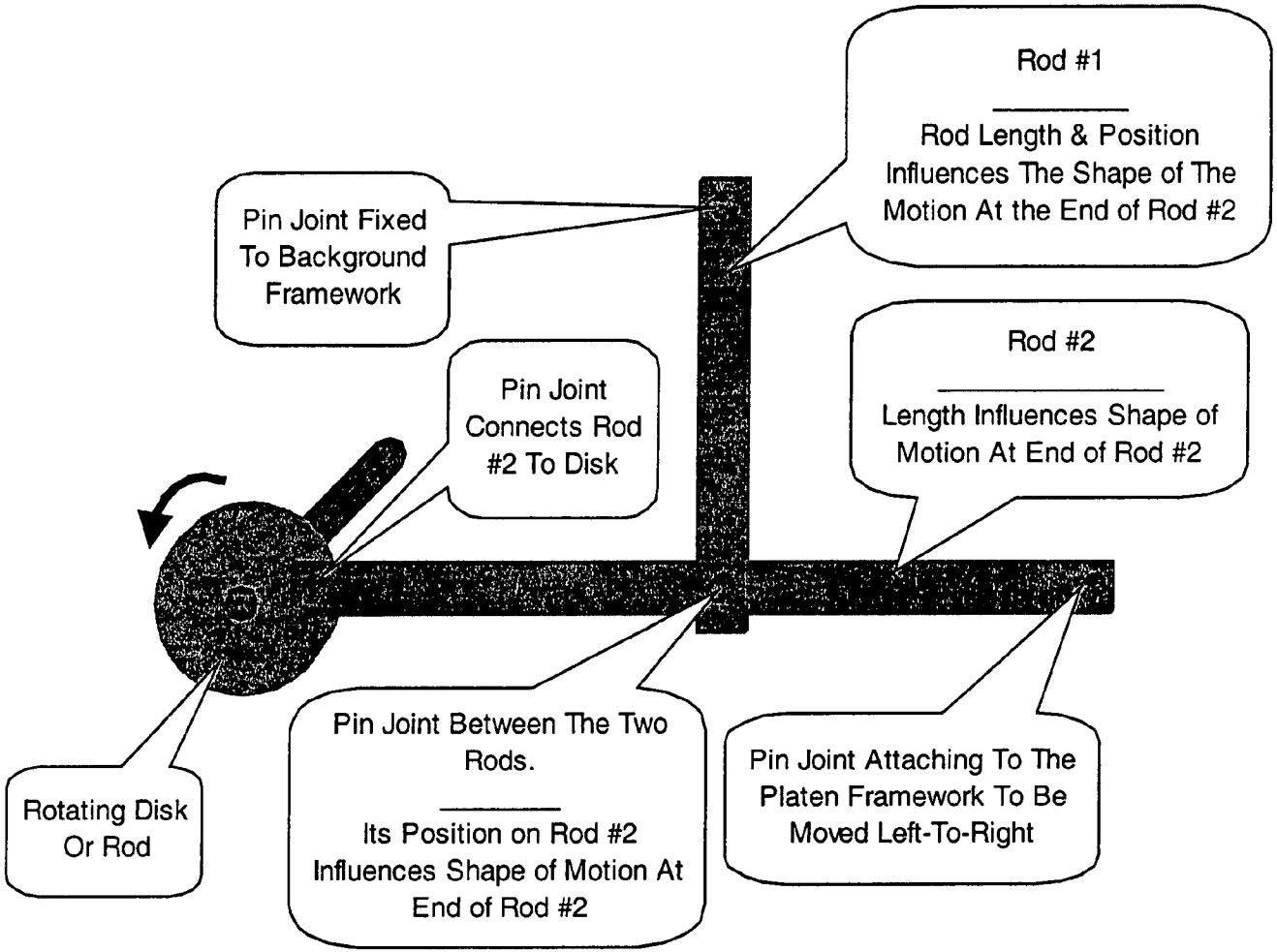
FIG. 67 shows Example D-drive Linkage.

This function can also be derived from a standard "D-drive" linkage arrangement. Furthermore, a complete system that combines the motions of up, down, left and right can be driven by a D-drive linkage. The fact that this motion is only a few millimeters in all directions should be also underscored here. The FIG. 67 on the next page illustrates one form of a D-drive linkage. This very small degree of movement makes the task of engineering these motions without large power consumption much more manageable.

Spring Tension/Length & Harmonic Frequency

If a weight is suspended from a spring, there is a harmonic up and down frequency in which the energy is nearly conserved. The losses due to friction in the bearing surfaces and in compressing the spring are the only power consuming components. An example of a use in practice is the fluidized bed conveyor. Well-designed fluidized conveyor systems generally utilized very little horsepower except in the startup stage. Once the conveyor is operating, the springs provide nearly all of the power required in both directions. Power losses consist of friction in the bearings and in the springs themselves.

If the effect of gravity is eliminated from the Christoffersen continuous press platen as previously described, then only the effect of momentum must be eliminated. This is accomplished by suspending the platen frameworks from a spring assembly network. Once completed, the springs store the kinetic energy of the traveling platens and frameworks until it is released to drive the mass in the opposite direction. Naturally, the springs must be designed so that the harmonic frequency of the total spring matches the desired frequency. Spring design can be variable so that the frequency, travel distance and travel direction can be changed as desired. Finally, connection to a motor drive or a magnetic drive creates a driven harmonic motion. If the drive is a motor, the speed can be varied. If the drive source is a magnetic pulse, the frequency and magnitude of pulse can be varied.

The mass of the board product being compressed acts as a damper on the spring. However, the amount of damper in the total system will be very small by comparison to the total mass in motion and thus not insurmountable.

The spring arrangement must be designed to accommodate the forward conveying as well. Therefore, it might be best to utilize two systems that can be adjusted to create a wide operating range for frequency and distance of travel in both the y and x directions.

The fastest speed of the platen travel will be about midway between the two extreme directions. The slowest speed will be at the apex of the travel direction. This fact can be utilized to optimize the conveying. At the point where the speed has been reduced, contact will be made with the board product. Then forward motion is engaged. At the apex of the forward motion, the board is released and travel is reversed. This period of time is more manageable as the speed is reduced.

Motion & Conveying Speed

If the amount of movement in the left-to-right direction is 4 millimeters, then the amount of conveying at 50 hertz will be 200 mm per second or 12 meters (39 feet) per minute. Models created in Working Model indicate frequencies of this magnitude are easily obtainable and require only minimal power. Nevertheless, there is another method of increasing the conveying speed without increasing the frequency and increase the accuracy and predictability of the forward travel as well.

The platens on the top and bottom are separated into two sets. Every other platen is a member of the first set and the remaining are members of the second set. Next, the two sets of platens are fixed to their two frameworks. Now, both sets can be operated in the same way as before but can also be operated in the opposite phase. That is, while the first set is closing and then going forward, the second set is opening and then moving backward.

Figure 68:
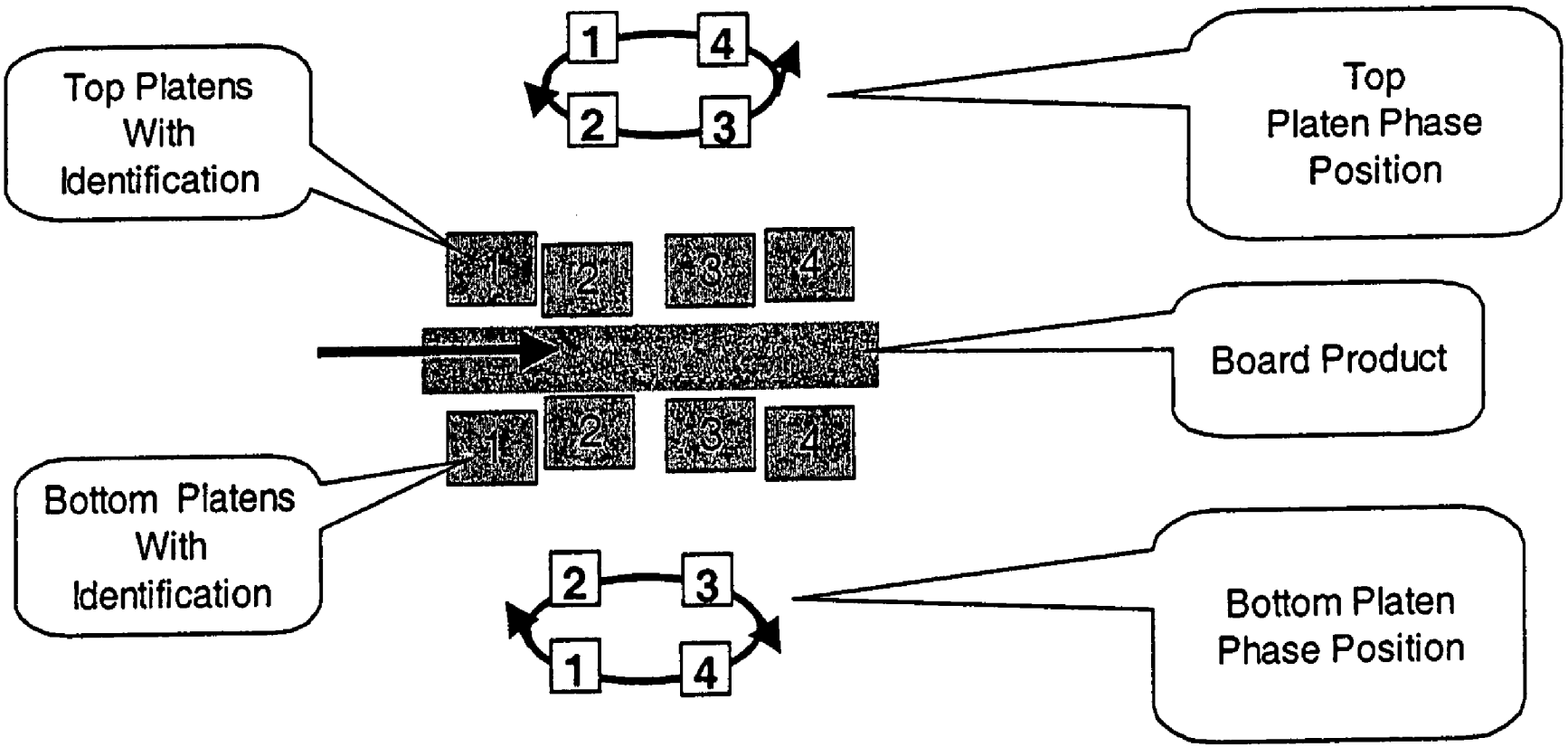
FIG. 68 shows Example Phase Positioning of 4 sets of Platens.

This method provides a very powerful control of the forward motion. In addition, it doubles the forward speed at the same frequency and distance of travel. There is no limit to the number of sets into which the platens can be separated. Nevertheless, a value of three or four sets seems to be the most probable optimum. At 4 sets using the above parameters yields a conveyor speed of 156 FPM (47.5 meters) from the previous 39 FPM. FIG. 68 illustrates the positions of the 4 phases of a 4-phase system at a given moment in time.

Figure 69:
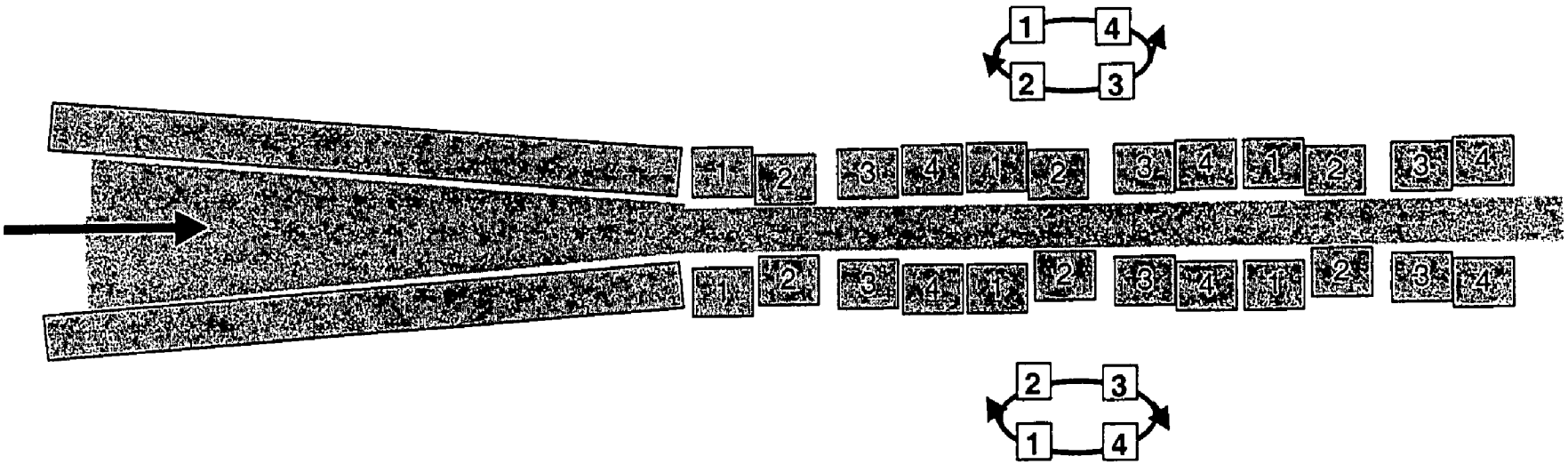
FIG. 69 shows Continuous Press with Example Multiphase Platen Configuration.

The above orbital motions are shown with the phase position of each set of platens. FIG. 69 illustrates a more complete illustration of a press configuration.

Of course, the press length can be any desired length that will provide the capacity necessary for the customer's requirements.

The above figure shows solid platens in the compression zones rather than smaller width multiple platens. It is possible under certain conditions that solid platens will be required in the first zone in order that the surface integrity is maintained until the surface layer is sufficiently cured. In that case, longer platens will perform better. When longer platens are required, the motion phase must be matched to one set of the platens in the curing section of the press. Alternatively, the compression zone can be configured to operate at a frequency that will match the combined frequency of the platen sets in the curing section.

This can be accomplished in two ways. The first way is to orbit at the multiple phase frequency. In the case shown in the above two figures, this is 4 times the rate of any one of the 4 sets. The second way is to keep the same frequency in the compression zone but match the sideways travel to that of the conveying speed in the curing zone. In the above example, this will be 4 times any one of the sets travels per cycle.

Alternative Compression Zone Configuration

Figure 70:
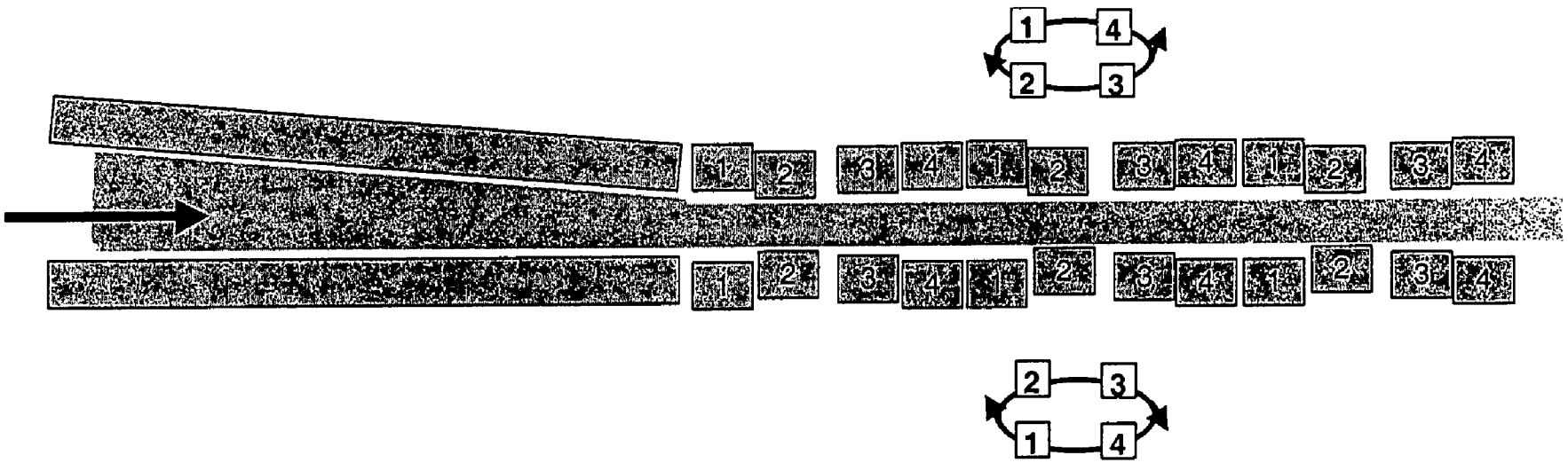
FIG. 70 shows Multiphase Configuration with Upper Tapered Compression Zone.

There is a variation to these ways as illustrated in FIG. 70.

In the FIG. 70 example, the upper platen only in the compression zone is sloped. All press configurations shown thus far can be modified to such a compression zone.

Thickness Control

The first consideration must be to achieve a precise control of the platen travel at the points of "fully open" and "fully closed." Maintaining control of the fully open position is of little concern except that reversing travel in the wrong place upon fully open would affect the fully closed point. Maintaining the fully closed position with precision is critical. However, controlling these two points will prove to be easily feasible in actual practice. Once the operating frequency has been achieved after startup, the points of fully open and fully closed will become precisely repeatable within a very small range. Tolerances of only a few thousandths of an inch are conceivable. Additionally, any variation is reduced as the frequency is increased. The reader should also keep in mind that the total range of travel is expected to only be a few millimeters in the up and down direction.

The material being compressed will provide a resistance to the platen closing travel. However, this will be compensated for by a CNC control. The power, platen travel and frequency can be monitored to provide inputs to the CNC process. Then the amount of spring length, strength, and/or tension can be adjusted to obtain the harmonic frequency. The frequency could also be changed but if the operator is given the control to "dial in" a desired frequency and conveyor speed, then it seems best to simply control the springs. Nevertheless, a variety of parameters can be CNC controlled to optimize the manufacturing process if designed that way.

Once the above considerations have been designed for, the thickness control is dependent upon simply setting the distance between the upper and lower platens to establish the thickness of the final product. A variety of methods already exist for setting the distance between the upper and lower platens in conventional continuous presses. Such devices will provide a variety of means of setting the distance in the Christoffersen pulse continuous press.

In the Christoffersen press there must be independent frameworks top and bottom that contain the platen frames and the spring assemblies. These frames then can be adjusted for distance apart. The distance between the top and bottom platens will be the objective but the frames will provide the base for the adjusting device. If the top and bottom are tied together to eliminate the effect of gravity as discussed above, then there will be an additional adjustment for setting the connection between the two platens as well. It should be pointed out here that the springs can be made to accommodate the effect of gravity without connecting the upper and lower sets together. The harmonic frequency can be established for the springs required with the added weight. Thus, the effect of gravity is overcome either way.

Additional feedback from product thickness gauges at strategic locations in the pressing process and at the exit end will provide another method of controlling product thickness.

Once a measurement indicates over or under thickness, the CNC control will make correction adjustments to the thickness settings in the press.

Continuous Press Conclusion

This press is different than any other on the market. It offers faster curing time, less operating cost and conceivably less capital cost.

The lower operating cost is partly due to less energy consumption. The forms of reduced energy include reduced drying, pollution control, and conveying electricity. Since this machine provides much better control of product internal steam there will be fewer rejects due to product blisters or blows, thus reducing operating cost. The cost of wasted material is reduced because of the better thickness control provided by this press. The associated cost of sanding off any additional thickness that would otherwise be present in competitive conventional continuous presses is also eliminated.

Lower capital cost is due to the smaller size requirement. This smaller size requires fewer platens, fewer major frameworks, and less installation and shipping costs. In addition, less factory space is required. There is also a capital cost associated with the time saved by manufacturing and installing the Christoffersen continuous press over competitive presses. This involves interest costs and cost of risk for large capital projects.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A drying machine for a mat material, comprising:

a heated, fluidized bed conveyor for heating of the mat material; and a humidity controller for preventing "case hardening " of the mat material when drying, wherein said fluidized bed conveyor is divided into at least two substantially equally weighted portions, wherein a first portion off-sets gravity influence of another section via the interconnection of said portions such that while one portion is traveling in a first direction, the other portion is traveling in an opposing direction.

2. The machine, according to claim 1, wherein said mat material is selected from the group consisting of wood, tobacco, and aggregate products.

3. The machine according to claim 1, wherein said humidity controller controls the humidity in zones.

4. The machine according to claim 2, wherein said humidity controller controls the humidity in zones.

* * * * *